US005558966A

United States Patent [19]

Kato et al.

[11] Patent Number: 5,558,966

[45] Date of Patent: Sep. 24, 1996

[54] ELECTROPHOTOGRAPHIC LIGHT-SENSITIVE MATERIAL

[75] Inventors: Eiichi Kato; Kazuo Ishii, both of Shizuoka, Japan

[73] Assignee: Fuji Photo Film Co., Ltd., Kanagawa, Japan

[21] Appl. No.: 454,492

[22] Filed: May 30, 1995

Related U.S. Application Data

[63] Continuation of Ser. No. 30,498, Mar. 30, 1993, abandoned.

[30] Foreign Application Priority Data

| | | | |
|---|---|---|---|
| Jul. 30, 1991 | [JP] | Japan | 3-211350 |
| Aug. 5, 1991 | [JP] | Japan | 3-218048 |
| Oct. 11, 1991 | [JP] | Japan | 3-290457 |
| May 26, 1992 | [JP] | Japan | 4-157277 |
| May 26, 1992 | [JP] | Japan | 4-157278 |
| Jul. 30, 1992 | [WO] | WIPO | PCT/JP92/00967 |

[51] Int. Cl.$^6$ ..... G03G 5/05

[52] U.S. Cl. ..... 430/96

[58] Field of Search ..... 430/96, 95

[56] References Cited

U.S. PATENT DOCUMENTS

| | | | |
|---|---|---|---|
| 5,021,311 | 6/1991 | Kato et al. | 430/96 |
| 5,089,368 | 2/1992 | Kato et al. | 430/96 |
| 5,183,721 | 2/1993 | Kato et al. | 430/96 |
| 5,200,105 | 4/1993 | Kato | 430/96 |
| 5,459,005 | 10/1995 | Kato et al. | 430/96 |

FOREIGN PATENT DOCUMENTS

| | | |
|---|---|---|
| 2-134641 | 5/1990 | Japan . |
| 2-135457 | 5/1990 | Japan . |
| 2-247656 | 10/1990 | Japan . |
| 3-100657 | 4/1991 | Japan . |

OTHER PUBLICATIONS

International Search Report for PCT/JP92/00967 (Oct. 1992).

*Primary Examiner*—Christopher D. Rodee

*Attorney, Agent, or Firm*—Sughrue, Mion, Zinn, Macpeak & Seas

[57] ABSTRACT

An electrophotographic light-sensitive material which has improved electrostatic characteristics and image forming performance and is excellent particularly in reproducibility of highly accurate image using a liquid developer and image forming performance upon a scanning exposure system using a laser beam of a low power.

The electrophotographic light-sensitive material contains, as a binder resin, at least one resin selected from a low molecular weight resin ($A_1$) formed from a macromonomer containing a polymer component of formula (I) and a monomer of the formula (I), a low molecular weight resin ($A_2$) formed from a macromonomer containing at random polar groups and a low molecular weight resin ($A_3$) formed from a macromonomer containing polar groups as a block, and a resin (B) which is a medium to high molecular weight AB block copolymer comprising an A block containing a specified polar group and a B block containing a polymer component of formula (I).

Formula (I)

wherein $a^1$ and $a^2$: hydrogen, halogen, a cyano group, a hydrocarbon group, —$COOR^4$ or —$COOR^4$ bonded via a hydrocarbon group ($R^4$: hydrocarbon group), and $R^3$: a hydrocarbon group.

7 Claims, No Drawings

ELECTROPHOTOGRAPHIC LIGHT-SENSITIVE MATERIAL

This is a Continuation of application Ser. No. 08/030,498 filed Mar. 30, 1993, now abandoned.

TECHNICAL FIELD

The present invention relates to an electrophotographic light-sensitive material, and more particularly to an electrophotographic light-sensitive material which is excellent in electrostatic characteristics and moisture resistance.

TECHNICAL BACKGROUND

An electrophotographic light-sensitive material may have various structures depending upon the characteristics required or an electrophotographic process to be employed.

Typical electrophotographic light-sensitive materials widely employed comprise a support having provided thereon at least one photoconductive layer and, if necessary, an insulating layer on the surface thereof. The electrophotographic light-sensitive material comprising a support and at least one photoconductive layer formed thereon is used for the image formation by an ordinary electrophotographic process including electrostatic charging, imagewise exposure, development, and, if desired, transfer.

Furthermore, a process using an electrophotographic light-sensitive material as an offset master plate precursor for direct plate making is widely practiced. In particular, a direct electrophotographic lithographic plate has recently become important as a system for printing in the order of from several hundreds to several thousands prints having a high image quality.

Under these circumstances, binder resins which are used for forming the photoconductive layer of an electrophotographic light-sensitive material are required to be excellent in the film-forming properties by themselves and the capability of dispersing photoconductive powder therein. Also, the photoconductive layer formed using the binder resin is required to have satisfactory adhesion to a base material or support. Further, the photoconductive layer formed by using the binder resin is required to have various excellent electrostatic characteristics such as high charging capacity, small dark decay, large light decay, and less fatigue due to prior light-exposure and also have an excellent image forming properties, and the photoconductive layer stably maintains these electrostatic properties in spite of the fluctuation in humidity at the time of image formation.

Further, extensive studies have been made for lithographic printing plate precursors using an electrophotographic light-sensitive material, and for such a purpose, binder resins for a photoconductive layer which satisfy both the electrostatic characteristics as an electrophotographic light-sensitive material and printing properties as a printing plate precursor are required.

It has been found that the chemical structure of binder resin used in a photoconductive layer which contains at least an inorganic photoconductive substance, a spectral sensitizing dye and a binder resin has a great influence upon the electrostatic characteristics as well as smoothness of the photoconductive layer. Among the electrostatic characteristics, dark charge retention rate (D.R.R.) and photosensitivity are particularly affected.

Techniques for improvements in smoothness and electrostatic characteristics of a photoconductive layer by using a resin of a graft type copolymer having a low molecular weight and containing an acidic group at one terminal of the copolymer main chain or the graft portion thereof are described, for example, in U.S. Pat. No. 5,021,311, JP-A-2-247656 (the term "JP-A" as used herein means an "unexamined published Japanese Patent Application") and U.S. Pat. No. 5,089,368.

Further, techniques for improving a mechanical strength of a photoconductive layer by using the above described low molecular weight resin containing an acidic group together with a medium to high molecular weight resin are described, for example, in JP-A-2-96174, JP-A-2-127651, JP-A-2-135454, JP-A-2-134641, JP-A-2-272560, JP-A-2-304451, JP-A-2-308168, JP-A-3-42666, JP-A-3-77953, JP-A-3-77955, U.S. Pat. No. 5,116,710 JP-A-3-223762, JP-A-3-238463, JP-A-3-238464, JP-A-3-261957, JP-A-3-259152, JP-A-4-15655, JP-A-4-20968, JP-A-4-25850, JP-A-4-29244, JP-A-4-30170, JP-A-4-37857, JP-A-4-39666, and JP-A-4-44047.

PROBLEMS TO BE SOLVED BY THE INVENTION

However, it has been found that, even in a case of using these various low molecular weight resins having an acidic group or in a case of using these low molecular weight resins together with medium to high molecular weight resins, it is yet insufficient to keep the stable performance in the case of greatly fluctuating the ambient conditions from high-temperature and high-humidity to low-temperature and low-humidity. In particular, in a scanning exposure system using a semi-conductor laser beam, the exposure time becomes longer and also there is a restriction on the exposure intensity as compared to a conventional overall simultaneous exposure system using a visible light, and hence a higher performance has been required for the electrostatic characteristics, in particular, the dark charge retention characteristics and photosensitivity.

Further, when the scanning exposure system using a semiconductor laser beam is applied to hitherto known light-sensitive materials for electrophotographic lithographic printing plate precursors, various problems may occur in that the difference between $E_{1/2}$ and $E_{1/10}$ is particularly large and the contrast of the duplicated image is decreased. Moreover, it is difficult to reduce the remaining potential after exposure, which results in severe fog formation in duplicated image, and when employed as lithographic printing plate precursors, edge marks of originals pasted up appear on the prints, in addition to the insufficient electrostatic characteristics described above.

Moreover, it has been desired to develop a technique which can faithfully reproduce highly accurate images of continuous gradation as well as images composed of lines and dots using a liquid developer. However, the above-described known techniques are still insufficient to fulfill such a requirement. Specifically, in the known technique, the improved electrostatic characteristics which are achieved by means of the low molecular weight resin may be sometimes deteriorated by using it together with the medium to high molecular weight resin. In fact, it has been found that an electrophotographic light-sensitive material having a photoconductive layer wherein the above described known resins are used in combination may cause a problem on reproducibility of the above described highly accurate image (particularly, an image of continuous gradation) or on image forming performance in case of using a scanning exposure system with a laser beam of low power.

The present invention has been made for solving the problems of conventional electrophotographic light-sensitive materials as described above and meeting the requirement for the light-sensitive materials.

An object of the present invention is to provide an electrophotographic light-sensitive material having stable and excellent electrostatic characteristics and giving clear good images even when the ambient conditions during the formation of duplicated images are fluctuated to low-temperature and low-humidity or to high-temperature and high-humidity.

Another object of the present invention is to provide a CPC electrophotographic light-sensitive material having excellent electrostatic characteristics and showing less environmental dependency.

A further object of the present invention is to provide an electrophotographic light-sensitive material effective for a scanning exposure system using a semi-conductor laser beam.

A still further object of the present invention is to provide an electrophotographic lithographic printing plate precursor having excellent electrostatic characteristics (in particular, dark charge retention characteristics and photosensitivity), capable of reproducing a faithful duplicated image to the original (in particular, a highly accurate image of continuous gradation), forming neither overall background stains nor dotted background stains of prints, and showing excellent printing durability.

Other objects of the present invention will become apparent from the following description.

DISCLOSURE OF THE INVENTION

It has been found that the above described objects of the present invention are accomplished by an electrophotographic light-sensitive material comprising a photoconductive layer containing at least an inorganic photoconductive substance, a spectral sensitizing dye and a binder resin, wherein the binder resin comprises at least one resin selected from resin ($A_1$), resin ($A_2$) and resin ($A_3$) shown below and at least one resin (B) shown below.

Resin ($A_1$):

A copolymer having a weight average molecular weight of from $1\times10^3$ to $2\times10^4$ and being formed from at least a monofunctional macromonomer ($M_1$) described below and a monomer corresponding to a repeating unit represented by the general formula (I) described below, wherein the copolymer has a polymer component containing at least one polar group selected from $-PO_3H_2$, $-SO_3H$, —COOH,

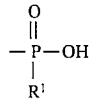

(wherein $R^1$ represents a hydrocarbon group or $-OR^2$ (wherein $R^2$ represents a hydrocarbon group)) and a cyclic acid anhydride group bonded at one terminal of the main chain thereof.

Monofunctional macromonomer ($M_1$):

A monofunctional macromonomer having a weight average molecular weight of not more than $2\times10^4$ and having a polymerizable double bond group bonded at only one terminal of the main chain of a polymer containing not less than 30% by weight of a polymer component corresponding to a repeating unit represented by the general formula (I) described below.

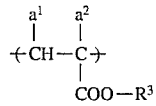

(I)

(wherein $a^1$ and $a^2$ each represents a hydrogen atom, a halogen atom, a cyano group, a hydrocarbon group, $-COOR^4$ or $-COOR^4$ bonded via a hydrocarbon group (wherein $R^4$ represents a hydrocarbon group); and $R^3$ represents a hydrocarbon group).

Resin ($A_2$):

A copolymer having a weight average molecular weight of from $1\times10^3$ to $2\times10^4$ and being formed from at least a monofunctional macromonomer ($M_2$) described below and a monomer corresponding to a repeating unit represented by the general formula (I) described above.

Monofunctional macromonomer ($M_2$):

A monofunctional macromonomer having a weight average molecular weight of not more than $2\times10^4$ and having a polymerizable double bond group at only one terminal of the main chain of a polymer containing at random not less than 30% by weight of a polymer component corresponding to a repeating unit represented by the general formula (I) described above and from 1 to 50% by weight of a polymer component containing at least one polar group selected from the specified polar groups as described in the resin ($A_1$) above.

Resin ($A_3$):

A copolymer having a weight average molecular weight of from $1\times10^3$ to $2\times10^4$ and being formed from at least a monofunctional macromonomer ($M_3$) described below and a monomer corresponding to a repeating unit represented by the general formula (I) described aobve.

Monofunctional macromonomer ($M_3$):

A monofunctional macromonomer having a weight average molecular weight of not more than $2\times10^4$, comprising an AB block copolymer being composed of an A block containing a polymer component containing at least one polar group selected from the specified polar groups as described in the resin ($A_1$) above and a B block containing a polymer component corresponding to a repeating unit represented by the general formula (II) described below and having a polymerizable double bond group bonded at the terminal of the main chain of the B block polymer.

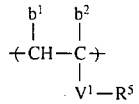

(II)

wherein $b^1$ and $b^2$ each represents a hydrogen atom, a halogen atom, a cyano group, a hydrocarbon group, $-COOR^4$ or $-COOR^4$ bonded via a hydrocarbon group (wherein $R^4$ represents a hydrocarbon group); $V^1$ represents —COO—, —OCO—, $$\text{-}(CH_2)_a\text{-}OCO\text{-},\quad \text{-}(CH_2)_a\text{-}COO\text{-}$$

(wherein a represents an integer of from 1 to 3), —O—, $-SO_2-$, —CO—,

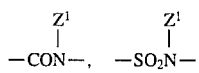

(wherein $Z^1$ represents a hydrogen atom or a hydrocarbon group), —CONHCOO—, —CONHCONH— or

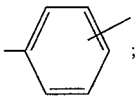

and $R^5$ represents a hydrocarbon group, provided that when $V^1$ represents

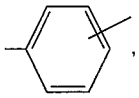

$R^5$ represents a hydrogen atom or a hydrocarbon group.

Resin (B):

An AB block copolymer having a weight average molecular weight of from $3\times10^4$ to $1\times10^6$ and comprising an A block containing a polymer component containing at least one polar group selected from the specified polar groups as described in the resin ($A_1$) above and a B block containing a polymer component corresponding to a repeating unit represented by the general formula (I) as described in the resin ($A_1$) above, wherein the A block contains the polymer component containing a polar group in an amount of from 0.05 to 10% by weight based on the AB block copolymer and the B block contains the polymer component represented by the general formula (I) in an amount not less than 30% by weight based on the AB block copolymer.

In short, the binder resin which can be used in the present invention comprises at least one of the resin ($A_1$) which is a copolymer formed from at least the macromonomer ($M_1$) described above and the monomer corresponding to the general formula (I) described above and having the specified polar group bonded at one terminal of the main chain thereof, the resin ($A_2$) which is a copolymer formed from at least the macromonomer ($M_2$) described above containing the specified polar group-containing component and the monomer corresponding to the general formula (I) described above, and the resin ($A_3$) which is a copolymer formed from at least the macromonomer ($M_3$) described above comprising an AB block copolymer being composed of an A block containing the specified polar group-containing component and a B block containing a polymer component represented by the general formula (II) described above and having a polymerizable double bond group bonded at the terminal of the B block polymer chain and the monomer corresponding to the general formula (I) described above (hereinafter, the macromonomers ($M_1$), ($M_2$) and ($M_3$) are generically referred to as a macromonomer (M), and the resins ($A_1$), ($A_2$) and ($A_3$) are generically referred to as a resin (A), sometimes), and the resin (B) which is an AB block copolymer comprising an A block containing the specified polar group-containing component described above and a B block containing a polymer component represented by the general formula (I) described above.

As a result of various investigations, it has been found that in the known technique wherein the low molecular weight resin containing a polar group is used together with the medium to high molecular weight resin, the improved electrostatic characteristics achieved by the low molecular weight resin are sometimes deteriorated by the medium to high molecular weight resin used together as described above. Further, it has become apparent that an appropriate action of medium to high molecular weight resin on the interaction between the photoconductive substance, spectral sensitizing dye and low molecular weight resin in the photoconductive layer is an unexpectedly important factor.

It has been found that the above described objects can be effectively achieved by using the AB block copolymer comprising an A block containing the polar group and a B block containing no polar group according to the present invention as a medium to high molecular weight resin to be used together with the low molecular weight resin (A) containing the polar group.

It is presumed that the electrostatic characteristics are stably maintained at a high level as a result of synergistic effect of the resin (A) and resin (B) according to the present invention wherein particles of photoconductive substance are sufficiently dispersed without the occurrence of aggregation, a spectral sensitizing dye and a chemical sensitizer are sufficiently adsorbed on the surface of particles of photoconductive substance, and the binder resin is sufficiently adsorbed to excessive active sites on the surface of the photoconductive substance to compensate the traps.

More specifically, the low molecular weight graft type copolymer resin (A) containing the specific polar group has the important function in that the resin is sufficiently adsorbed on the surface of particles of the photoconductive substance to disperse uniformly and to restrain the occurrence of aggregation due to its short polymer chain and in that adsorption of the spectral sensitizing dye on the photoconductive substance is not disturbed.

Further, by using the medium to high molecular weight AB block copolymer comprising an A block containing the specific polar group and a B block which does not contain the specific polar group, mechanical strength of the photoconductive layer is remarkably increased. This is believed to be based on that the A block portion of the resin has a weak interaction with the particles of photoconductive substance compared with the resin (A) and that the polymer chains of the B block portions of the resins intertwine each other.

Moreover, according to the present invention the electrostatic characteristics are more improved in comparison with a case wherein a known medium to high molecular weight resin is employed. This is believed to be based on that the resin (B) acts to control the disturbance of adsorption of spectral sensitizing dye on the surface of particles of photoconductive substance due to the polar group present in the A block portion which interacts with the particles of photoconductive substance.

As a result, it is presumed that the resin (B) appropriately effects on controlling the disturbance of adsorption of spectral sensitizing dye on the surface of particles of photoconductive substance and the electrophotographic interactions and increasing the strength of the photoconductive layer in a system wherein the particles of photoconductive substance, spectral sensitizing dye and resin (A) are coexistent with the resin (B), while details thereof are not clear.

This effect is especially remarkable in a case wherein polymethine dyes or phthalocyanine series pigments which are particularly effective as spectral sensitizing dyes for the region of near infrared to infrared light.

When the electrophotographic light-sensitive material according to the present invention containing photoconductive zinc oxide as the photoconductive substance is applied to a conventional direct printing plate precursor, extremely good water retentivity as well as the excellent image forming performance can be obtained. More specifically, when the light-sensitive material according to the present invention is subjected to an electrophotographic process to form an duplicated image, oil-desensitization of non-image portions by chemical treatment with a conventional oil-desensitizing solution to prepare a printing plate, and printing by an offset printing system, it exhibits excellent characteristics as a printing plate.

When the electrophotographic light-sensitive material according to the present invention is subjected to the oil-desensitizing treatment, the non-image portions are rendered sufficiently hydrophilic to increase water retentivity which results in remarkable increase in a number of prints obtained. It is believed that these results are obtained by the fact that the condition is formed under which a chemical reaction for rendering the surface of zinc oxide hydrophilic upon the oil-desensitizing treatment is able to proceed easily and effectively. Specifically, zinc oxide particles are uniformly and sufficiently dispersed in the resin (A) and resin (B) used as a binder resin and the state of binder resin present on or adjacent to the surface of zinc oxide particles is proper to conduct an oil-desensitizing reaction with the oil-desensitizing solution rapidly and effectively.

Now, the resin (A) which can be used as the binder resin for the photoconductive layer of the electrophotographic light-sensitive material according to the present invention will be described in more detail below.

The resin (A) according to the present invention is a graft type copolymer having a weight average molecular weight of from $1\times10^3$ to $2\times10^4$ and containing the polymer component represented by the general formula (I), and it includes three embodiments of the resin ($A_1$), ($A_2$) and ($A_3$) mainly depending on a kind of macromonomer used for forming a copolymer component.

The resin ($A_1$) is a graft type copolymer containing the polymer component represented by the general formula (I) in the graft portion and main chain portion thereof and having a polymer component containing the specified polar group bonded at one terminal of the main chain thereof.

The resin ($A_2$) is a graft type copolymer containing the polymer component represented by the general formula (I) in the graft portion and main chain portion thereof and containing the specified polar group-containing component at random in the graft portion thereof.

The resin ($A_3$) is a graft type copolymer containing the polymer component represented by the general formula (I) in the main chain thereof and containing the specified polar group-containing component as a block in the graft portion thereof.

The weight average molecular weight of the resin (A) is from $1\times10^3$ to $2\times10^4$, and preferably from $3\times10^3$ to $1\times10^4$. The glass transition point of the resin (A) is preferably from −30° C. to 110° C., and more preferably from −20° C. to 90° C.

If the weight average molecular weight of the resin (A) is less than $1\times10^3$, the film-forming property of the resin is lowered, thereby a sufficient film strength cannot be maintained, and on the other hand, if the weight average molecular weight of the resin (A) is higher than $2\times10^4$, the effect of the present invention for obtaining stable duplicated images is reduced since fluctuations of electrophotographic characteristics (particularly, initial potential, dark charge retention rate and photosensitivity) of the photoconductive layer, in particular, that containing a spectral sensitizing dye for sensitization in the range of from near-infrared to infrared become-somewhat large under severe conditions of high temperature and high humidity or low temperature and low humidity.

In the resin (A) according to the present invention, the total amount of polymer component containing the specified polar group present at the terminal of the main chain and the graft portion of a graft type copolymer is preferably from 0.5 to 20 parts by weight and more preferably from 1 to 15 parts by weight per 100 parts by weight of the resin (A).

If the content of the polar group-containing component in the resin (A) is less than 0.5% by weight, the initial potential is low and thus satisfactory image density is hardly obtained. On the other hand, if the content of the polar group-containing component is larger than 20% by weight, various undesirable problems may occur, for example, the dispersibility of photoconductive substance is reduced, and further when the light-sensitive material is used as an offset master plate, the occurrence of background stains may increase even a low molecular weight resin.

The weight average molecular weight of the macromonomer (M) used in the resin (A) is not more than $2\times10^4$.

If the weight average molecular weight of the macromonomer (M) exceeds $2\times10^4$, copolymerizability with other monomers, for example, those corresponding to the general formula (I) described in detail hereinafter is undesirably reduced. If, on the other hand, it is too small, the effect of improving electrophotographic characteristics of the light-sensitive layer would be small. Accordingly, the macromonomer (M) preferably has a weight average molecular weight of at least $1\times10^3$.

The content of the macromonomer (M) in the resin (A) is suitably from 1 to 70% by weight, and preferably from 5 to 50% by weight.

If the content of the macromonomer is less than 1% by weight in the resin (A), electrophotographic characteristics (particularly, dark charge retention rate and photosensitivity) may be reduced and the fluctuations of electrophotographic characteristics of the photoconductive layer, particularly that containing a spectral sensitizing dye for the sensitization in the range of from near-infrared to infrared become large depending on changes in ambient conditions. The reason therefor is considered that the construction of the polymer becomes similar to that of a conventional homopolymer or random polymer due to the presence of only a small amount of macromonomer which constitutes the graft portion. On the other hand, if the content of the macromonomer in the resin (A) exceeds 70% by weight, the copolymerizability of the macromonomer with other monomers corresponding to other copolymer components according to the present invention may become insufficient, and there is a tendency that the sufficient electrophotographic characteristics can not be obtained as the binder resin.

The content of the polymer component corresponding to the repeating unit represented by the general formula (I) copolymerizable with the macromonomer present in the resin (A) is suitably not less than 30% by weight, and preferably not less than 50% by weight.

The repeating unit represented by the general formula (I) above which is contained in the resin (A) will be described in greater detail below.

In the general formula (I), $a^1$ and $a^2$ each preferably represents a hydrogen atom, a halogen atom (e.g., chlorine and bromine), a cyano group, an alkyl group having from 1 to 4 carbon atoms (e.g., methyl, ethyl, propyl and butyl), —$COOR^4$ or —$COOR^4$ bonded via a hydrocarbon group (wherein $R^4$ represents a hydrogen atom or an alkyl, alkenyl, aralkyl, alicyclic or aryl group which may be substituted, and specifically includes those as described for $R^3$ hereinafter). Particularly preferably $a^1$ represents a hydrogen atom and $a^2$ represents a methyl group.

The hydrocarbon group in the above described —$COOR^4$ group bonded via a hydrocarbon group includes, for example, a methylene group, an ethylene group and a propylene group.

$R^3$ preferably represents a hydrocarbon group having not more than 18 carbon atoms, which may be substituted. The substituent for the hydrocarbon group may be any substituent other than the polar groups contained in the polar group-containing polymer component described above present in the resin (A). Suitable examples of the substituent include a halogen atom (e.g., fluorine, chlorine and bromine), —$OR^6$, —$COOR^6$, and —$OCOR^6$ (wherein $R^6$ represents an alkyl group having from 1 to 22 carbon atoms, e.g., methyl, ethyl, propyl, butyl, hexyl, octyl, decyl, dodecyl, hexadecyl and octadecyl). Preferred examples of the hydrocarbon group include an alkyl group having from 1 to 18 carbon atoms which may be substituted (e.g., methyl, ethyl, propyl, butyl, pentyl, hexyl, heptyl, octyl, decyl, dodecyl, hexadecyl, octadecyl, 2-chloroethyl, 2-bromoethyl, 2-cyanoethyl, 2-hydroxyethyl, 2-methoxycarbonylethyl, 2-methoxyethyl, 2-ethoxyethyl, 3-hydroxypropyl and 3-bromopropyl), an alkenyl group having from 2 to 18 carbon atoms which may be substituted (e.g., vinyl, allyl, 2-methyl-1-propenyl, 2-butenyl, 2-pentenyl, 3-methyl-2-pentenyl, 1-pentenyl, 1-hexenyl, 2-hexenyl and 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl and dimethoxybenzyl), an alicyclic group having from 5 to 8 carbon atoms which may be substituted (e.g., cyclopentyl, cyclohexyl, 2-cyclohexylethyl and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl and dodecyloylamidophenyl).

More preferably, the polymer component corresponding to the repeating unit represented by the general formula (I) is a methacrylate component having the specific aryl group represented by the general formula (Ia) and/or (Ib) described below. The low molecular weight resin containing the specific aryl group-containing methacrylate polymer component described above is sometimes referred to as a resin (A') hereinafter.

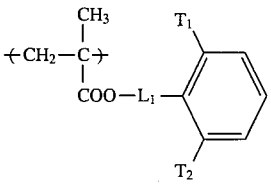
(Ia)

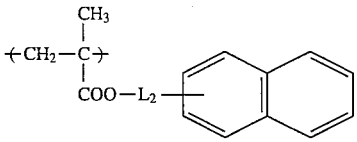
(Ib)

wherein $T_1$ and $T_2$ each represents a hydrogen atom, a halogen atom, a hydrocarbon group having from 1 to 10 carbon atoms, —$COR_a$ or —$COOR_a$, wherein $R_a$ represents a hydrocarbon group having from 1 to 10 carbon atoms; and $L_1$ and $L_2$ each represents a mere bond or a linking group containing from 1 to 4 linking atoms, which connects —COO— and the benzene ring.

In the resin (A'), the content of the methacrylate polymer component corresponding to the repeating unit represented by the general formula (Ia) and/or (Ib) is suitably not less than 30% by weight, preferably from 50 to 97% by weight, and the content of polymer component containing the specified polar group is suitably from 0.5 to 20% by weight, preferably from 1 to 15% by weight.

In case of using the resin (A'), the electrophotographic characteristics (particularly, $V_{10}$, D.R.R. and $E_{1/10}$) of the electrophotographic material can be furthermore improved.

In the general formula (Ia), $T_1$ and $T_2$ each preferably represents a hydrogen atom, a chlorine atom, a bromine atom, an alkyl group having from 1 to 4 carbon atoms (e.g., methyl, ethyl, propyl and butyl), an aralkyl group having from 7 to 9 carbon atoms (e.g., benzyl, phenethyl, 3-phenylpropyl, chlorobenzyl, dichlorobenzyl, bromobenzyl, methylbenzyl, methoxybenzyl and chloromethylbenzyl), an aryl group (e.g., phenyl, tolyl, xylyl, bromophenyl, methoxyphenyl, chlorophenyl and dichlorophenyl), —$COR_a$ or —$COOR_a$ (wherein $R_a$ preferably represents any of the above-recited hydrocarbon groups for $T_1$ or $T_2$).

In the general formulae (Ia) and (Ib), $L_1$ and $L_2$ each represents a mere bond or a linking group containing from 1 to 4 linking atoms which connects between —COO— and the benzene ring, e.g., $-(CH_2)_{n1}-$ (wherein $n_1$ represents an integer of 1, 2 or 3), —$CH_2OCO$—, —$CH_2CH_2OCO$—, $-(CH_2O)_{m1}-$ (wherein $m_1$ represents an integer of 1 or 2) and —$CH_2CH_2O$—, and preferably represents a mere bond or a linking group containing from 1 to 2 linking atoms.

Specific examples of the polymer component corresponding to the repeating unit represented by the general formula (Ia) or (Ib) which can be used in the resin (A) according to the present invention are set forth below, but the present invention should not be construed as being limited thereto. In the following formulae (a-1) to (a-17), n represents an integer of from 1 to 4; m represents an integer of from 0 to 3; p represents an integer of from 1 to 3; $R_{10}$ to $R_{13}$ each represents —$C_nH_{2n+1}$ or —$(CH_2)_mC_6H_5$ (wherein n and m each has the same meaning as defined above); and $X_1$ and $X_2$, which may be the same or different, each represents a hydrogen atom, —Cl, —Br or —I.

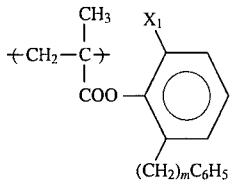
(a-1)

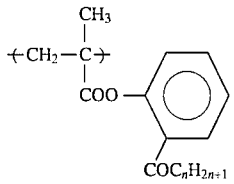
(a-2)

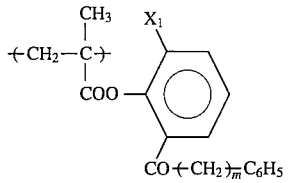
(a-3)

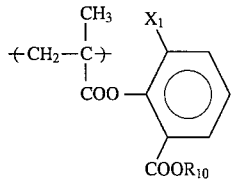
(a-4)

-continued (a-5)

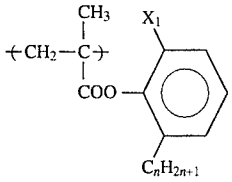

(a-6)

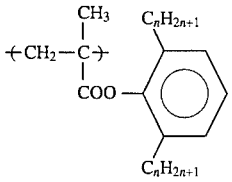

(a-7)

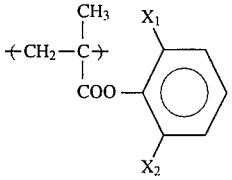

(a-8)

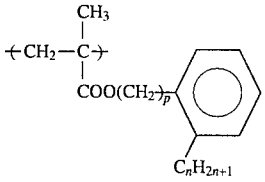

(a-9)

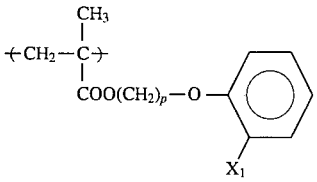

(a-10)

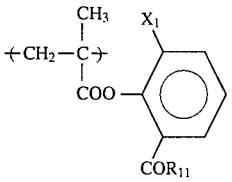

(a-11)

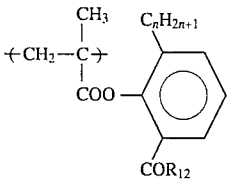

(a-12)

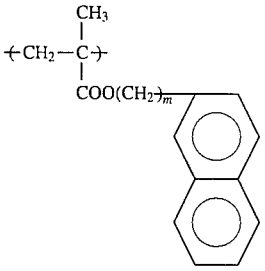

-continued (a-13)

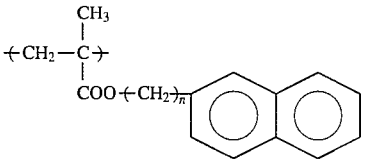

(a-14)

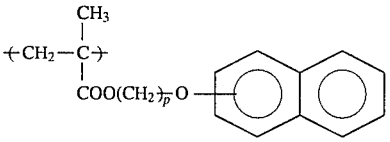

(a-15)

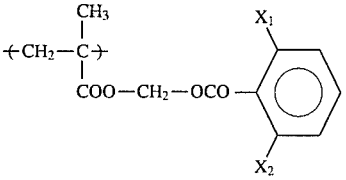

(a-16)

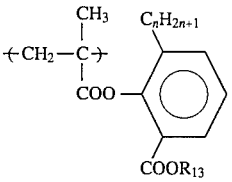

(a-17)

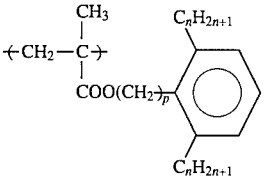

In the graft type copolymer according to the present invention, one or more other monomers may be employed as a component copolymerizable with the macromonomer (M) in addition to a monomer corresponding to the repeating unit of the general formula (I), (Ia) and/or (Ib). Examples of such monomers include, in addition to methacrylic acid esters, acrylic acid esters and crotonic acid esters containing substituents other than those described for the general formula (I), α-olefins, vinyl or allyl esters of carboxylic acids (including, e.g., acetic acid, propionic acid, butyric acid, valeric acid, benzoic acid and naphthalenecarboxylic acid, as examples of the carboxylic acids), acrylonitrile, methacrylonitrile, vinyl ethers, itaconic acid esters (e.g., dimethyl itaconate and diethyl itaconate), acrylamides, methacrylamides, styrenes (e.g., styrene, vinyltoluene, chlorostyrene, hydroxystyrene, N,N-dimethylaminomethylstyrene, methoxycarbonylstyrene, methanesulfonyloxystyrene and vinylnaphthalene), vinylsulfone-containing compounds, vinylketone-containing compounds and heterocyclic vinyl compounds (e.g., vinylpyrrolidone, vinylpyridine, vinylimidazole, vinylthiophene, vinylimidazoline, vinylpyrazoles, vinyldioxane, vinylquinoline, vinyltetrazole and vinyloxazine). Preferred examples thereof include vinyl or allyl esters of alkanoic acids containing from 1 to 3 carbon atoms, acrylonitrile, methacrylonitrile, styrene and styrene derivatives (e.g., vinyltoluene, butylstyrene, methoxystyrene, chlorostyrene, dichlorostyrene, bromostyrene and ethoxystyrene). It is preferred that the content of the polymer components corresponding to such other monomers does not exceed 20% by weight of the resin (A).

Now, the polymer component having the specified polar group present in the resin (A) will be described in detail below.

The polymer component having the specified polar group includes that present in the graft portion of the resin (A) and that present at one terminal of the copolymer main chain.

The polar group included in the polar group-containing polymer component is selected from $—PO_3H_2$, $—SO_3H$, —COOH,

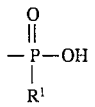

and a cyclic acid anhydride group, as described above.

In the group

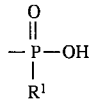

above, $R^1$ represents a hydrocarbon group or $—OR^2$ (wherein $R^2$ represents a hydrocarbon group). The hydrocarbon group represented by $R^1$ or $R^2$ preferably includes an aliphatic group having from 1 to 22 carbon atoms which may be substituted (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl and methoxybenzyl) and an aryl group which may be substituted (e.g., phenyl, tolyl, ethylphenyl, propylphenyl, chlorophenyl, fluorotolyl, phenyl, bromophenyl, chloromethylphenyl, dichlorophenyl, methoxyphenyl, cyanophenyl, acetamidophenyl, acetylphenyl and butoxyphenyl).

The cyclic acid anhydride group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydrides ring, maleic anhydride ring, cyclopentane- 1,2-dicarboxylic acid anhydride ring, cyclohexane- 1,2-dicarboxylic acid anhydride ring, cyclohexene-1,2-dicarboxylic acid anhydride ring, and 2,3-bicyclo[2,2,2]octanedicarboxylic acid anhydride. These rings may be substituted with, for example, a halogen atom such as a chlorine atom and a bromine atom and an alkyl group such as a methyl group, an ethyl group, a butyl group and a hexyl group.

Specific examples of the aromatic dicarboxylic acid anhydrides include phthalic anhydride ring, naphthalenedicarboxylic acid anhydride ring, pyridinedicarboxylic acid anhydride ring and thiophenedicarboxylic acid anhydride ring. These rings may be substituted with, for example, a halogen atom (e.g., chlorine and bromine), an alkyl group (e.g., methyl, ethyl, propyl and butyl), a hydroxyl group, a cyano group, a nitro group and an alkoxycarbonyl group (e.g., methoxycarbonyl and ethoxycarbonyl).

In a case wherein the polar group is present in the polymer chain of the macromonomer as in the resins ($A_2$) and ($A_3$), the polar group may be bonded to the polymer chain either directly or via an appropriate linking group.

The linking group can be any group for connecting the polar group to the polymer chain. Specific examples of suitable linking group include

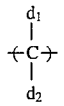

(wherein $d_1$ and $d_2$, which may be the same or different, each represents a hydrogen atom, a halogen atom (e.g., chlorine and bromine), a hydroxyl group, a cyano group, an alkyl group (e.g., methyl, ethyl, 2-chloroethyl, 2-hydroxyethyl, propyl, butyl and hexyl), an aralkyl group (e.g., benzyl and phenethyl) or a phenyl group),

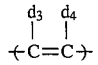

(wherein $d_3$ and $d_4$ each has the same meaning as defined for $d_1$ or $d_2$ above), $—C_6H_{10}$, $—C_6H_4—$, —O—, —S—,

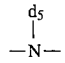

(wherein $d_5$ represents a hydrogen atom or a hydrocarbon group (preferably having from 1 to 12 carbon atoms (e.g., methyl, ethyl, propyl, butyl hexyl, octyl, decyl, dodecyl, 2-methoxyethyl, 2-chloroethyl, 2-cyanoethyl, benzyl, methylbenzyl, phenethyl, phenyl, tolyl, chlorophenyl, methoxyphenyl and butylphenyl)), —CO—, —COO—, —OCO—, $CON(d_5)—$, $—SO_2N(d_5)—$, $—SO_2—$, —NHCONH—, —NHCOO—, $—NHSO_2—$, —CONHCOO—, —CONHCONH—, a heterocyclic ring (preferably a 5-membered or 6-membered ring containing at least one of an oxygen atom, a sulfur atom and a nitrogen atom as a hetero atom or a condensed ring thereof (e.g., thiophene, pyridine, furan, imidazole, piperidine and morpholine)),

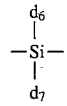

(wherein $d_6$ and $d_7$, which may be the same or different, each represents a hydrocarbon group or $—Od_8$ (wherein $d_8$ represents a hydrocarbon group)), and a combination thereof. Suitable examples of the hydrocarbon group represented by $d_6$, $d_7$ or $d_8$ include those described for $d_5$.

The polymer component containing the polar group according to the present invention may be any of specified polar group-containing vinyl compounds copolymerizable with, for example, a monomer corresponding to the repeating unit represented by the general formula (I) (including that represented by the general formula (Ia) or (Ib)). Examples of such vinyl compounds are described, e.g., in Kobunshi Gakkai (ed.), *Kobunshi Data Handbook Kisohen* (*Polymer Date Handbook Basis*), Baifukan (1986). Specific examples of these vinyl monomers include acrylic acid, α- and/or β-substituted acrylic acids (e.g., α-acetoxy, α-acetoxymethyl, α-(2-amino)ethyl, α-chloro, α-bromo, α-fluoro, α-tributylsilyl, α-cyano, β-chloro, β-bromo, α-chloro-β-methoxy and α,β-dichloro compounds), methacrylic acid, itaconic acid, itaconic half esters, itaconic half amides, crotonic acid, 2-alkenylcarboxylic acids (e.g., 2-pentenoic acid, 2-methyl-2-hexenoic acid, 2-octenoic acid, 4-methyl-2-hexenoic acid and 4-ethyl-2-octenoic acid), maleic acid, maleic half esters, maleic half amides, vinylbenzenecarboxylic acid, vinylbenzenesulfonic acid, vinylsulfonic acid, vinylphosphonic acid, dicarboxylic acid vinyl or allyl half esters, and ester or amide derivatives of these carboxylic acids or sulfonic acids containing the specified polar group in the substituent thereof.

Specific examples of the polar group-containing polymer components are set forth below, but the present invention should not be construed as being limited thereto. In the following formulae, $e_1$ represents —H or —$CH_3$; $e_2$ represents —H, —$CH_3$ or —$CH_2COOCH_3$; $R_{14}$ represents an alkyl group having from 1 to 4 carbon atoms; $R_{15}$ represents an alkyl group having from 1 to 6 carbon atoms, a benzyl group or a phenyl group; c represents an integer of from 1 to 3; d represents an integer of from 2 to 11; e represents an integer of from 1 to 11; f represents an integer of from 2 to 4; and g represents an integer of from 2 to 10.

(b-1)

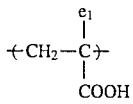

(b-2)

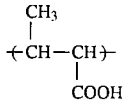

(b-3)

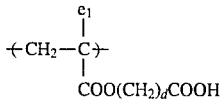

(b-4)

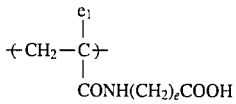

(b-5)

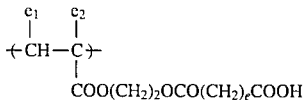

(b-6)

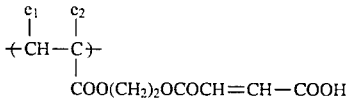

(b-7)

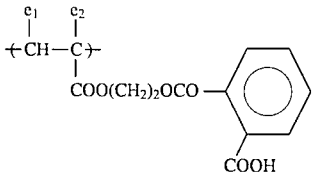

(b-8)

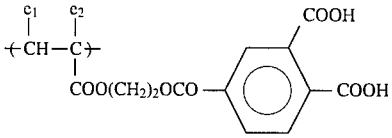

(b-9)

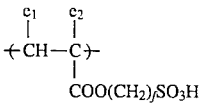

(b-10)

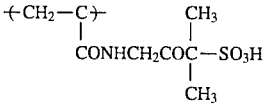

-continued (b-11)

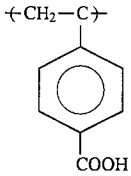

(b-12)

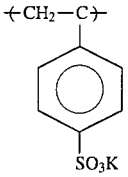

(b-13)

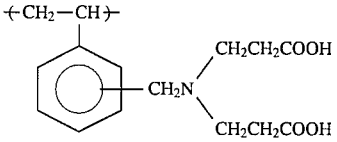

(b-14)

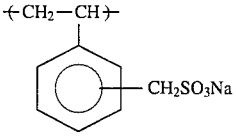

(b-15)

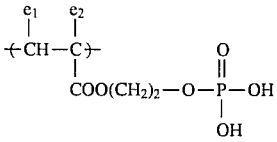

(b-16)

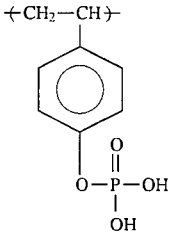

(b-17)

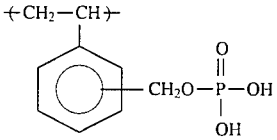

(b-18)

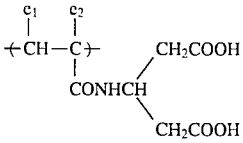

(b-19)

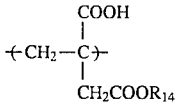

(b-20)

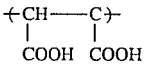

-continued
(b-21)
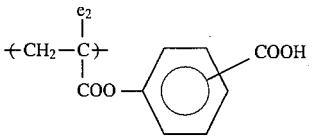
(b-22)
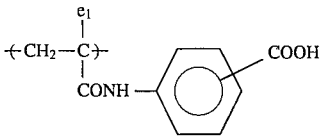
(b-23)
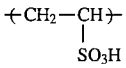
(b-24)
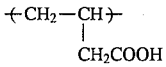
(b-25)
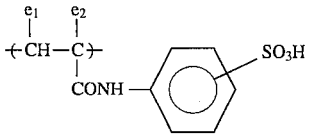
(b-26)
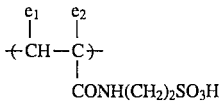
(b-27)
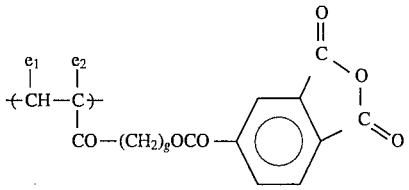
(b-28)
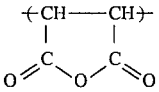
(b-29)
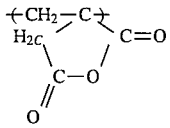
(b-30)
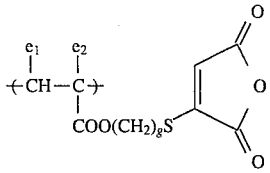
(b-31)
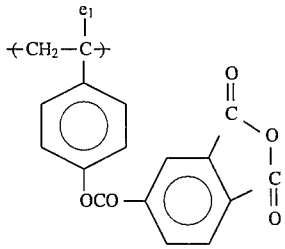
-continued
(b-32)
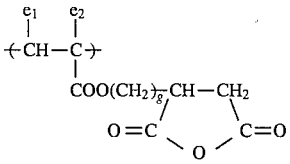
(b-33)
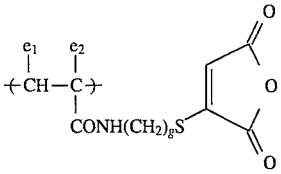
(b-34)
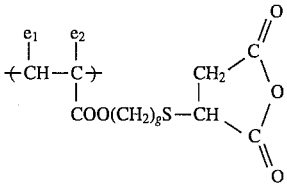
(b-35)
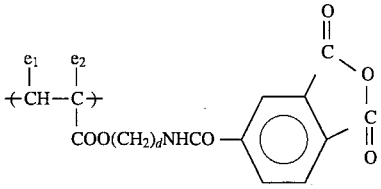
(b-36)
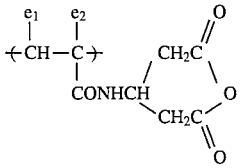
(b-37)
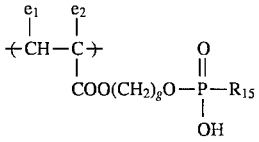
(b-38)
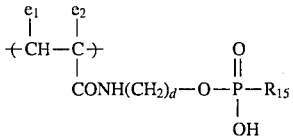
(b-39)
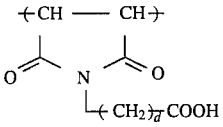
(b-40)
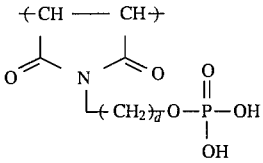
(b-41)
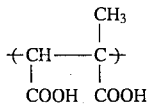

-continued (b-42)

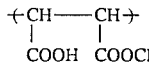

(b-43)

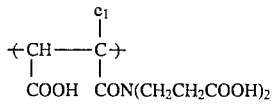

(b-44)

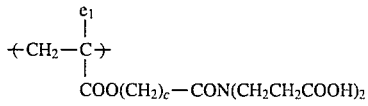

(b-45)

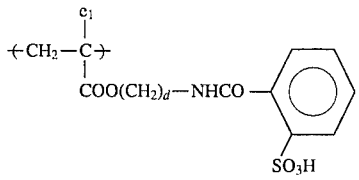

(b-46)

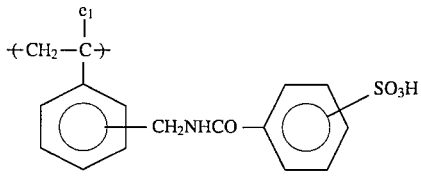

(b-47)

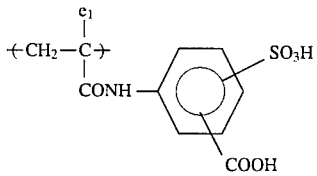

(b-48)

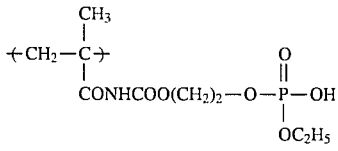

(b-49)

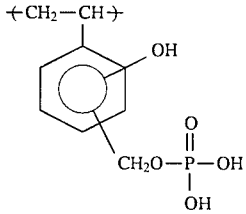

(b-50)

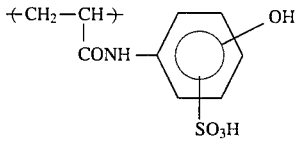

(b-51)

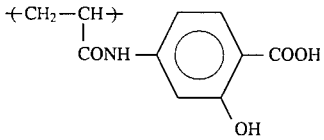

(b-52)

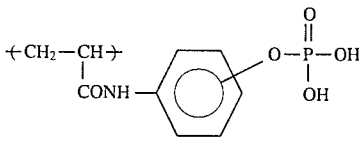

In the resin ($A_2$) according to the present invention, the polymer components containing the polar group described above are present irregularly in the macromonomer ($M_2$), and the content thereof is preferably from 1 to 50% by weight and more preferably from 3 to 30% by weight based on the macromonomer ($M_2$).

Of the resins ($A_2$), those additionally having at least one polar group selected from the above described polar groups bonded at one terminal of the copolymer main chain thereof (hereinafter, these resins are particularly referred to as resin ($A_{12}$) sometimes) are preferred.

In the resin ($A_{12}$), the polar group contained in the polymer component of the macromonomer and the polar group bonded at one terminal of the copolymer main chain may be the same or different, and the ratio of the polar group present in the polymer chain of the macromonomer to the polar group bonded to the terminal of the polymer main chain may be varied depending on the kinds and amounts of other binder resins, a spectral sensitizing dye, a chemical sensitizer and other additives which constitute the photoconductive layer according to the present invention, and can be appropriately controlled. What is important is that the total amount of the polar group-containing component present in the resin ($A_{12}$) is from 0.5 to 20% by weight.

In a case wherein the polar group is present at one terminal of the copolymer main chain as in the resins ($A_1$) and ($A_{12}$), the polar group may be bonded to the terminal of the copolymer main chain either directly or via an appropriate linking group. Suitable examples of the linking groups include those illustrated for the cases wherein the polar groups are present in the polymer chain hereinbefore described.

In the resins ($A_1$) and ($A_2$) (including the resin ($A_{12}$)), the polymer component which constitutes a repeating unit of the monofunctional macromonomer ($M_1$) or ($M_2$) having a polymerizable double bond group bonded at one terminal of the polymer chain thereof includes the component represented by the general formula (I), (Ia) and/or (Ib), and the content thereof is not less than 30% by weight, preferably not less than 50% by weight in the macromonomer.

The component of the general formula (I) used as the copolymer component and the component of the general formula (I) included as the polymer component in the macromonomer ($M_1$) or ($M_2$) may be the same or different in the resin ($A_1$) or ($A_2$). The macromonomers ($M_1$) and ($M_2$) may further contain a polymer component other than the polymer components represented by the general formula (I), (Ia) and (Ib) and the polymer component containing the specified polar group which may be used if desired. Such other polymer components include those described as the other components which are copolymerizable with the macromonomer (M) and the component of the general formula (I) for forming the copolymer main chain of the resin (A) described above.

In the resin ($A_3$) containing an AB block copolymer in the graft portion, the polar group-containing component described above is present in the A block. Two or more kinds of the polar group-containing components may be present in the A block, and in such a case, two or more kinds of these polar group-containing components may be contained in the form of a random copolymer or a block copolymer in the block A. The A block may further contain a component which does not contain the polar group (for example, a component represented by the general formula (II) described in detail below) in addition to the polar group-containing component. The content of the polar group-containing component in the A block is preferably from 30 to 100% by weight.

Now, the repeating unit represented by the general formula (II) which is a component constituting the B block in the resin ($A_3$) will be described in detail below.

In the general formula (II), $V^1$ represents —COO—, —OCO—, $$\text{-}(CH_2)_a\text{-}OCO\text{-},\quad \text{-}(CH_2)_a\text{-}COO\text{-}$$

(wherein a represents an integer of from 1 to 3), —O—, —$SO_2$—, —CO—, $$\text{-}\overset{\overset{Z^1}{|}}{C}O\text{-},\quad \text{-}SO_2\overset{\overset{Z^1}{|}}{N}\text{-},$$

—CONHCOO—, —CONHCONH— or

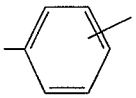

(wherein $Z^1$ represents a hydrogen atom or a hydrocarbon group).

Preferred examples of the hydrocarbon group represented by $Z^1$ include an alkyl group having from 1 to 22 carbon atoms which may be substituted (e.g., methyl, ethyl, propyl, butyl, hexyl, heptyl octyl, decyl, dodecyl, hexadecyl, octadecyl, 2-chloroethyl, 2-bromoethyl, 2-cyanoethyl, 2-methoxycarbonylethyl, 2-methoxyethyl and 3-bromopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl and 4-methyl-2-hexenyl), an aralkyl group having from 7 to 12 carbon atoms which may be substituted (e.g., benzyl, phenethyl , 3-phenylpropyl, naphthylmethyl, 2-naphthylethyl, chlorobenzyl, bromobenzyl, methylbenzyl, ethylbenzyl, methoxybenzyl, dimethylbenzyl and dimethoxybenzyl), an alicyclic group having from 5 to 8 carbon atoms which may be substituted (e.g., cyclohexyl, 2-cyclohexylethyl and 2-cyclopentylethyl) and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl and dodecyloylamidophenyl).

In the general formula (II), $R^5$ represents a hydrocarbon group, and preferred examples thereof include those described for $Z^1$ above.

When $V^1$ represents

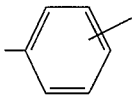

in the general formula (II), $R^5$ represents a hydrogen atom or a hydrocarbon group. When $V^1$ represents

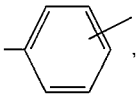

the benzene ring may further be substituted. Suitable examples of the substituents include a halogen atom (e.g., chlorine and bromine), an alkyl group (e.g., methyl, ethyl, propyl, butyl, chloromethyl and methoxymethyl) and an alkoxy group (e.g., methoxy, ethoxy, propoxy and butoxy).

In the general formula (II), $b^1$ and $b^2$, which may be the same or different, each has the same meaning as defined for $a^1$ or $a^2$ in the general formula (I) described above.

More preferably, in the general formula (II), $V^1$ represents —COO—, —OCO—, —$CH_2$OCO—, —$CH_2$COO—, —O—, —CONH—, —$SO_2$NH— or

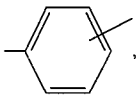

and $b^1$ and $b^2$ which may be the same or different, each represents a hydrogen atom, a methyl group, —$COOZ^3$, or —$CH_2COOZ^3$, wherein $Z^3$ represents an alkyl group having from 1 to 6 carbon atoms (e.g., methyl, ethyl, propyl, butyl and hexyl). Most preferably, either one of $b^1$ and $b^2$ represents a hydrogen atom.

The content of the polymer component corresponding to the general formula (II) above present in the B block of the macromonomer ($M_3$) in the resin ($A_3$) is preferably not less than 30% by weight, more preferably not less than 50% by weight of the B block.

The B block may further contain a polymer component other than the polymer component represented by the general formula (II). Such other polymer components include those described as the other components which are copolymerizable with the macromonomer and the component of the general formula (I) for forming the copolymer main chain of the resin (A). Such other components, however, are employed in a range of not more than 20 parts by weight per 100 parts by weight of the total polymer components constituting the B block. Further, the B block preferably does not contain any specified polar group-containing polymer component which is a component constituting the A block. When two or more kinds of polymer components are present in the B block, two or more kinds of these polymer components may be contained in the B block in the form of a random copolymer or a block copolymer. However, it is preferred that they are present at random in view of simplicity in synthesis.

The copolymer component constituting the macromonomer ($M_3$) used in the resin ($A_3$) comprises the A block and the B block as described above, and a ratio of A block/B block is preferably 1 to 70/99 to 30 by weight and more preferably 3 to 50/97 to 50 by weight.

Now, the polymerizable double bond group bonded at one terminal of the macromonomer (M) constituting the resin (A) which is the graft type copolymer according to the present invention will be described in detail below.

In a case of the macromonomer ($M_3$) constituting the resin ($A_3$), the polymerizable double bond group is bonded at one terminal of the B block, another terminal of which is bonded to the A block as described above.

Suitable examples of the polymerizable double bond group include those represented by the following general formula (III):

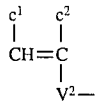

(III)

wherein $V^2$ has the same meaning as $V^1$ defined in the general formula (II), and $c^1$ and $c^2$, which may be the same or different, each has the same meaning as a or $a^1$ or $a^2$ defined in the general formula (I).

Specific examples of the polymerizable double bond group represented by the general formula (III) include

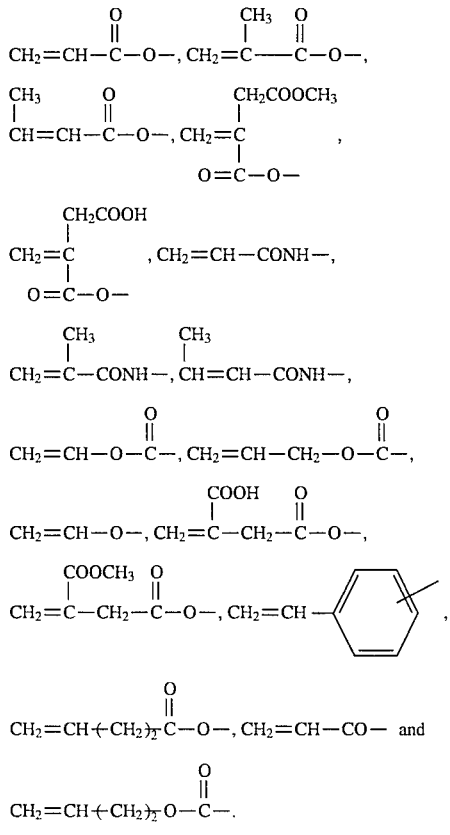

The polymerizable double bond group may be bonded to one terminal of the polymer chain which constitutes a graft portion either directly or via an appropriate linking group. Suitable examples of the linking groups include those illustrated for the cases wherein the polar groups are present in the polymer chain hereinbefore described.

The macromonomer (M) constituting the resin (A) used in the present invention can be produced by conventionally known synthesis methods.

Specifically, the macromonomers ($M_1$) and ($M_2$) used for forming the resins ($A_1$) and ($A_2$) can be synthesized by a radical polymerization method of forming the macromonomer by reacting an oligomer having a reactive group bonded at the terminal thereof and various reagents. The oligomer used above can be obtained by a radical polymerization using a polymerization initiator and/or a chain transfer agent each having the reactive group such as a carboxy group, a carboxyhalide group, a hydroxy group, an amino group, a halogen atom, an epoxy group, etc., in the molecule thereof.

More specifically, they can be synthesized according to the methods as described, for example, in P. Dreyfuss & R. P. Quirk, *Encycl. Polym. Sci. Eng.*, 7, 551 (1987), P. F. Rempp & E. Franta, *Adv. Polym Sci.*, 58, 1 (1984), Yusuke Kawakami, *Kagaku Kogyo* (*Chemical Industry*), 38, 56 (1987), Yuuya Yamashita, *Kobunshi* (*Polymer*), 31, 988 (1982), Shiro Kobayashi, *Kobunshi* (*Polymer*), 30, Koichi Ito, *Kobunshi Kako* (Polymer Processing), 35, 262 (1986), Kishiro Higashi & Takashi Tsuda, *Kino Zairyo* (*Functional Materials*), 1987, No. 10, 5, and the literature references and patents cited therein.

However, since the macromonomer ($M_2$) used in the present invention has the above-described polar group as the component of the repeating unit, the following matters should be considered in the synthesis thereof.

In one method, the radical polymerization and the introduction of a terminal reactive group are carried out by the above-described method using a monomer having the polar group as the form of a protected functional group as shown, for example, in the following reaction formula (A).

Reaction Formula (A)

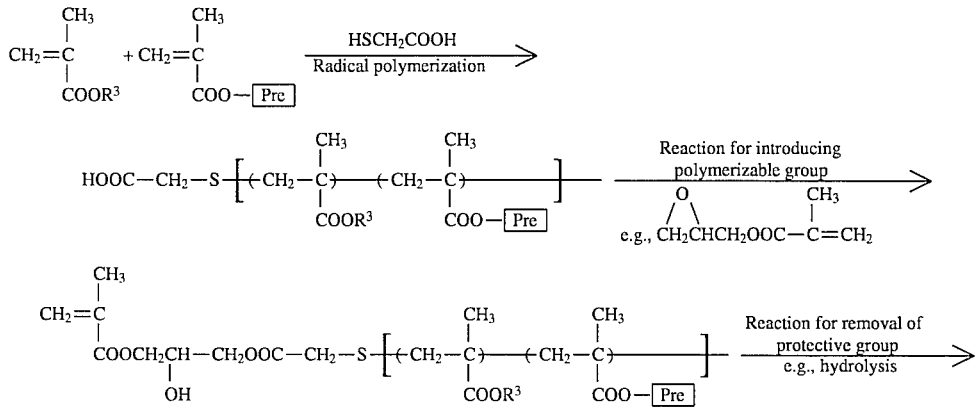

-continued

Reaction Formula (A)

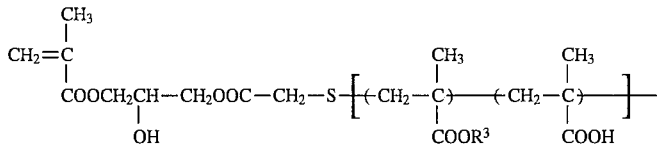

* Pre : protective group for —COOH, e.g., $-C(C_6H_5)_3$, $-\underset{CH_3}{\overset{CH_3}{Si}}-C_3H_7$, 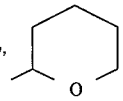 , etc.

The reaction for introducing the protective group and the reaction for removal of the protective group (e.g., hydrolysis reaction, hydrogenolysis reaction and oxidative decomposition reaction) for the polar group being randomly contained in the macromonomer ($M_2$) used in the present invention can be carried out by any of conventional known methods.

These methods are specifically described, for example, in J. F. W. McOmie, *Protective Groups in Organic Chemistry*, Plenum Press (1973), T. W. Greene, *Protective Groups in Organic Synthesis,* John Wiley & Sons (1981), Ryohei Oda, *Kobunshi Fine Chemical* (*Polymer Fine Chemical*), Kodansha K. K., (1976), Yoshio Iwakura and Keisuke Kurita, *Hannosei Kobunshi* (*Reactive Polymers*), Kodansha K. K. (1977), G. Berner, et al, *J. Radiation Curing,* No. 10, 10(1986), JP-A-62-212669, JP-A-62-286064, JP-A-62-210475, JP-A-62-195684, JP-A-62-258476, JP-A-63-260439, Japanese Patent Application Nos. 62-220520 and 62-226692.

Another method for producing the macromonomer ($M_2$) comprises synthesizing the oligomer in the same manner as described above and then reacting the oligomer with a reagent having a polymerizable double bond group which reacts with only the "specific reactive group" bonded at one terminal by utilizing the difference between the reactivity of the "specific reactive group" and the reactivity of the polar group contained in the oligomer as shown in the following reaction formula (B).

Reaction Formula (B)

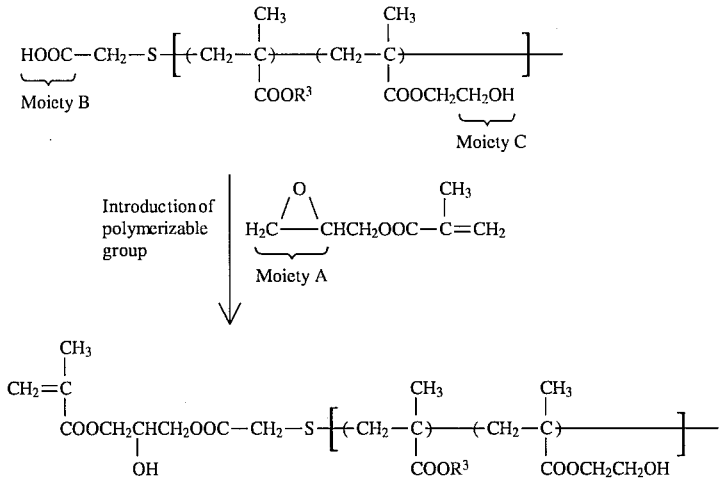

Specific examples of combination of the specific functional groups (moieties A, B, and C) as described in the reaction formula (B) are shown in Table 1 below, although the present invention should not be construed as being limited thereto. It is important to utilize the selectivity of reaction in an ordinary organic chemical reaction and the macromonomer may be formed without protecting the polar group present in the oligomer. In Table 1, Moiety A is a functional group in the reagent for introducing a polymerizable group, Moiety B is a specific functional group bonded at the terminal of oligomer, and Moiety C is a polar group present in the repeating unit in the oligomer.

TABLE 1

| Moiety A | Moiety B | Moiety C |
|---|---|---|
| 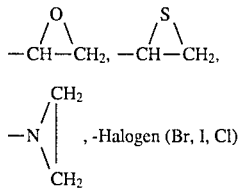 | $-COOH$, $-NH_2$ | $-OH$ |
| $-COCl$, Acid Anhydride | $-OH$, $-NH_2$ | $-COOH$, $-SO_3H$, $-PO_3H_2$, |
| $-SO_2Cl$, | | $-P(=O)(OH)-R^1$ |
| $-COOH$, $-NHR^9$ (wherein $R^9$ is a hydrogen atom or an alkyl group) | -Halogen | $-COOH$, $-SO_3H$, $-PO_3H_2$, $-OH$, $-P(=O)(OH)-R^1$ |
| $-COOH$, $-NHR^9$ | 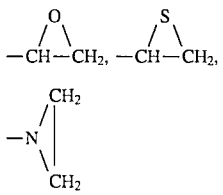 | $-OH$ |
| $-OH$, $-NHR^9$ | $-COCl$, $-SO_2Cl$ | $-COOH$, $-SO_3H$, $-PO_3H_2$ |

The chain transfer agent which can be used includes, for example, mercapto compounds having the polar group or a substituent capable of being converted into the polar group later (e.g., thioglycolic acid, thiomalic acid, thisalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]propionic acid, 3-[N-(2-mercaptoethyl)amino]propionic acid, N-(3-mercaptopropionyl)alanine, 2-mercaptoethanesulfonic acid, 3-mercaptopropanesulfonic acid, 4-mercaptobutanesulfonic acid, 2-mercaptoethanol, 3-mercapto-1,2-propanediol, 1-mercapto- 2-propanol, 3-mercapto-2-butanol, mercapto-phenol, 2-mercaptoethylamine, 2-mercaptoimidazole and 2-mercapto- 3-pyridinol), disulfide compounds which are the oxidation products of these mercapto compounds, and iodized alkyl compounds having the above described polar group or substituent (e.g., iodoacetic acid, iodopropionic acid, 2-iodoethanol, 2-iodoethanolsulfonic acid and 3-iodopropanesulfonic acid). Of these compounds, the mercapto compounds are preferred.

Also, the polymerization initiator having a specific reactive group which can be used includes, for example, 2,2'-azobis(2-cyanopropanol), 2,2'-azobis(2-cyanopentanol), 4,4'-azobis(4-cyanovaleric acid), 4,4'-azobis(4-cyanovaleric acid chloride), 2,2'-azobis[2-(5-methyl- 2-imidazolin-2-yl-)propane], 2,2'-azobis[2-(3,4,5,6-tetrahydropyrimidin-2-yl-)propane], 2,2'-azobis 2-[1-(2-hydroxyethyl)-2-imidazolin-2-yl]propane, 2,2'-azobis[2-methyl-N-(2-hydroxyethyl)propionamide] and the derivatives thereof.

The chain transfer agent or the polymerization initiator is usually used in an amount of from 0.1 to 15% by weight, and preferably from 0.5 to 10% by weight based on the total monomers used.

Specific examples of the macromonomers ($M_1$) and ($M_2$) used in the present invention are illustrated below, but the present invention is not to be construed as being limited thereto. It should also be noted that specific examples of the macromonomer ($M_1$) are those shown below but having no specified polar group-containing component.

In the following formulae, $R^{26}$ represents —H or $—CH_3$, $R^{27}$, $R^{28}$ and $R^{29}$ each represents —H, $—CH_3$ or $—CH_2COOCH_3$, $R^{30}$ represents $—C_kH_{2k+1}$ (wherein k represents an integer of from 1 to 18), $—CH_2C_6H_5$,

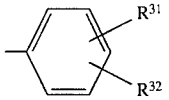

wherein $R^{31}$ and $R^{32}$ each represents —H, —Cl, —Br, $—CH_3$ or $—COOCH_3$)

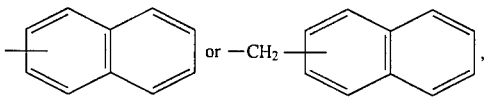

$R^{33}$ represents —CN, —$OCOCH_3$, —$CONH_2$ or —$C_6H_5$, $R^{34}$ represents —Cl, —Br, —CN or —$OCH_3$, $m_2$ represents an integer of from 2 to 18, $n_2$ represents an integer of from 2 to 12, and $p_2$ represents an integer of from 2 to 4.
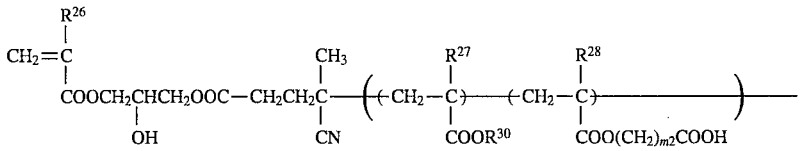
(M-1)
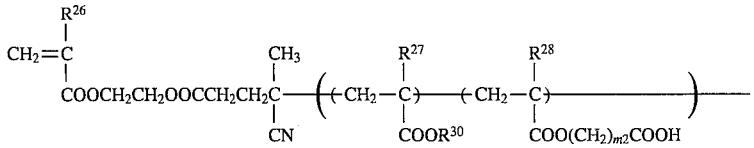
(M-2)
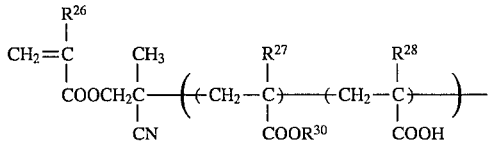
(M-3)
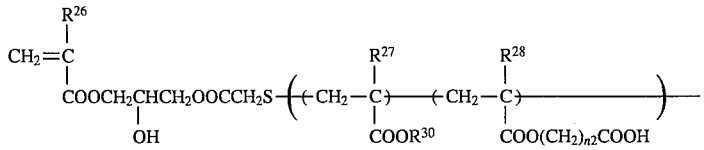
(M-4)
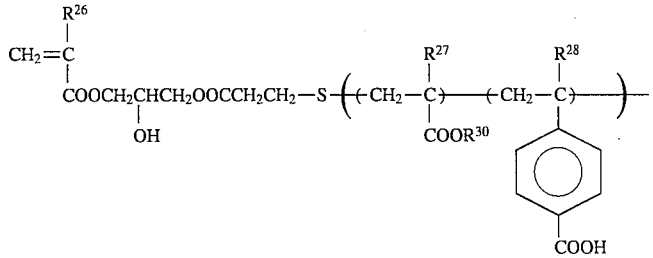
(M-5)
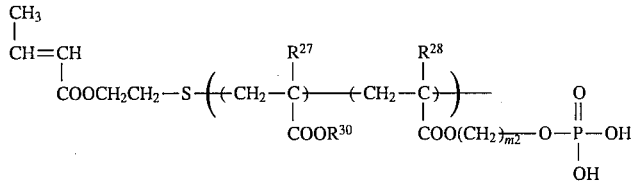
(M-6)
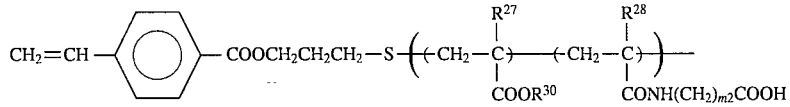
(M-7)
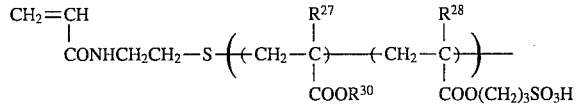
(M-8)
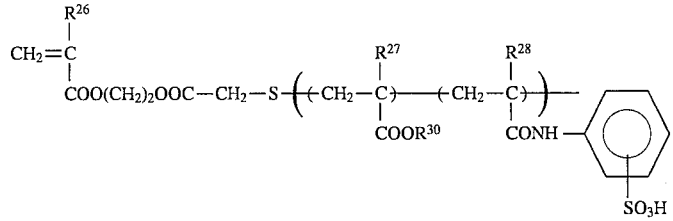
(M-9)

-continued
(M-10)
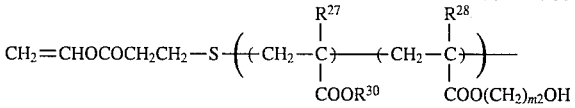
(M-11)
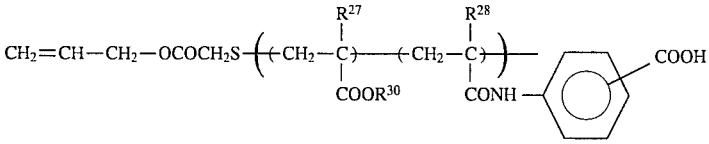
(M-12)
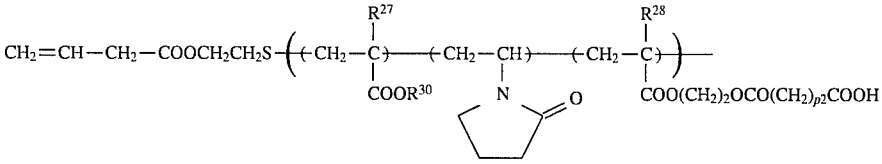
(M-13)
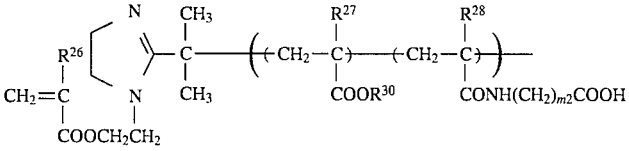
(M-14)
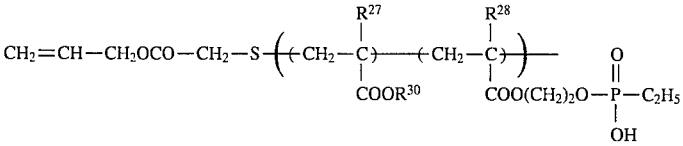
(M-15)
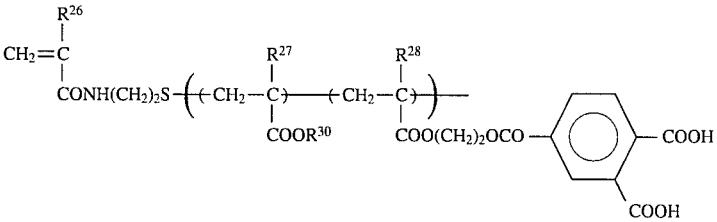
(M-16)
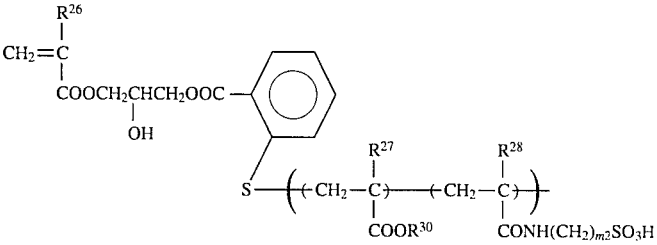
(M-17)
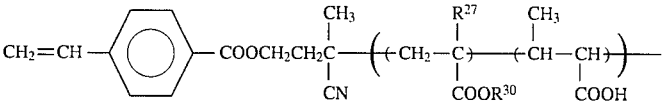
(M-18)
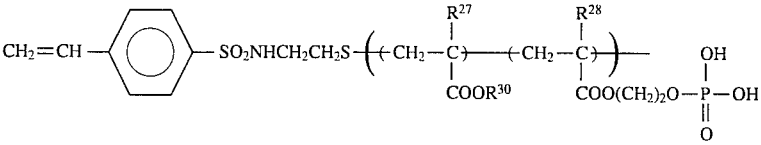
(M-19)
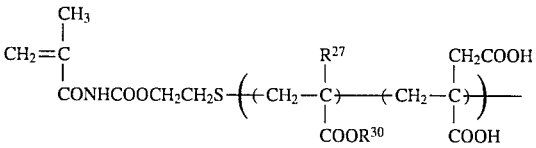

-continued (M-20)

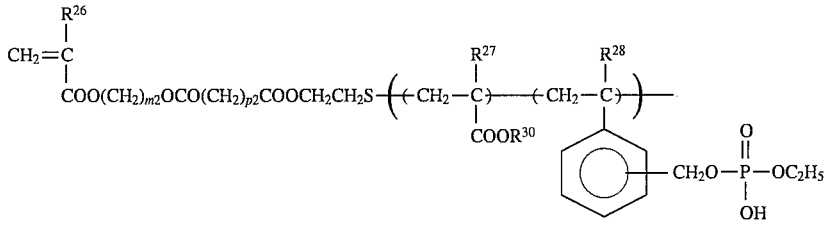

(M-21)

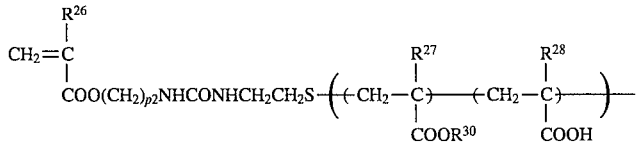

(M-22)

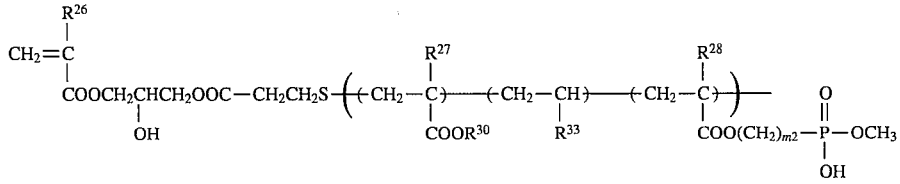

(M-23)

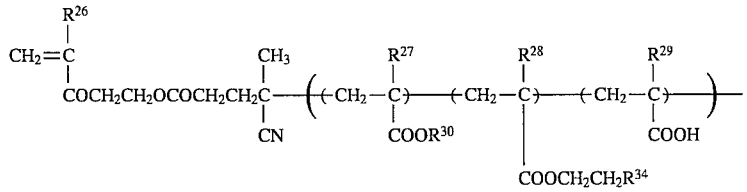

(M-24)

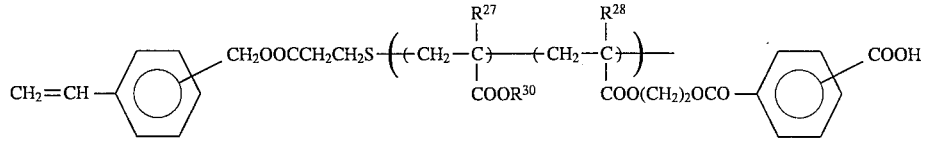

The macromonomer ($M_3$) used in the resin ($A_3$) can be synthesized in the following manner. Specifically, an AB block copolymer is syuthesized according to a synthesis method for the AB block copolymer of the resin (B) described hereinafter, then a polymerizable double bond group is introduced into the terminal of the resulting living polymer by a reaction with a various kind of reagent, and thereafter a protection-removing reaction of the functional group which has been formed by protecting the polar group is conducted by a hydrolysis reaction, a hydrogenolysis reaction, an oxidative decomposition reaction, or a photodecomposition reaction to form the polar group. One example thereof is shown by the following reaction scheme (C):

Reaction Scheme (C)

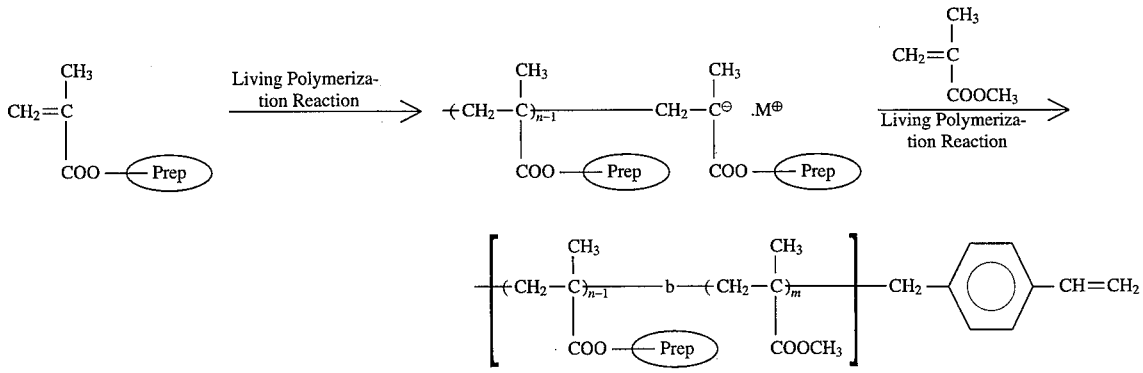

-continued

Reaction Scheme (C)

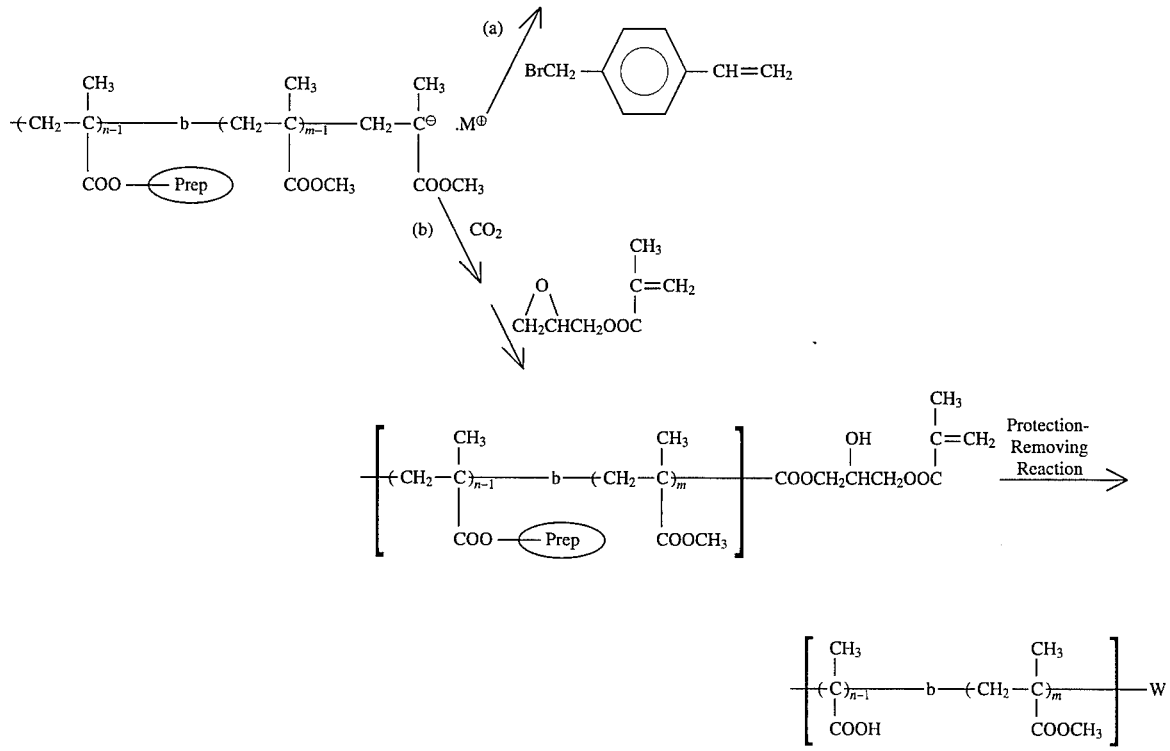

W: $-CH_2-C_6H_4-CH=CH_2$ (in case of (a)) $-COOCH_2CH(OH)CH_2OOCC(CH_3)=CH_2$ (in case of (b))

Prep : Protective group for —COOH,

—b—: A bond connecting two blocks present on both sides.

n, m: Repeating unit

The living polymer can be easily synthesized according to synthesis methods as described, for example, in the literatures cited hereinafter with respect to the synthesis of the resin (B). Further, in order to introduce a polymerizable double bond group into the terminal of the living polymer, a conventionally known synthesis method for macromonomer can be employed.

For details, reference can be made, for example, to P. Dreyfuss and R. P. Quirk, *Encycl. Polym. Sci. Eng.*, 7, 551 (1987), P. F. Rempp and E. Franta, *Adv. Polym. Sci.*, 58, 1 (1984), V. Percec, *Appl. Polym. Sci.*, 285, 95 (1984), R. Asami and M. Takari, *Makromol. Chem. Suppl.*, 12, 163 (1985), P. Rempp et al., *Makromol. Chem. Suppl.*, 8, 3 (1984), Yushi Kawakami, *Kogaku Kogyo*, 38, 56 (1987), Yuya Yamashita, *Kobunshi*, 31, 988 (1982), Shiro Kobayashi, *Kobunshi*, 30, 625 (1981), Toshinobu Higashimura, *Nippon Secchaku Kyokaishi*, 18, 536 (1982), Koichi Itoh, *Kobunshi Kako*, 35, 262 (1986), Kishiro Higashi and Takashi Tsuda, *Kino Zairyo*, 1987, No. 10, 5, and references and patents cited in these literatures.

Also, the protection of the specified polar group of the present invention by a protective group and the release of the protective group (a reaction for removing the protective group) can be easily conducted by utilizing conventionally known knowledges. More specifically, they can be preformed by appropriately selecting methods as described, for example, in the literature references cited hereinafter with respect to the synthesis of the resin (B).

Furthermore, the AB block copolymer can be also synthesized by a photoiniferter polymerization method using a dithiocarbamate compound as an initiator. For example, the block copolymer can be synthesized according to synthesis methods as described, for example, in the literature references cited hereinafter with respect to the synthesis of the resin (B).

The macromonomer (M) according to the present invention can be obtained by applying the above described synthesis method for macromonomer to the AB block copolymer.

Specific examples of the macromonomer ($M_3$) which can be used in the present invention are set forth below, but the present invention should not be construed as being limited thereto. In the following formulae, $p^3$, $p^4$ and $p^5$ each represents —H, $—CH_3$ or $—CH_2COOCH_3$, $p^6$ represents —H or $—CH_3$, $R^{20}$ represents $—C_pH_{2p+1}$ (wherein p represents an integer of from 1 to 18),

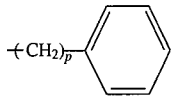
(wherein q represents an integer of from 1 to 3),
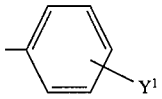
(wherein $Y^1$ represents —H, —Cl, —Br, $—CH_3$, $—OCH_3$ or $—COCH_3$) or
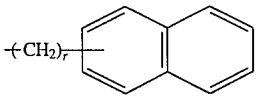
(wherein r represents an integer of from 0 to 3), $R^{12}$ represents $—C_sH_{2s+1}$ (wherein s represents an integer of from 1 to 8) or
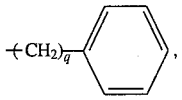
$Y^2$ represents —COOH, $—SO_3H$,
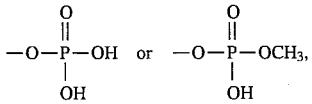
$Y^3$ represents —COOH, $—SO_3H$,
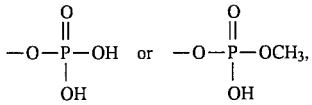
t represents an integer of from 2 to 12, and u represents an integer of from 2 to 6.
(M-101)
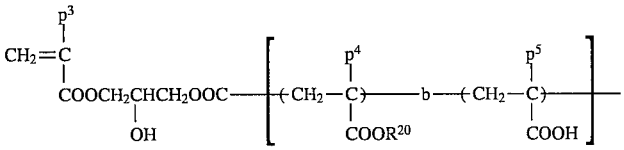
(M-102)
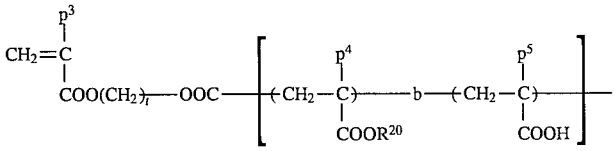
(M-103)
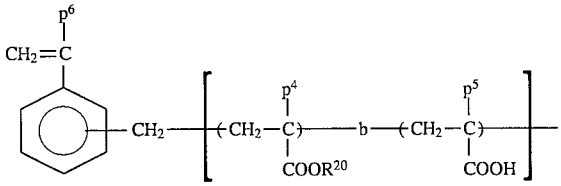
(M-104)
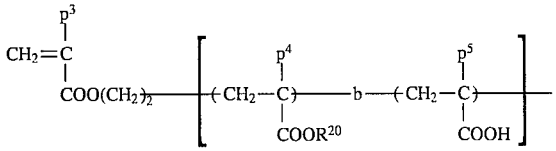
(M-105)
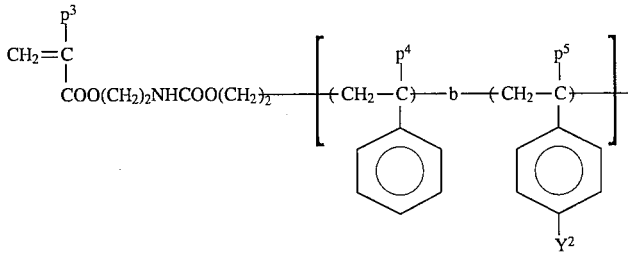
(M-106)
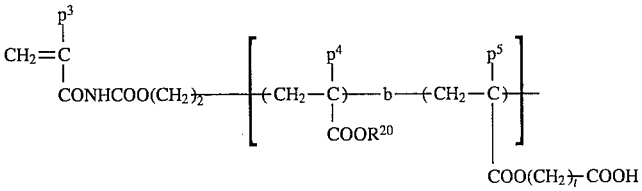

-continued
(M-107)
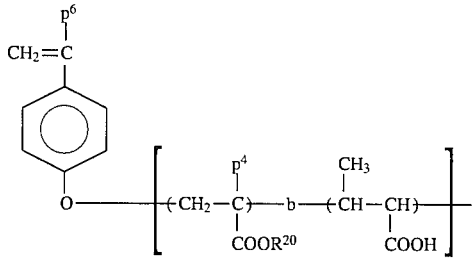
(M-108)
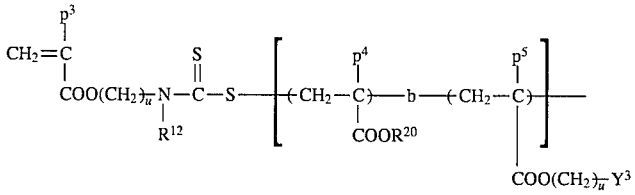
(M-109)
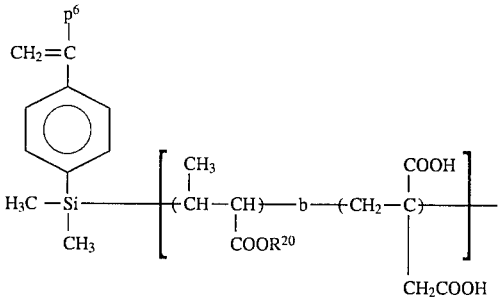
(M-110)
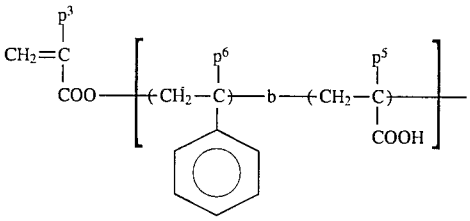
(M-111)
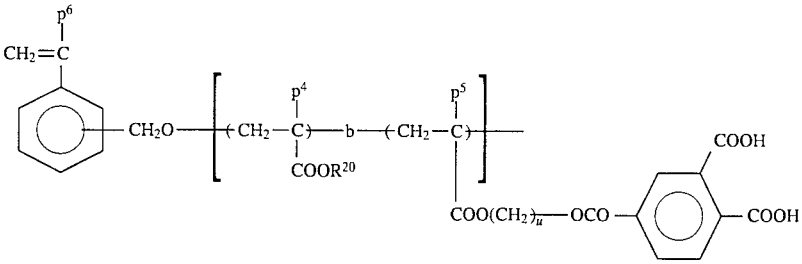
(M-112)
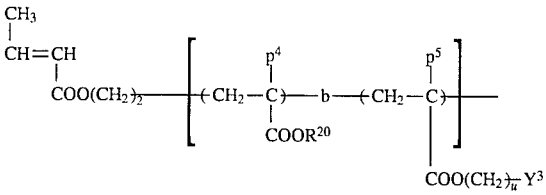
(M-113)
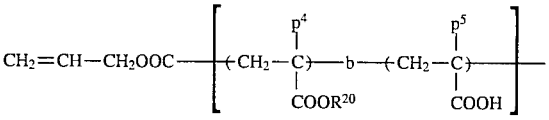

-continued (M-114)

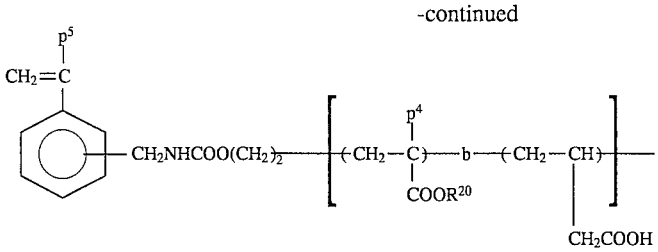

(M-115)

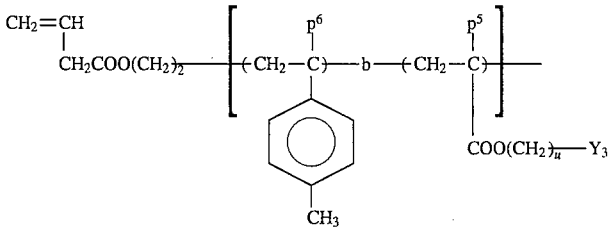

(M-116)

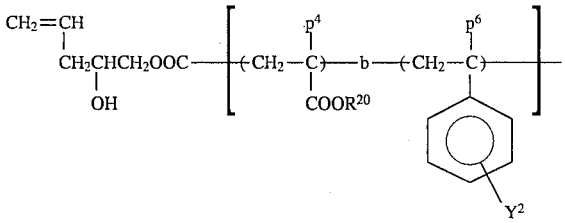

The resin (A) according to the present invention can be produced by copolymerization of at least one compound each selected from the macromonomers (M) and other monomers (for example, those represented by the general formula (I)) in the desired ratio. The copolymerization can be performed using a known polymerization method, for example, solution polymerization, suspension polymerization, precipitation polymerization, and emulsion polymerization. More specifically, according to the solution polymerization monomers are added to a solvent such as benzene or toluene in the desired ratio and polymerized with an azobis compound, a peroxide compound or a radical polymerization initiator to prepare a copolymer solution. The solution is dried or added to a poor solvent whereby the desired copolymer can be obtained. In case of suspension polymerization, monomers are suspended in the presence of a dispersing agent such as polyvinyl alcohol or polyvinyl pyrrolidone and copolymerized with a radical polymerization initiator to obtain the desired copolymer.

Now, the resin (B) which can be used as the binder resin for the photoconductive layer of the electrophotographic light-sensitive material according to the present invention will be described in more detail below.

The resin (B) is an AB block copolymer comprising an A block which comprises a polymer component containing the specified polar group and a B block which comprises a polymer component corresponding to the repeating unit represented by the general formula (I) and does not contain a polymer component containing the specified polar group described above.

The AB block copolymer according to the present invention include a block copolymer wherein the A block and the B block are bonded each other (Embodiment (1)), a block copolymer of Embodiment (1) wherein the specified polar group is bonded at one terminal of the A block polymer chain and the B block is bonded at the other terminal of the A block polymer chain (Embodiment (2)), and a block copolymer wherein the B blocks are bonded at both terminals of the A block polymer chain (Embodiment (3)). These AB block copolymers are schematically illustrated as follows.

Embodiment (1) (A Block)-b-(B Block)

Embodiment (2) (Polar Group)-(A Block)-b-(B Block)

Embodiment (3) (B Block)-b-(A Block)-b-(B Block)

wherein -b- represents a bond connecting two blocks present on both sides.

The resin (B) is characterized by containing from 0.05 to 10% by weight of polymer component containing the specified polar group and not less than 30% by weight of polymer component represented by the general formula (I) bases on the resin (B) as described above.

If the content of the polar group-containing component in the resin (B) is less than 0.05% by weight, the initial potential is low and thus satisfactory image density can not be obtained. On the other hand, if the content of the polar group-containing component is larger than 10% by weight, various undesirable problems may occur, for example, the dispersibility of particles of photoconductive substance is reduced, the film smoothness and the electrophotographic characteristics under high temperature and high humidity condition deteriorate, and further when the light-sensitive material is used as an offset master plate, the occurrence of background stains increases.

It is also preferred that the total amount of the specified polar group-containing polymer component contained in the resin (B) is from 10 to 50% by weight based on the total amount of the specified polar group-containing polymer component present in the resin (A).

If the total amount of the specified polar group-containing component in the resin (B) is less than 10% by weight of that in the resin (A), the electrophotographic characteristics (particularly, dark charge retention rate and photosensitivity) and film strength tend to decrease. On the other hand, if it is larger than 50% by weight, a sufficiently uniform dispersion of particles of photoconductive substance may not be obtained, thereby the electrophotographic characteristics decrease and water retentivity decline when used as an offset master plate.

The weight average molecular weight of the resin (B) is from $3\times10^4$ to $1\times10^6$, and preferably from $5\times10^4$ to $5\times10^5$.

If the weight average molecular weight of the resin (B) is less than $3\times10^4$, the film-forming property of the resin is lowered, thereby a sufficient film strength cannot be maintained, while if the weight average molecular weight of the resin (B) is higher than $1\times10^6$, the effect of the resin (B) of the present invention is reduced, thereby the electrophotographic characteristics thereof become almost the same as those of conventionally known resins.

The glass transition point of the resin (B) is preferably from −10° C. to 100° C., and more preferably from 0° C. to 90° C.

Specific examples of the polymer component containing the specified polar group which constitutes the A block of the AB block copolymer (resin (B)) according to the present invention include those for the polymer component containing the specified polar group present in the resin (A) described above.

Two or more kinds of the polymer components containing the specified polar group may be employed in the A block. In such a case, two or more kinds of the polar group-containing components may be contained in the A block in the form of a random copolymer or a block copolymer.

The A block may contain other polymer components than the polar group-containing polymer components. Preferred examples of such other polymer components include those corresponding to the repeating unit represented by the general formula (II) as described in detail with respect to the resin (A) above.

Moreover, the A block may further contain other polymer components corresponding to monomers copolymerizable with monomers corresponding to the polymer components represented by the general formula (II). Examples of such monomers include acrylonitrile, methacrylonitrile and heterocyclic vinyl compounds (e.g., vinylpyridine, vinylimidazole, vinylpyrrolidone, vinylthiophene, vinylpyrazoles, vinyldioxane and vinyloxazine). However, such other monomers are preferably employed in an amount of not more than 20 parts by weight per 100 parts by weight of the total polymer components constituting the A block.

The polymer component which constitutes the B block of the AB block copolymer (resin (B)) will be described in greater detail below.

The B block contains at least the polymer component corresponding to the repeating unit represented by the general formula (I) described above. The content of the polymer component corresponding to the general formula (I) in the B block is preferably not less than 30% by weight, more preferably not less than 50% by weight.

The polymer component corresponding to the general formula (I) is the same as that described in detail with respect to the resin (A) hereinbefore. As other polymer components, the B block may contain the above described polymer components represented by the general formula (II) and above described other polymer components corresponding to monomers copolymerizable with monomers corresponding to the polymer components represented by the general formula (II) which may be present in the A block described above. However, the B block does not contain any specified polar group-containing polymer component used in the A block.

Preferred examples of polymer components constituting the B block include those represented by the general formula (I) wherein both $a^1$ and $a^2$ are hydrogen atoms and the hydrocarbon group represented by $R^3$ is an alkyl group having from 1 to 6 carbon atoms which may be substituted (e.g., methyl, ethyl, propyl, butyl, pentyl, hexyl, 2-chloroethyl, 2-cyanoethyl, 2-methoxyethyl, 2-thienylethyl and 2,3-dichloropropyl), and those represented by the general formula (II) wherein both $b^1$ and $b^2$ are hydrogen atoms and the hydrocarbon group represented by $R^5$ is selected from the alkyl group described for $R^3$ above.

The AB block copolymer (resin (B)) used in the present invention can be produced by a conventionally known polymerization reaction method. More specifically, it can be produced by the method comprising previously protecting the specified polar group in a monomer corresponding to the polymer component having the specified polar group to form a functional group, synthesizing an AB block copolymer by a so-called known living polymerization reaction, for example, an ion polymerization reaction with an organic metal compound (e.g., alkyl lithiums, lithium diisopropylamide and alkylmagnesium halides) or a hydrogen iodide/iodine system, a photopolymerization reaction using a porphyrin metal complex as a catalyst, or a group transfer polymerization reaction, and then conducting a protection-removing reaction of the functional group which had been formed by protecting the polar group by a hydrolysis reaction, a hydrogenolysis reaction, an oxidative decomposition reaction, or a photodecomposition reaction to form the polar group. One example thereof is shown by the following reaction scheme (D):

Reaction Scheme (D)

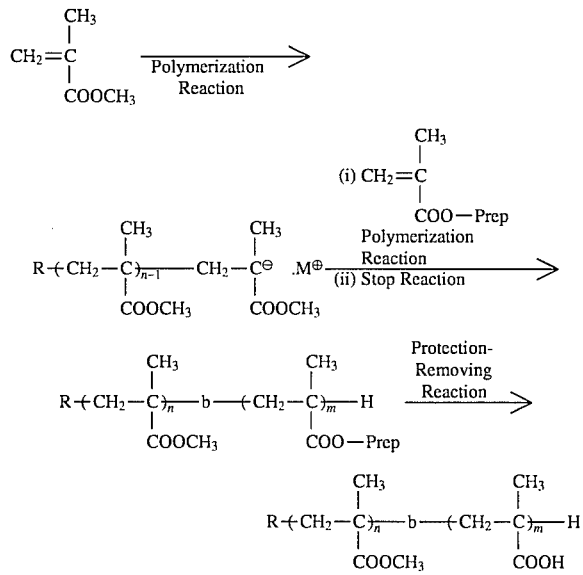

R: Alkyl group, porphyrin ring residue, etc.
Prep: Protective group (e.g., $-C(C_6H_5)_3$, $-Si(C_3H_7)_3$, etc.)
—b—: A bond connecting two blocks present on both sides
n, m: Repeating unit Specifically, the AB block copolymer can be easily synthesized according to the synthesis methods described, e.g., in P. Lutz, P. Masson et al, *Polym. Bull.*, 12, 79 (1984), B. C. Anderson, G. D. Andrews et al, *Macromolecules*, 14, 1601 (1981), K. Hatada, K. Ute et al, *Polym. J.*, 17, 977 (1985), ibid., 18, 1037 (1986), Koichi Ute and Koichi Hatada, *Kobunshi Kako* (*Polymer Processing*), 36, 366 (1987), Toshinobu Higashimura and Mitsuo Sawamoto, *Kobunshi Ronbun Shu* (*Polymer Treatises*, 46, 189 (1989), M. Kuroki and T. Aida, *J. Am. Chem. Soc.*, 109, 4737 (1989), Teizo Aida and Shohei Inoue, *Yuki Gosei Kagaku* (*Organic Synthesis Chemistry*), 43, 300 (1985), and D. Y. Sogah, W. R. Hertler et al, *Macromolecules*, 20, 1473 (1987).

Also, the protection of the specified polar group by a protective group and the release of the protective group (a reaction for removing a protective group) can be easily conducted by utilizing conventionally known knowledges. More specifically, they can be performed by appropriately selecting methods described, e.g., in Yoshio Iwakura and Keisuke Kurita, *Hannosei Kobunshi* (*Reactive Polymer*), Kodansha (1977), T. W. Greene, *Protective Groups in Organic Synthesis*, John Wiley & Sons (1981), and J. F. W. McOmie, *Protective Groups in Organic Chemistry*, Plenum Press, (1973), as well as the methods as described in the above references.

Further, the AB block copolymer can be also synthesized by performing a polymerization reaction under light irradiation using a monomer having an unprotected polar group and also using a dithiocarbamate group-containing compound and/or xanthate group-containing compound as an initiator. For example, the block copolymer can be synthesized according to the synthesis methods described, e.g., in Takayuki Otsu, *Kobunshi* (*Polymer*), 37, 248 (1988), Shunichi Himori and Ryuichi Otsu, *Polym. Rep. Jap.* 37, 3508 (1988), JP-A-64-111, JP-A-64-26619, Nobuyuki Higashi et al, *Polymer Preprints Japan,* 36, (6), 1511 (1987), and M. Niwa, N. Higashi et al, *J. Macromol. Sci. Chem.*, A24, (5), 567 (1987).

Moreover, the AB block copolymer can be synthesized by a method wherein an azobis compound containing either the A block portion or the B block portion is synthesized and using the resulting polymer azobis initiator as an initiator, a radical polymerization reaction is conducted with monomers for forming another block. Specifically, the AB block copolymer can be synthesized by the methods described, for example, in Akira Ueda and Susumu Nagai, *Kobunshi Ronbun Shu,* 44, 469(1987), and Akira Ueda, *Osakashiritsu Kogyo Kenkyusho Hokoku,* 84, (1989).

In case of utilizing the above described synthesis method, a weight average molecular weight of the polymer azobis initiator is preferably not more than $2\times10^4$ in view of the easy synthesis of polymer azobis initiator and the regular polymerization reaction for the formation of block. On the other hand, it is preferred that the polymer chain of B block is longer than that of A block in the resin (B) according to the present invention. As a result, a polymer azobis initiator containing the A block portion is preferably employed when the AB block copolymer is synthesized according to the method. For example, the AB block copolymer is synthesized according to the following reaction scheme (E):

Reaction Scheme (E)

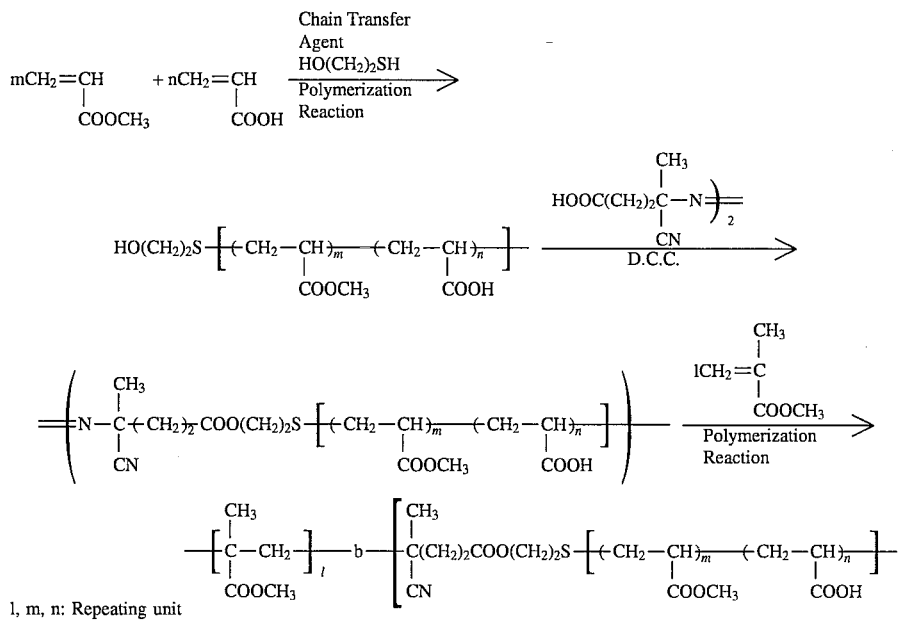

The resin (B) can have the specified polar group bonded either directly or via an appropriate linking group at one terminal of the polymer chain of the A block comprising the polar group-containing polymer component as described above. In such a case, the polar group bonded at the terminal may be the same as or different from the polar group present in the polymer component constituting the A block. Suitable examples of the linking groups include those illustrated for the cases wherein the polar groups are present in the polymer chain of the resin (A) described hereinbefore.

The AB block copolymer having the specified polar group at the terminal of its polymer chain can be produced by a conventionally known polymerization reaction method. More specifically, it can be produced by a method comprising previously protecting the specified polar group in a monomer corresponding to the polymer component having the specified polar group to form a functional group, synthesizing an AB block copolymer by a so-called known living polymerization reaction, for example, an ion polymerization reaction with an organic metal compound (e.g., alkyl lithiums, lithium diisopropylamide and alkylmagnesium halides) or a hydrogen iodide/iodine system, a photopolymerization reaction using a porphyrin metal complex as a catalyst or a group transfer polymerization reaction, introducing directly the specified polar group or introducing at first a functional group capable of connecting the specified polar group, then chemically bonding the specified polar group, at the stop reaction, and then conducting a protection-removing reaction of the functional group formed by protecting the polar group in the polymer by a hydrolysis reaction, hydrogenolysis reaction, an oxidative decomposition reaction or a photodecomposition reaction to form the polar group. One example thereof is shown by the following reaction scheme (F):

Reaction Scheme (F)

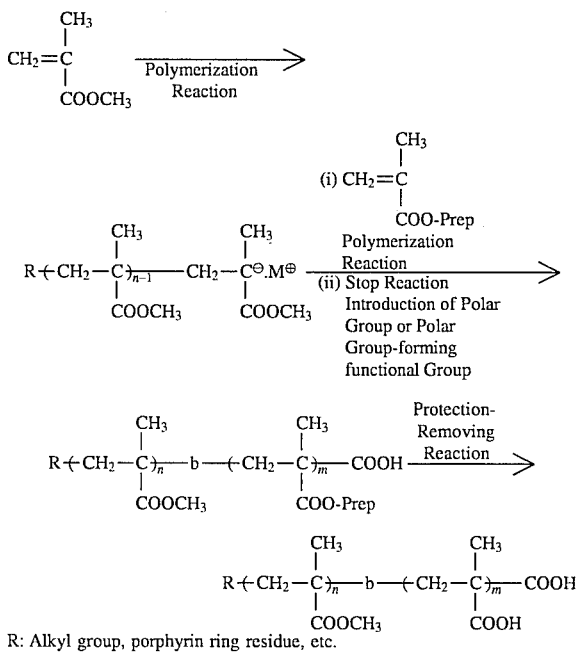

R: Alkyl group, porphyrin ring residue, etc.
Prep: Protective group (e.g., $-C(C_6H_5)_3$, $-Si(C_3H_7)_3$, etc.)
b: A bond connecting two blocks present on both sides
m, n: Repeating unit Specifically, the AB block copolymer can be easily synthesized according to the synthesis methods described in the literatures cited hereinbefore with respect to the synthesis of the resin (B).

Furthermore, the AB block copolymer can also be synthesized by performing a polymerization reaction under light irradiating using a monomer having an unprotected polar group and also using a dithiocarbamate group-containing compound and/or xanthate group-containing compound which also contains the specific polar group as a substituent as an initiator. For example, the block copolymer can be synthesized according to the synthesis methods described in the literature references cited hereinbefore with respect to the synthesis of the resin (B).

Also, the protection of the specified polar group by a protective group and the release of the protective group (a reaction for removing a protective group) described above can be easily conducted by utilizing conventionally known knowledges. More specifically, they can be performed by appropriately selecting methods described in the literature references cited hereinbefore with respect to the synthesis of the resin (B), as well as the methods as described in the above references.

Of the resin (B), the block copolymer wherein the B blocks are bonded to the both terminals of the A block (hereinafter sometimes referred to as a BAB block copolymer) is described below.

The B blocks bonded to the both terminals of the A block may be structurally the same or different and each contains the polymer component represented by the general formula (I) and does not contain the specified polar group-containing component present in the A block. The lengths of the polymer chains may be the same or different.

The BAB block copolymer used in the present invention can be produced by a conventionally known polymerization reaction method. More specifically, it can be produced by the method comprising previously protecting the specified polar group in a monomer corresponding to the polymer component having the specified polar group to form a functional group, synthesizing an AB block copolymer by a so-called known living polymerization reaction, for example, an ion polymerization reaction with an organic metal compound (e.g., alkyl lithiums, lithium diisopropylamide and alkylmagnesium halides) or a hydrogen iodide/iodine system, a photopolymerization reaction using a porphyrin metal complex as a catalyst or a group transfer polymerization reaction, and then conducting a protection-removing reaction of the functional group which had been formed by protecting the polar group by a hydrolysis reaction, a hydrogenolysis reaction, an oxidative decomposition reaction or a photodecomposition reaction to form the polar group. One example thereof is shown by the following reaction scheme (G):

Reaction Scheme (G)

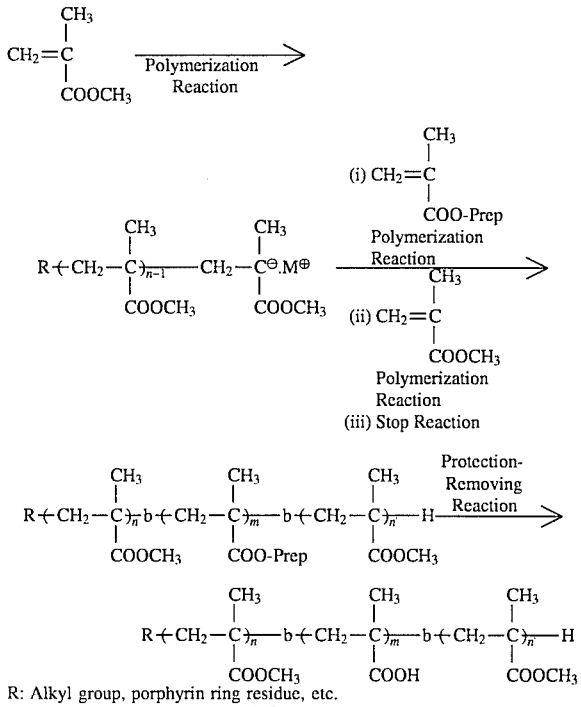

R: Alkyl group, porphyrin ring residue, etc.
Prep: Protective group (e.g., $-C(C_6H_5)_3$, $-Si(C_3H_7)_3$, etc.)
b: A bond connecting two blocks present on both sides
n, m, n': Repeating unit Specifically, the BAB block copolymer can be easily synthesized according to the synthesis methods described, e.g., in P. Lutz, P. Masson et al, *Polym. Bull.*, 12, 79 (1984), B. C. Anderson, G. D. Andrews et al, *Macromolecules*, 14, 1601 (1981), K. Hatada, K. Ute et al, *Polym. J.*, 17, 977 (1985), ibid., 18, 1037 (1986), Koichi Ute and Koichi Hatada, *Kobunshi Kako* (*Polymer Processing*), 36, 366 (1987), Toshinobu Higashimura and Mitsuo Sawamoto, *Kobunshi Ronbun Shu* (*Polymer Treatises*, 46, 189 (1989), M. Kuroki and T. Aida, *J. Am. Chem. Soc.*, 109, 4737 (1989), Teizo Aida and Shohei Inoue, *Yuki Gosei Kagaku* (*Organic Synthesis Chemistry*), 43, 300 (1985), and D. Y. Sogah, W. R. Hertier et al, *Macromolecules*, 20, 1473 (1987), M. Morton, T. E. Helminiake et al, *J. Polym. Sci.*, 57, 471 (1962), S. Gordon III, M. Blumenthal and J. E. Loftus, *Polym. Bull.*, 11, 349 (1984), and R. B. Bates, W. A. Beavers et al, *J. Org. Chem.*, 44, 3800 (1979).

Also, the protection of the specified polar group by a protective group and the release of the protective group (a reaction for removing a protective group) can be easily conducted by utilizing conventionally known knowledges. More specifically, they can be performed by appropriately selecting methods described in the literature references cited hereinbefore with respect to the synthesis of the resin (B), as well as the methods as described in the above references.

Further, the BAB block copolymer can also be synthesized by performing a polymerization reaction under light irradiation using a monomer having an unprotected polar group and also using a dithiocarbamate group-containing compound and/or xanthate group-containing compound as an initiator. For example, the block copolymer can be synthesized according to the synthesis methods described in the literature references cited hereinbefore with respect to the synthesis of the resin (B).

The ratio of resin (A) to resin (B) used in the present invention is preferably 0.05 to 0.60/0.95 to 0.40, more preferably 0.10 to 0.40/0.90 to 0.60 in terms of a weight ratio of resin (A)/resin (B).

When the weight ratio of resin (A)/resin (B) is less than 0.05, the effect for improving the electrostatic characteristics may be reduced. On the other hand, when it is more than 0.60, the film strength of the photoconductive layer may not be sufficiently maintained in some cases (particularly, in case of using as an electrophotographic printing plate precursor).

The resin (A) used in the photoconductive layer according to the present invention includes three embodiments of the resins ($A_1$), ($A_2$) and ($A_3$) as described above. Two or more kinds of each of the resins (A) and the resins (B) may be employed in the photoconductive layer. What is important is that the resin (A) and the resin (B) are employed at the ratio described above.

Furthermore, in the present invention, the binder resin used in the photoconductive layer may contain other resin(s) known for inorganic photoconductive substance in addition to the resin (A) and the resin (B) according to the present invention. However, the amount of other resins described above should not exceed 30 parts by weight per 100 parts by weight of the total binder resins since, if the amount is more than 30 parts by weight, the effects of the present invention are remarkably reduced.

Representative other resins which can be employed together with the resins (A) and (B) according to the present invention include vinyl chloride-vinyl acetate copolymers, styrene-butadiene copolymers, styrene-methacrylate copolymers, methacrylate copolymers, acrylate copolymers, vinyl acetate copolymers, polyvinyl butyral resins, alkyd resins, silicone resins, epoxy resins, epoxyester resins, and polyester resins.

Specific examples of other resins used are described, for example, in Takaharu Shibata and Jiro Ishiwatari, *Kobunshi* (*High Molecular Materials*), 17, 278 (1968), Harumi Miyamoto and Hidehiko Takei, *Imaging* No. 8, 9 (1973), Koichi Nakamura, *Kiroku Zairyoyo Binder no Jissai Gijutsu* (*Practical Technique of Binders for Recording Materials*), Cp. 10, published by C. M. C. Shuppan (1985), D. Tatt, S. C. Heidecker *Tappi,* 49, No. 10, 439 (1966), E. S. Baltazzi, R. G. Blanckette, et al., *Photo. Sci. Eng.,* 16, No. 5, 354 (1972), Nguyen Chank Keh, Isamu Shimizu and Eiichi Inoue, *Denshi Shashin Gakkaishi* (*Journal of Electrophotographic Association*), 18, No. 2, 22 (1980), JP-B-50-31011, JP-A-53-54027, JP-A-54-20735, JP-A-57-202544 and JP-A-58-68046.

The total amount of binder resin used in the photoconductive layer according to the present invention is preferably from 10 to 100 parts by weight, more preferably from 15 to 50 parts by weight, per 100 parts by weight of the inorganic photoconductive substance.

When the total amount of binder resin used is less than 10 parts by weight per 100 parts by weight of the inorganic photoconductive substance, it may be difficult to maintain the film strength of the photoconductive layer. On the other hand, when it is more than 100 parts by weight, the electrostatic characteristics may decrease and the image forming performance may degrade to result in the formation of poor duplicated image.

The inorganic photoconductive substance which can be used in the present invention includes zinc oxide, titanium oxide, zinc sulfide, cadmium sulfide, cadmium carbonate, zinc selenide, cadmium selenide, tellurium selenide, and lead sulfide.

As the spectral sensitizing dye which can be used in the present invention, various dyes can be employed individually or as a combination of two or more thereof. Examples of the spectral sensitizing dyes include, for example, carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, and styryl dyes), and phthalocyanine dyes (including metallized dyes) as described for example, in Harumi Miyamoto and Hidehiko Takei, *Imaging,* 1973, No. 8, 12, C. J. Young et al., *RCA Review,* 15, 469 (1954 ), Kohei Kiyota et al., *Denkitsushin Gakkai Ronbunshi,* J 63-C, No. 2, 97 (1980), Yuji Harasaki et al., *Kogyo Kagaku Zasshi,* 66, 78 and 188 (1963), and Tadaaki Tani, *Nihon Shashin Gakkaishi,* 35, 208 (1972).

Specific examples of the carbonium dyes, triphenylmethane dyes, xanthene dyes, and phthalein dyes are described, for example, in JP-B-51-452, JP-A-50-90334, JP-A-50-114227, JP-A-53-39130, JP-A-53-82353, U.S. Pat. Nos. 3,052,540 and 4,054,450, and JP-A-57-16456.

The polymethine dyes, such as oxonol dyes, merocyanine dyes, cyanine dyes, and rhodacyanine dyes, include those described, for example, in F. M. Hamer, *The Cyanine Dyes and Related Compounds.* Specific examples include those described, for example, in U.S. Pat. Nos. 3,047,384, 3,110,591, 3,121,008, 3,125,447, 3,128,179, 3,132,942, and 3,622,317, British Patents 1,226,892, 1,309,274 and 1,405,898, JP-B-48-7814 and JP-B-55-18892.

In addition, polymethine dyes capable of spectrally sensitizing in the longer wavelength region of 700 nm or more, i.e., from the near infrared region to the infrared region, include those described, for example, in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research disclosure,* 216, 117 to 118 (1982).

The electrophotographic light-sensitive material of the present invention is excellent in that the performance properties thereof are not liable to variation even when various kinds of sensitizing dyes are employed together.

If desired, the photoconductive layer may further contain various additives commonly employed in conventional electrophotographic light-sensitive layer, such as chemical sensitizers. Examples of such additives include electron-accepting compounds (e.g., halogen, benzoquinone, chloranil, acid anhydrides, and organic carboxylic acids) as described in the above-mentioned *Imaging,* 1973, No. 8, 12; and polyarylalkane compounds, hindered phenol compounds, and p-phenylenediamine compounds as described in Hiroshi Kokado et al., *Saikin-no Kododen Zairyo to Kankotai no Kaihatsu Jitsuyoka,* Chaps. 4 to 6, Nippon Kagaku Joho K. K. (1986).

The amount of these additives is not particularly restricted and usually ranges from 0.0001 to 2.0 parts by weight per 100 parts by weight of the photoconductive substance.

The photoconductive layer suitably has a thickness of from 1 to 100 μm, preferably from 10 to 50 μm.

In cases where the photoconductive layer functions as a charge generating layer in a laminated light-sensitive material composed of a charge generating layer and a charge transporting layer, the thickness of the charge generating layer suitably ranges from 0.01 to 1 μm, preferably from 0.05 to 0.5 μm.

If desired, an insulating layer can be provided on the light-sensitive layer of the present invention. When the insulating layer is made to serve for the main purposes for protection and improvement of durability and dark decay characteristics of the light-sensitive material, its thickness is relatively small. When the insulating layer is formed to provide the light-sensitive material suitable for application to special electrophotographic processes, its thickness is relatively large, usually ranging from 5 to 70 μm, preferably from 10 to 50 μm.

Charge transporting materials in the above-described laminated light-sensitive material include polyvinylcarbazole, oxazole dyes, pyrazoline dyes, and triphenylmethane dyes. The thickness of the charge transporting layer ranges usually from 5 to 40 μm, preferably from 10 to 30 μm.

Resins to be used in the insulating layer or charge transporting layer typically include thermoplastic and thermosetting resins, e.g., polystyrene resins, polyester resins, cellulose resins, polyether resins, vinyl chloride resins, vinyl acetate resins, vinyl chloride-vinyl acetate copolymer resins, polyacrylate resins, polyolefin resins, urethane resins, epoxy resins, melamine resins, and silicone resins.

The photoconductive layer according to the present invention can be provided on any known support. In general, a support for an electrophotographic light-sensitive layer is preferably electrically conductive. Any of conventionally employed conductive supports may be utilized in the present invention. Examples of usable conductive supports include a substrate (e.g., a metal sheet, paper, and a plastic sheet) having been rendered electrically conductive by, for example, impregnating with a low resistant substance; the above-described substrate with the back side thereof (opposite to the light-sensitive layer side) being rendered conductive and having further coated thereon at least one layer for the purpose of prevention of curling; the above-described substrate having provided thereon a water-resistant adhesive layer; the above-described substrate having provided thereon at least one precoat layer; and paper laminated with a conductive plastic film on which aluminum is vapor deposited.

Specific examples of conductive supports and materials for imparting conductivity are described, for example, in Yukio Sakamoto, *Denshishashin,* 14, No. 1, pp. 2 to 11 (1975), Hiroyuki Moriga, *Nyumon Tokushushi no Kagaku,* Kobunshi Kankokai (1975), and M. F. Hoover, *J. Macromol. Sci. Chem.,* A-4(6), pp. 1327 to 1417 (1970).

The electrophotographic light-sensitive material according to the present invention can be utilized in any known electrophotographic process. Specifically, the light-sensitive material of the present invention is employed in any recording system including a PPC system and a CPC system in combination with any developer including a dry type developer and a liquid developer. In particular, the light-sensitive material is preferably employed in combination with a liquid developer in order to obtain the excellent effect of the present invention since the light-sensitive material is capable of providing faithfully duplicated image of highly accurate original.

Further, a color duplicated image can be produced by using it in combination with a color developer in addition to the formation of black and white image. Reference can be made to methods described, for example, in Kuro Takizawa, *Shashin Kogyo,* 33, 34 (1975) and Masayasu Anzai, *Denshitsushin Gakkai Gijutsu Kenkyu Hokoku,* 77, 17 (1977).

Moreover, the light-sensitive material of the present invention is effective for recent other uses utilizing an electrophotographic process. For instance, the light-sensitive material containing photoconductive zinc oxide as a photoconductive substance is employed as an off-set printing plate precursor, and the light-sensitive material containing photoconductive zinc oxide or titanium oxide which does not cause environmental pollution and has good whiteness is employed as a recording material for forming a block copy usable in an offset printing process or a color proof.

BEST MODE FOR CONDUCTING THE INVENTION

The present invention is illustrated in greater detail with reference to the following examples where the molecular weights of resins A-1, A-11, A-29 and A-101 and macromonomers M-1, M-2, M-4 and M-101 were measured by GPC, but the present invention is not to be construed as being limited thereto.

Synthesis examples of the resin (A) are specifically illustrated below.

SYNTHESIS EXAMPLE 1 OF MACROMONOMER: (M-1)

A mixed solution of 75 g of methyl methacrylate, 25 g of methyl acrylate, 5 g of thioglycolic acid, and 200 g of toluene was heated to a temperature of 75° C. with stirring under nitrogen gas stream and, after adding thereto 1.0 g of 2,2-azobisisobutyronitrile (abbreviated as A.I.B.N.), the reaction was carried out for 8 hours. Then, to the reaction mixture were added 8 g of glycidyl methacrylate, 1.0 g of N,N-dimethyldodecylamine, and 0.5 g of t-butylhydroquinone, and the resulting mixture was stirred for 12 hours at 100° C. After cooling, the reaction mixture was reprecipitated from 2 liters of n-hexane to obtain 82 g of a white powder. A weight average molecular weight (Mw) of the resulting polymer was $3.8\times10^3$.

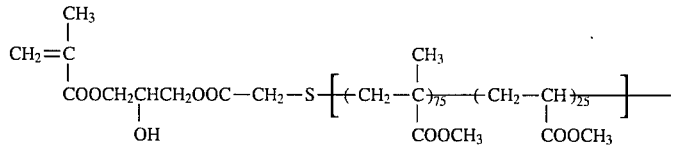

(M-1)

SYNTHESIS EXAMPLE 2 OF MACROMONOMER: (M-2)

A mixed solution of 90 g of butyl methacrylate, 10 g of methacrylic acid, 4 g of 2-mercaptoethanol, and 200 g of tetrahydrofuran was heated to a temperature of 70° C. with stirring under nitrogen gas stream and, after adding thereto 1.2 g of A.I.B.N., the reaction was carried out for 8 hours.

Then, the reaction mixture was cooled to 20° C. in a water bath and, after adding thereto 10.2 g of triethylamine, 14.5 g of methacrylic acid chloride was added dropwise to the mixture with stirring at a temperature of lower than 25° C. Thereafter, the mixture was further stirred for one hour. Then, 0.5 g of t-butylhydroquinone was added to the mixture, and the resulting mixture was heated to a temperature of 60° C. and stirred for 4 hours.

After cooling, the reaction mixture was added dropwise to one liter of water with stirring (over a period of about 10 minutes) followed by stirring for one hour. After allowing to stand the mixture, water was removed by decantation. After washing twice with water, the reaction mixture was dissolved in 100 ml of tetrahydrofuran and the solution was reprecipitated from 2 liters of petroleum ether. The precipitates thus formed were collected by decantation and dried under reduced pressure to obtain 65 g of the viscous product. An Mw of the polymer was $3.3\times10^3$.

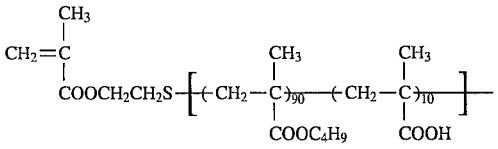

(M-2)

SYNTHESIS EXAMPLE 3 OF MACROMONOMER: (M-3)

A mixed solution of 95 g of benzyl methacrylate, 5 g of 2-phosphonoethyl methacrylate, 6 g of 2-aminoethylmercaptan, and 200 g of tetrahydrofuran was heated to a temperature of 70° C. with stirring under nitrogen gas stream. After adding thereto 1.5 g of A.I.B.N., the reaction was carried out for 4 hours and, after further adding thereto 0.5 g of A.I.B.N., the reaction was carried out for 4 hour.

Then, the reaction mixture was cooled to a temperature of 20° C. and after adding thereto 10 g of acrylic anhydride, the resulting mixture was stirred for one hour at a temperature of from 20° to 25° C. Then, 1.0 g of t-butylhydroquinone was added to the mixture, followed by stirring for 4 hours at a temperature of from 50° to 60° C. After cooling, the reaction mixture was added dropwise to one liter of water with stirring over a peried of about 10 minutes followed by stirring for one hour and, after allowing the reaction mixture to stand, water was removed by decantation. After repeatedly washing the mixture twice with water, the reaction mixture was dissolved in 100 ml of tetrahydrofuran and the solution was reprecipitated from 2 liters of petroleum ether. The precipitates formed were collected by decantation and dried under reduced pressure to obtain 70 g of the viscous product. An Mw of the polymer was $6\times10^3$.

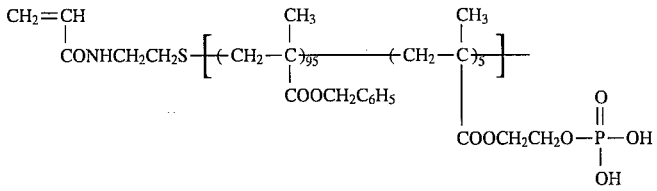

(M-3)

SYNTHESIS EXAMPLE 4 OF MACROMONOMER: (M-4)

A mixed solution of 90 g of 2-chlorophenyl methacrylate, 10 g of Monomer (I) having the structure (I') shown below, 4 g of thioglycolic acid, and 200 g of toluene was heated to 70° C. with stirring under nitrogen gas stream. After adding thereto 1.5 g of A.I.B.N., the reaction was carried out for 5 hours and, after further adding thereto 0.5 g of A.I.B.N., the reaction was carried out for 4 hour. Then, after adding thereto 12.4 g of glycidyl methacrylate, 1.0 g of N,N-dimethyldodecylamine, 1.5 g of t-butylhydroquinone, the reaction was carried out for 8 hours at 110° C. After cooling, the reaction mixture was added to a mixture of 3 g of p-toluenesulfonic acid and 100 ml of an aqueous solution of 90% by volume tetrahydrofuran followed by stirring for one hour at a temperature of from 30° to 35° C. The reaction mixture was reprecipitated from 2 liters of a water/ethanol (1/3 by volume) mixed solution, and the precipitates formed were collected by decantation. The precipitates were dissolved in 200 ml of tetrahydrofuran, and the solution was reprecipitated from 2 liters of n-hexane to obtain 58 g of a powder. An Mw of the polymer was $7.6\times10^3$.

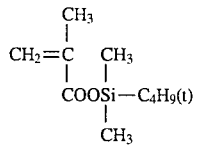

Monomer (I)

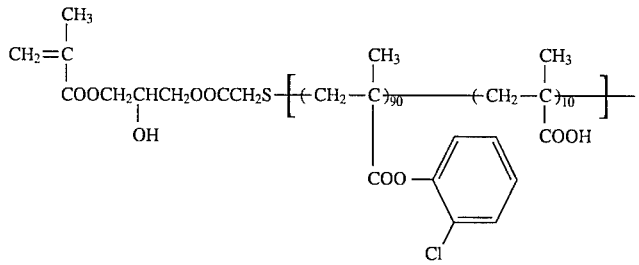

(M-4)

SYNTHESIS EXAMPLE 5 OF MACROMONOMER: (M-5)

A mixed solution of 95 g of 2,6-dichlorophenyl methacrylate, 5 g of 3-(2'-nitrobenzyloxysulfonyl)propyl methacrylate, 150 g of toluene, and 50 g of isopropyl alcohol was heated to 80° C. with stirring under nitrogen gas stream. After adding thereto 5.0 g of 2,2'-azobis(2-cyanovaleric acid) (A.C.V.), the reaction was carried out for 5 hours and, after further adding thereto 1.0 g of A.C.V., the reaction was carried out for 4 hours. After cooling, the reaction mixture was reprecipitated from 2 liters of methanol, and the powder formed was collected by filtration and dried under reduced pressure.

A mixture of 50 g of the powder prepared above, 14 g of glycidyl methacrylate, 0.6 g of N,N-dimethyldocylamine, 1.0 g of t-butylhydroquinone, and 100 g of toluene was stirred for 10 hours at a temperature of 110° C. After cooling the mixture to a room temperature, the mixture was irradiated by a high-pressure mercury lamp of 80 W for one hour with stirring. Thereafter, the reaction mixture was reprecipitated from one liter of methanol, and the powder formed was collected by filtration and dried under reduced pressure to obtain 34 g of the polymer. An Mw of the polymer was $7.3\times10^3$.

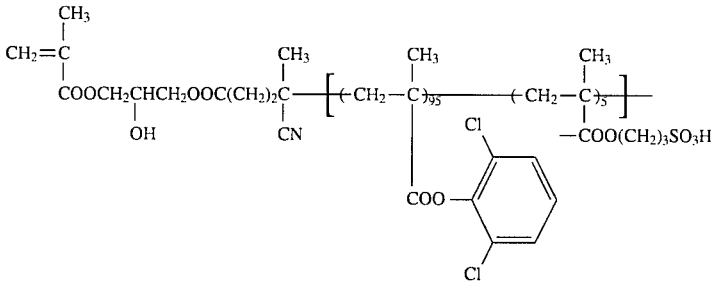

(M-5)

SYNTHESIS EXAMPLE 6 OF MACROMONOMER: (M-6)

A mixed solution of 80 g of ethyl methacrylate, 5 g of N-vinylpyrrolidone, 29 g of trimethylsilyl methacrylate, 3 g of β-mercaptoethanol, and 200 g of tetrahydrofuran was heated to a temperature of 70° C. with stirring under nitrogen gas stream. After adding thereto 1 g of A.I.B.N., the reaction was carried out for 4 hours and after further adding thereto 0.5 g of A.I.B.N., the reaction was carried out for 4 hours. The reaction mixture was cooled to 25° C. and after adding thereto 6.6 g of methacrylic acid, a mixed solution of 8 g of dicarboxylcarbodiimide (D.C.C.), 0.2 g of 4-(N,N-dimethylamino)pyridine and 20 g of methylene chloride was added dropwise to the mixture at a temperature of from 25° to 30° C., followed by stirring for 4 hours under the same condition. Then, 10 g of formic acid was added to the reaction mixture, followed by stirring for one hour. The insoluble substance deposited was removed by filtration, the filtrate was reprecipitated from one liter of methanol to collect the oily product by filtration. The oily product was dissolved in 200 g of tetrahydrofuran, and after removing the insoluble substance by filtration, the filtrate was again reprecipitated from one liter of methanol. The resulting oily product was collected and dried to obtain 65 g of the polymer. An Mw of the polymer was $7\times10^3$.

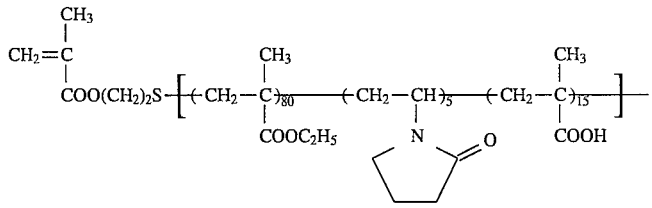

(M-6)

SYNTHESIS EXAMPLE 1 OF RESIN (A): (A-1)

A mixed solution of 70 g of benzyl methacrylate, 30 g of Macromonomer (M-1), 150 g of toluene, and 50 g of isopropanol was heated to a temperature of 80° C. under nitrogen gas stream, and 5 g of A.C.V. was added thereto to effect a reaction for 4 hours. To the reaction mixture was further added 0.5 g of A.C.V., followed by reacting for 4 hours. The resulting copolymer had a weight average molecular weight (Mw) of $1.0\times10^4$.

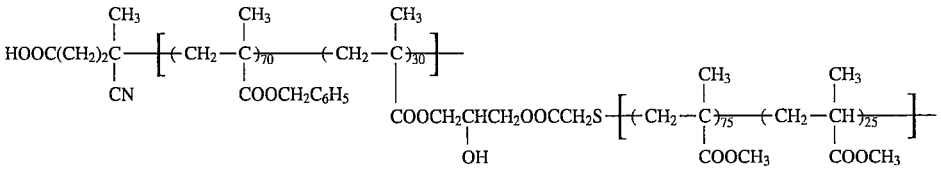

(A-1)

SYNTHESIS EXAMPLE 2 OF RESIN (A): (A-2)

A mixed solution of 80 g of 2-chlorophenyl methacrylate, 20 g of a macromonomer corresponding to a repeating unit having the structure shown below (Mw: $5\times10^3$), 3.0 g of β-mercaptopropionic acid, and 200 g of toluene was heated to a temperature of 75° C. under nitrogen gas stream. After adding thereto 1.5 g of A.I.B.N., the reaction was carried out for 4 hours. After further adding thereto 0.5 g of A.I.B.N., the reaction was carried out for 4 hours. The resulting copolymer had an Mw of $8.8\times10^3$.

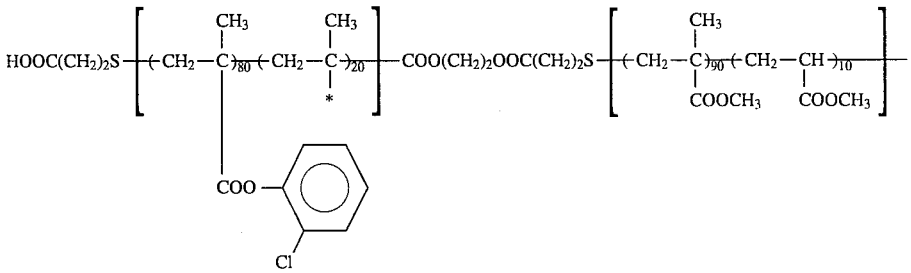

Resin (A-2)

SYNTHESIS EXAMPLES 3 TO 9 OF RESIN (A): (A-3) to (A-9)

Each of the copolymers shown in Table 2 below was synthesized in the same manner as described in Synthesis Example 2 of Resin (A) except for using each of monomers and macromonomers corresponding to the repeating units shown in Table 2 below in place of 80 g of 2-chlorophenyl methacrylate and 20 g of the macromonomer in Synthesis Example 2 of Resin (A). The Mw of each of the copolymers was in a range of from $7.5\times10^3$ to $9\times10^3$. The Mw of each of the macromonomers used was in a range of from $3.5\times10^3$ to $5\times10^3$.

TABLE 2

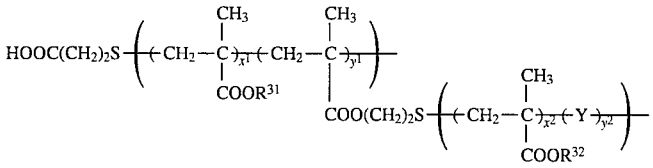

| Synthesis Example of Resin (A) | Resin (A) | $R^{31}$ | $x^1/y^1$ (weight ratio) | $-R^{32}$ | $-Y-$ | $x^2/y^2$ (weight ratio) |
|---|---|---|---|---|---|---|
| 3 | A-3 | $-CH_3$ | 70/30 | $-CH_2C_6H_5$ | — | 100/0 |
| 4 | A-4 | $-C_6H_5$ | 60/40 | $-CH_2C_6H_5$ | — | 100/0 |
| 5 | A-5 | $-C_2H_5$ | 75/25 | $-CH_2C_6H_5$ | $-CH_2-CH(COOCH_2C_6H_5)-$ | 60/40 |
| 6 | A-6 | $-CH_2C_6H_5$ | 80/20 | $-CH_3$ | 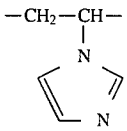 | 95/5 |
| 7 | A-7 | $-CH_2C_6H_5$ | 60/40 | 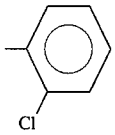 | $-CH_2CH(C\equiv N)-$ | 95/5 |
| 8 | A-8 | 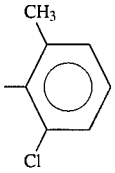 | 80/20 | $-C_6H_5$ | — | 100/0 |
| 9 | A-9 | 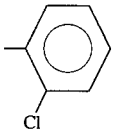 | 75/25 | 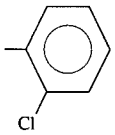 | $-CH_2CH(COOCH_3)-$ | 80/20 |

SYNTHESIS EXAMPLE 10 OF RESIN (A): (A-10)

A mixed solution of 70 g of benzyl methacrylate, 30 g of Macromonomer (M-4), and 200 g of toluene was heated to a temperature of 80° C. under nitrogen gas stream, and 8 g of 2,2'-azobisvaleronitrile (A.I.V.N.) was added thereto to effect a reaction for 3 hours. To the reaction mixture was further added 1 g of A.I.V.N., followed by reacting for 4 hours. The resulting polymer had an Mw of $8.5\times10^3$.

SYNTHESIS EXAMPLE 11 OF RESIN (A): (A-11)

A mixed solution of 60 g of 2-chlorophenyl methacrylate, 35 g of Macromonomer (M-2), 5 g of 2-methoxyethyl methacrylate, 3 g of octadecyl methacrylate, and 200 g of toluene was heated to a temperature of 75° C. under nitrogen gas stream, and 1.0 g of A.I.B.N. was added thereto to effect a reaction for 3 hours. After further adding thereto 0.5 g of A.I.B.N., the reaction was carried out for 3 hours, and after

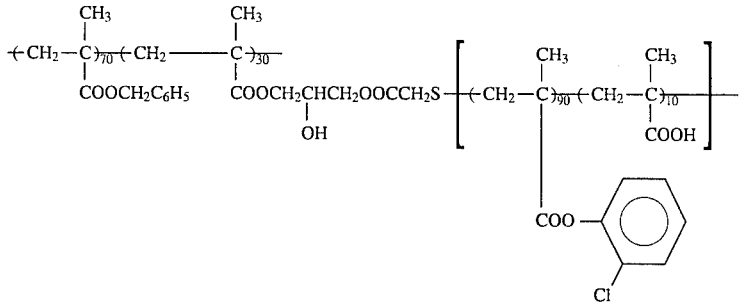

(A-10)

further adding thereto 0.5 g of A.I.B.N., the reaction was carried out for 3 hours. After cooling, the reaction mixture was reprecipitated from one liter of ether, the resulting precipitates were collected and dried to obtain 63 g of the viscous product having an Mw of $6.5\times10^3$.

Mw of each of the copolymers was in the range of from $6\times10^3$ to $8\times10^3$.

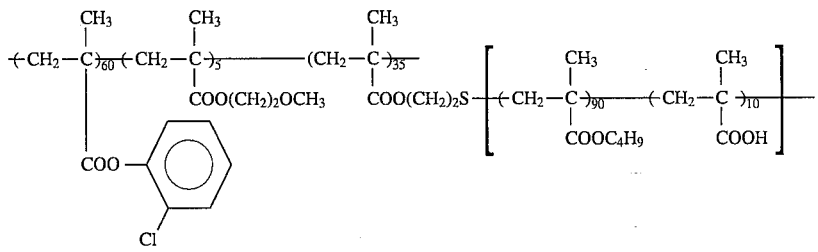

(A-11)

SYNTHESIS EXAMPLES 12 TO 19 OF RESIN (A): (A-12) to (A-19)

Each of the copolymers shown in Table 3 below was synthesized in the same procedure as described in Synthesis Example 11 of Resin (A) except for using each of monomers and macromonomers corresponding to the polymer components shown in Table 3 below in place of the monomer and macromonomer in Synthesis Example 11 of Resin (A). The

TABLE 3

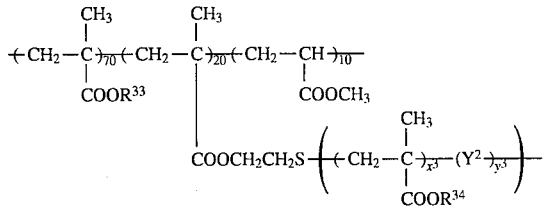

| Synthesis Example of Resin (A) | Resin (A) | $-R^{33}$ | $R^{34}$ | $x^3/y^3$ (weight ratio) | $-Y^2-$ |
|---|---|---|---|---|---|
| 12 | A-12 | $-C_2H_5$ | 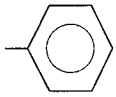 | 90/10 | $-CH_2-CH(COOH)-$ |
| 13 | A-13 | $-C_3H_7$ | 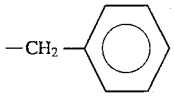 | 85/15 | $-CH_2-C(CH_3)(COO(CH_2)_2OCO(CH_2)_3COOH)-$ |
| 14 | A-14 | $-C_4H_9$ | 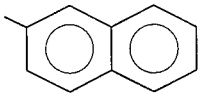 | 90/10 | $-CH_2-C(CH_3)(COO(CH_2)_2O-P(=O)(OH)-OH)-$ |
| 15 | A-15 | 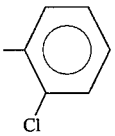 | $-CH_3$ | 90/10 | $-CH_2-CH(COOH_2CH_2COOCH)-$ |

TABLE 3-continued

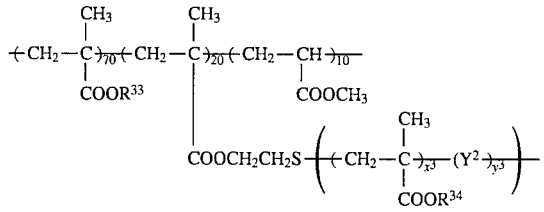

| Synthesis Example of Resin (A) | Resin (A) | $-R^{33}$ | $R^{34}$ | $x^3/y^3$ (weight ratio) | $-Y^2-$ |
|---|---|---|---|---|---|
| 16 | A-16 | 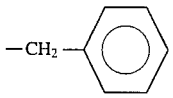 | $-C_2H_5$ | 90/10 | 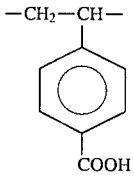 |
| 17 | A-17 | 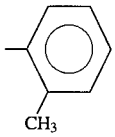 | $-C_4H_9$ | 92/8 | 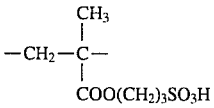 |
| 18 | A-18 | $-CH_3$ | 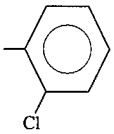 | 93/7 | 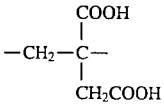 |
| 19 | A-19 | $-CH_3$ | $-C_2H_5$ | 90/10 | 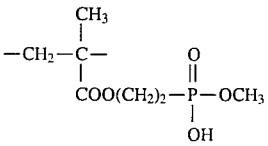 |

SYNTHESIS EXAMPLE 20 OF RESIN (A): (A-20)

A mixed solution of 70 g of 2-chlorophenyl methacrylate, 30 g of Macromonomer (M-3), 3.0 g of thioglycolic acid, and 150 g of toluene was heated to a temperature of 80° C. under nitrogen gas stream, and 1.0 g of A.I.B.N was added thereto to effect a reaction for 4 hours. After further adding thereto 0.5 g of A.I.B.N., the reaction was carried out for 2 hours, and after further adding 0.3 g of A.I.B.N., the reaction was carried out for 3 hours. The resulting copolymer had an Mw of $8.5\times10^3$.

SYNTHESIS EXAMPLES 21 TO 28 OF RESIN (A): (A-21) to (A-28)

Each of the copolymers shown in Table 4 below was synthesized by a polymerization reaction in the same manner as described in Synthesis Example 20 of Resin (A) using each of 60 g of monomers, 40 g of macromonomers and 0.04 moles of mercapto compounds corresponding to the components shown in Table 4 below. The Mw of each of the copolymers was in the range of from $6\times10^3$ to $9\times10^3$.

(A-20)

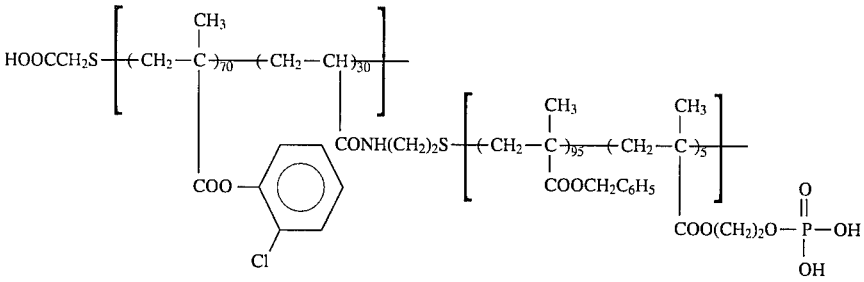

TABLE 4
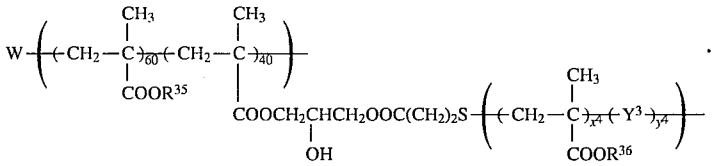
| Synthesis Example of Resin (A) | Resin (A) | W— | $R^{35}$ | $R^{36}$ | $x^4/y^4$ (weight ratio) | $-Y^3-$ |
|---|---|---|---|---|---|---|
| 21 | A-21 | HOOC—$H_2C$—S— | 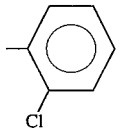 | $-C_2H_5$ | 90/10 | —$CH_2$—CH(—$COO(CH_2)_2COOH$)— |
| 22 | A-22 | HOOC—$CH_2$ / HOOC—CHS— | 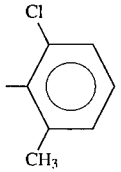 | 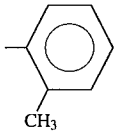 | 85/15 | —$CH_2$—C($CH_2COOH$)(COOH)— |
| 23 | A-23 | 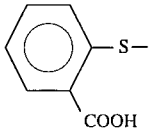 | 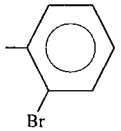 | —$CH_2$— 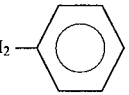 | 90/10 | —$CH_2$—C($CH_3$)(CONH— 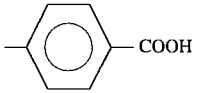 —COOH)— |
| 24 | A-24 | H—P(=O)(OH)—$OCH_2CH_2S$— | $-C_2H_5$ | 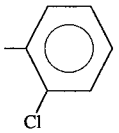 | 90/10 | —$CH_2$—C($CH_3$)($COO(CH_2)_2OCO$— 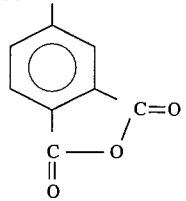 )— |

TABLE 4-continued
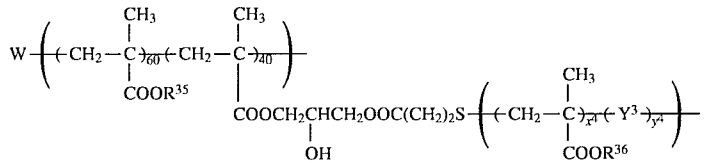
| Synthesis Example of Resin (A) | Resin (A) | W— | $R^{35}$ | $R^{36}$ | $x^4/y^4$ (weight ratio) | $-Y^3-$ |
|---|---|---|---|---|---|---|
| 25 | A-25 | $HO_3SCH_2CH_2S-$ | 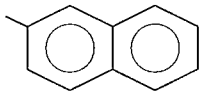 | $-C_4H_9$ | 93/7 | 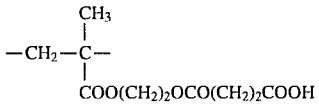 |
| 26 | A-26 | $HOCH_2CH_2-S-$ | 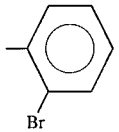 | $-C_2H_5$ | 92/8 | 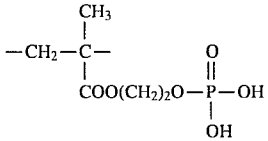 |
| 27 | A-27 | $HOOC-(CH_2)_2S-$ | 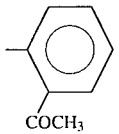 | $-C_3H_7$ | 95/5 | 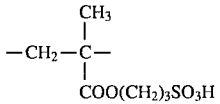 |
| 28 | A-28 | 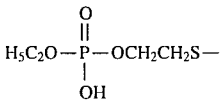 | 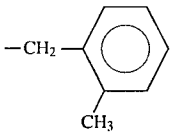 | 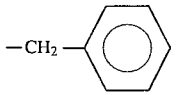 | 90/10 | 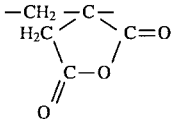 |

SYNTHESIS EXAMPLE 29 OF RESIN (A): (A-29)

A mixed solution of 60 g of 2-chloro-6-methylphenyl methacrylate, 25 g of Macromonomer (M-4), 15 g of methyl acrylate, 150 g of toluene, and 50 g of isopropanol was heated to a temperature of 80° C. under nitrogen gas stream. After adding thereto 5 g of A.C.V., the reaction was carried out for 5 hours and, after further adding thereto 1.0 g of A.C.V., the reaction was carried out for 4 hours. The resulting copolymer had an Mw of $9.8\times10^3$ (A-29)

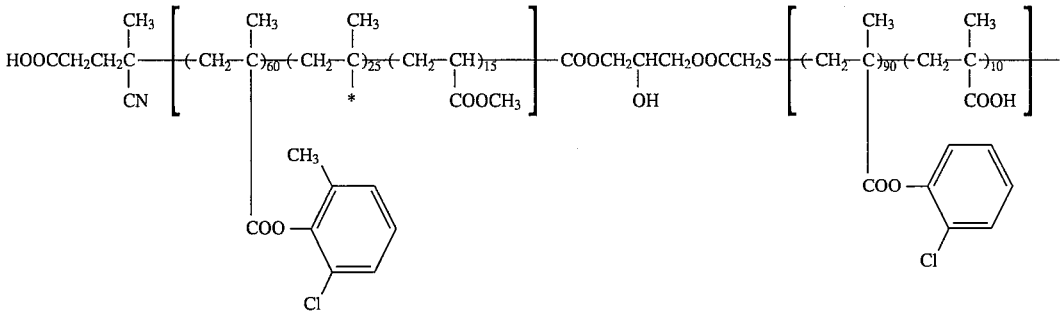

SYNTHESIS EXAMPLE 101 OF MACROMONOMER: (M-101)

A mixed solution of 30 g of triphenylmethyl methacrylate and 100 g of toluene was sufficiently degassed under nitrogen gas stream and cooled to −20° C. Then, 1.0 g of 1,1-diphenylbutyl lithium was added to the mixture, and the reaction was conducted for 10 hours. Separately, a mixed solution of 70 g of ethyl methacrylate and 100 g of toluene was sufficiently degassed under nitrogen gas stream, and the resulting mixed solution was added to the above described mixture, and then reaction was further conducted for 10 hours. The reaction mixture was adjusted to 0° C., and carbon dioxide gas was passed through the mixture in a flow rate of 60 ml/min for 30 minutes, then the polymerization reaction was terminated.

The temperature of the reaction solution obtained was raised to a temperature of 25° C. under stirring, 6 g of 2-hydroxyethyl methacrylate was added thereto, then a mixed solution of 12 g of dicyclohexylcarbodiimide, 1.0 g of 4-N,N-dimethylaminopyridine and 20 g of methylene chloride was added dropwise thereto over a period of 30 minutes, and the mixture was stirred for 3 hours.

After removing the precipitated insoluble substances from the reaction mixture by filtration, 10 ml of an ethanol solution of 30% by weight hydrogen chloride was added to the filtrate, and the mixture was stirred for one hour. Then, the solvent of the reaction mixture was distilled off under reduced pressure until the whole volume was reduced to a half, and the mixture was reprecipitated from one liter of petroleum ether. The precipitates thus formed were collected and dried under reduced pressure to obtain 56 g of the macromonomer having an Mw of $6.5\times10^3$.

(M-101)

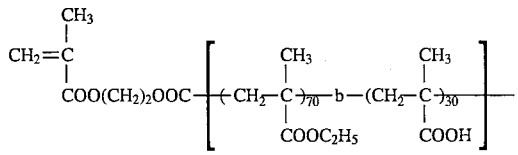

SYNTHESIS EXAMPLE 102 OF MACROMONOMER: (M-102)

A mixed solution of 5 g of benzyl methacrylate, 0.1 g of (tetraphenyl porphynate) aluminum methyl and 60 g of methylene chloride was raised to a temperature of 30° C. under nitrogen gas stream. The mixture was irradiated with light from a xenon lamp of 300 W at a distance of 25 cm through a glass filter, and the reaction was conducted for 12 hours. To the mixture was further added 45 g of butyl methacrylate, after similarly light-irradiating for 8 hours, 10 g of 4-bromomethylstyrene was added to the reaction mixture followed by stirring for 30 minutes, then the reaction was terminated. Then, Pd—C was added to the reaction mixture, and a catalytic reduction reaction was conducted for one hour at a temperature of 25° C.

After removing insoluble substances from the reaction mixture by filtration, the reaction mixture was reprecipitated from 500 ml of petroleum ether and the precipitates thus formed were collected and dried to obtain 33 g of the macromonomer having an Mw of $7\times10^3$.

(M-102)

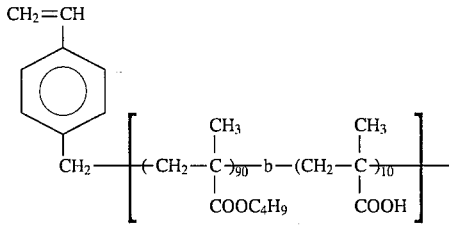

SYNTHESIS EXAMPLE 103 OF MACROMONOMER: (M-103)

A mixed solution of 37.6 g of Monomer (II) having the structure shown below and 100 g of toluene was sufficiently degassed under nitrogen gas stream and cooled to 0° C. Then, 2 g of 1,1-diphenyl-3-methylpentyl lithium was added to the mixture followed by stirring for 6 hours. Separately, a mixed solution of 80 g of 2-chloro-6-methylphenyl methacrylate and 100 g of toluene was sufficiently degassed under nitrogen gas stream and the resulting mixed solution was added to the above described mixture, and then reaction was further conducted for 8 hours. After introducing ethylene oxide at a flow rate of 30 ml/min into the reaction mixture for 30 minutes with vigorously stirring, the mixture was cooled to a temperature of 15° C., and 12 g of methacrylic acid chloride was added dropwise thereto over a period of 30 minutes, followed by stirring for 3 hours.

Then, to the reaction mixture was added 10 g of an ethanol solution of 30% by weight hydrogen chloride and, after stirring the mixture for one hour at 25° C., the mixture was reprecipitated from one liter of petroleum ether. The precipitates thus formed were collected, washed twice with 300 ml of diethyl ether and dried to obtain 55 g of the macromonomer having an Mw of $7.8\times10^3$.

Monomer (II)

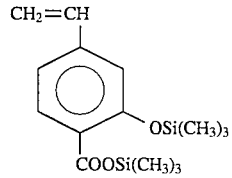

(M-103)

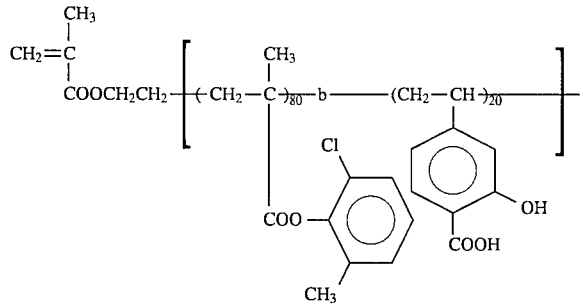

SYNTHESIS EXAMPLE 104 OF MACROMONOMER: (M-104)

A mixed solution of 40 g of triphenylmethyl acrylate and 100 g of toluene was sufficiently degassed under nitrogen gas stream and cooled to −20° C. Then, 2 g of sec-butyl lithium was added to the mixture, and the reaction was conducted for 10 hours. Separately, a mixed solution of 60 g of styrene and 100 g of toluene was sufficiently degassed under nitrogen gas stream and the resulting mixed solution was added to the above described mixture, and then reaction was further conducted for 12 hours. The reaction mixture was adjusted to 0° C., 11 g of benzyl bromide was added thereto, and the reaction was conducted for one hour, followed by reacting at a temperature of 25° C. for 2 hours.

Then, to the reaction mixture was added 10 g of an ethanol solution of 30% by weight hydrogen chloride, followed by stirring for 2 hours. After removing the insoluble substances from the reaction mixture by filtration, the mixture was reprecipitated from one liter of n-hexane. The precipitates thus formed were collected and dried under reduced pressure to obtain 58 g of the macromonomer having an Mw of $4.5\times10^3$.

(M-104)

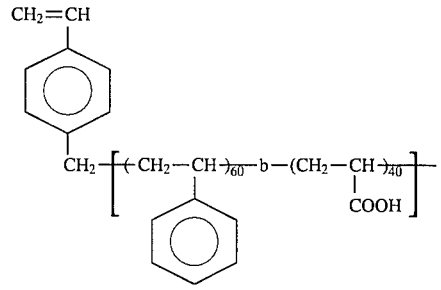

SYNTHESIS EXAMPLE 105 OF MACROMONOMER: (M-105)

A mixed solution of 70 g of phenyl methacrylate and 4.8 g of benzyl N-hydroxyethyl-N-ethyldithiocarbamate was placed in a vessel under nitrogen gas stream followed by closing the vessel and heated to a temperature of 60° C. The mixture was irradiated with light from a high-pressure mercury lamp for 400 W at a distance of 10 cm through a glass filter for 10 hours to conduct a photopolymerization. Then, 30 g of acrylic acid and 180 g of methyl ethyl ketone were added to the mixture and, after replacing the gas in the vessel with nitrogen, the mixture was light-irradiated again for 10 hours.

To the resulting reaction mixture was added dropwise 12 g of 2-isocyanatoethyl methacrylate at a temperature of 30° C. over a period of one hour and the mixture was stirred for 2 hours. The reaction mixture obtained was reprecipitated from 1.5 liters of hexane and the precipitates thus formed were collected and dried to obtain 68 g of the macromonomer having an Mw of $6.0\times10^3$.

(M-105)

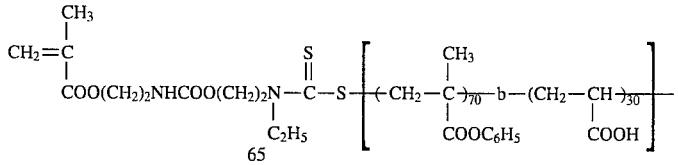

SYNTHESIS EXAMPLE 101 OF RESIN (A): (A-101)

A mixed solution of 80 g of ethyl methacrylate, 20 g of Macromonomer (M-101) and 150 g of toluene was heated at a temperature of 95° C. under nitrogen gas stream, and 6 g of 2,2'-azobis(isobutyronitrile) (A.I.B.N.) was added thereto to effect reaction for 3 hours. Then, 2 g of A.I.B.N. was further added thereto, followed by reacting for 2 hours, and thereafter 2 g of A.I.B.N. was added thereto, followed by reacting for 2 hours. The resulting copolymer had an Mw of $9\times10^3$.

Resin (A-101)

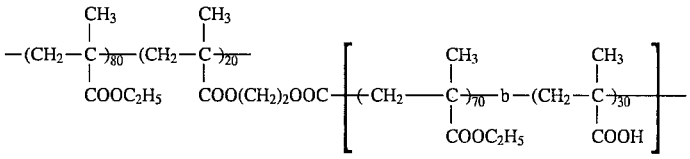

SYNTHESIS EXAMPLE 102 OF RESIN (A): (A-102)

A mixed solution of 70 g of 2-chlorophenyl methacrylate, 30 g of Macromonomer (M-102), 2 g of n-dodecylmercaptan and 100 g of toluene was heated at a temperature of 80° C. under nitrogen gas stream, and 3 g of 2,2'-azobis-(isovaleronitrile) (A.I.V.N.) was added thereto to effect reaction for 3 hours. Then, 1 g of A.I.V.N. was further added, followed by reacting for 2 hours, and thereafter 1 g of A.I.V.N. was added thereto, followed by heating to a temperature of 90° C. and reacting for 3 hours. The resulting copolymer had an Mw of $7.6\times10^3$.

Resin (A-102)

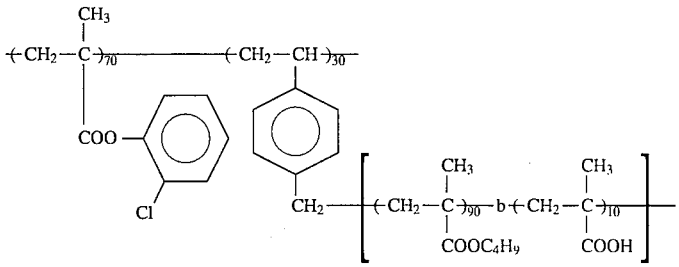

SYNTHESIS EXAMPLES 103 TO 118 OF RESIN (A): (A-103) to (A-118)

The copolymers shown in Table 5 below were synthesized under the same polymerization conditions as described in Synthesis Example 101 of Resin (A) except for using the monomers shown in Table 5 below in place of the ethyl methacrylate, respectively. The Mw of each of the copolymers obtained was in a range of from $5\times10^3$ to $9\times10^3$.

TABLE 5
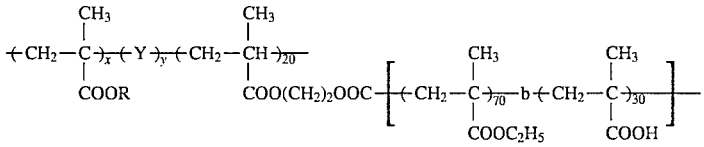
x + y + 20 = 100 (weight ratio)
| Synthesis Example of Resin (A) | Resin (A) | −R | −Y− | x/y |
|---|---|---|---|---|
| 103 | A-103 | $-C_4H_9$ | — | 80/0 |
| 104 | A-104 | $-CH_2C_6H_5$ | — | 80/0 |
| 105 | A-105 | $-C_6H_5$ | — | 80/0 |
| 106 | A-106 | $-C_4H_9$ | $-CH_2-CH-$ 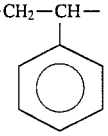 | 65/15 |
| 107 | A-107 | $-CH_2C_6H_5$ | $-CH_2-CH-$ (COOCH$_3$) | 70/10 |
| 108 | A-108 | 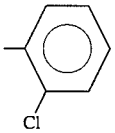 | — | 80/0 |
| 109 | A-109 | 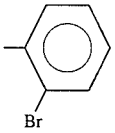 | — | 80/0 |
| 110 | A-110 | 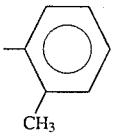 | — | 80/0 |
| 111 | A-111 | 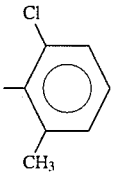 | — | 80/0 |
| 112 | A-112 | 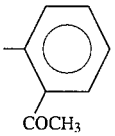 | — | 80/0 |
| 113 | A-113 | 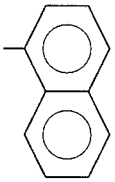 | $-CH_2-CH-$ (COOC$_2$H$_5$) | 70/0 |
| 114 | A-114 | $-CH_2$ 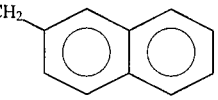 | — | 80/0 |

TABLE 5-continued

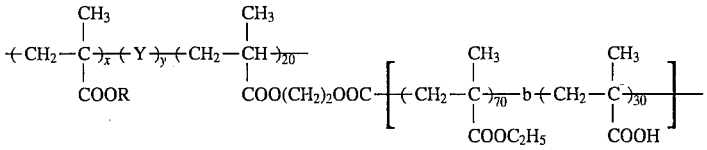

x + y + 20 = 100 (weight ratio)

| Synthesis Example of Resin (A) | Resin (A) | −R | −Y− | x/y |
|---|---|---|---|---|
| 115 | A-115 | $-CH_3$ | $-CH_2-C(CH_3)(COOC_4H_9)-$ | 40/40 |
| 116 | A-116 | $-CH_2C_6H_5$ | $-CH_2-C(CH_3)(COO(CH_2)_2CN)-$ | 65/15 |
| 117 | A-117 | $-C_6H_5$ | $-CH_2-CH(CONH_2)-$ | 72/8 |
| 118 | A-118 | 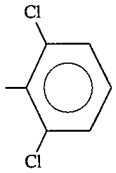 | — | 80/0 |

SYNTHESIS EXAMPLES 119 TO 135 OF RESIN (A): (A-119) to (A-135)

The copolymers shown in Table 6 below were synthesized under the same polymerization conditions as described in Synthesis Example 102 of Resin (A) except for using the macromonomers (M) shown in Table 6 below in place of Macromonomer (M-102), respectively. The Mw of each of the copolymers obtained was in a range of from $2\times10^3$ to $1\times10^4$.

TABLE 6

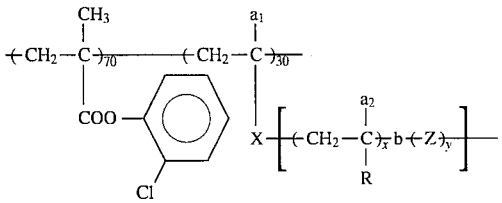

(weight ratio)

| Synthesis Example of Resin (A) | Resin (A) | −X− | $a_1/a_2$ | −R | −Z− | x/y |
|---|---|---|---|---|---|---|
| 119 | A-119 | $-COO(CH_2)_2OOC-$ | −H/ $-CH_3$ | $-COOCH_3$ | $-CH_2-CH(COOH)-$ | 70/30 |

TABLE 6-continued

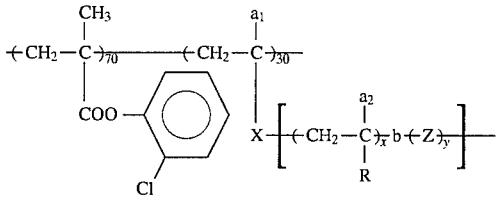

(weight ratio)

| Synthesis Example of Resin (A) | Resin (A) | −X− | $a_1/a_2$ | −R | −Z− | x/y |
|---|---|---|---|---|---|---|
| 120 | A-120 | $-COOCH_2CH(OH)CH_2OOC-$ | $-CH_3/-CH_3$ | $-COOCH_2C_6H_5$ | 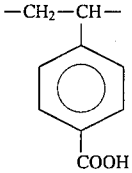 | 60/40 |
| 121 | A-121 | 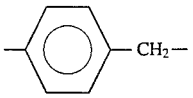 | $-H/-CH_3$ | $-COOC_6H_5$ | 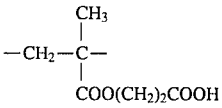 | 65/35 |
| 122 | A-122 | $-COO(CH_2)_2OCO(CH_2)_2-$ $-COO(CH_2)_2-$ | $-CH_3/-CH_3$ | $-COOC_2H_5$ | 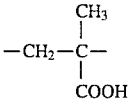 | 80/20 |
| 123 | A-123 | $-COOCH_2CH_2-$ | $-CH_3/-H$ | $-C_6H_5$ | 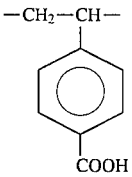 | 50/50 |
| 124 | A-124 | $-COOCH_2CH(OH)CH_2OOC-$ | $-CH_3/-CH_3$ | $-COOC_2H_5$ | 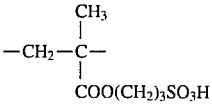 | 90/10 |
| 125 | A-125 | 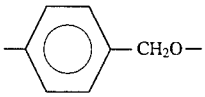 | $-H/-CH_3$ | $-COOC_3H_7$ | 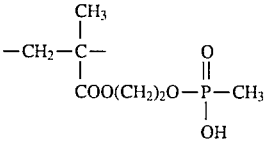 | 80/20 |
| 126 | A-126 | $\vert$ $COO(CH_2)_2N(C_2H_5)-C(=S)-S-$ | $-CH_3/-CH_3$ | $-COOC_2H_5$ | 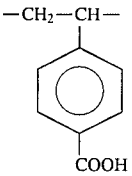 | 65/35 |
| 127 | A-127 | " | $-CH_3/-H$ | $-COOC_6H_5$ | 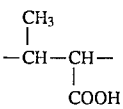 | 70/30 |
| 128 | A-128 | $\vert$ $COO(CH_2)_2NHCOO-(CH_2)_2-$ | $-CH_3/-CH_3$ | " | 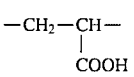 | 75/25 |

TABLE 6-continued
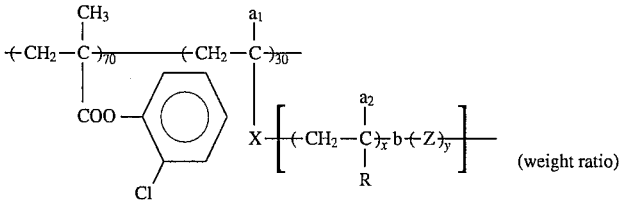
| Synthesis Example of Resin (A) | Resin (A) | −X− | $a_1/a_2$ | −R | −Z− | x/y |
|---|---|---|---|---|---|---|
| 129 | A-129 | $-COOCH_2CH_2-$ | $-CH_3/-H$ | $-C_6H_5$ | 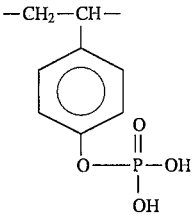 | 90/10 |
| 130 | A-130 | $\vert$ $CONHCOOCH_2CH_2-$ | $-CH_3/-CH_3$ | $-COOCH_2C_6H_5$ | 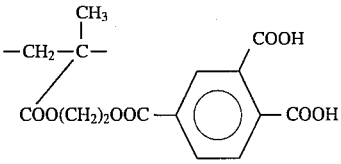 | 70/30 |
| 131 | A-131 | 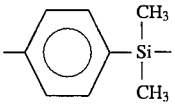 | $-H/-CH_3$ | $-COOC_4H_9$ | 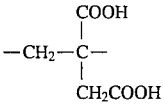 | 80/20 |
| 132 | A-132 | $-COO-$ | $-CH_3/-CH_3$ | $-COOCH_3$ |  | 70/30 |
| 133 | A-133 | $-COO(CH_2)_4OOC-$ | $-CH_3/-CH_3$ | 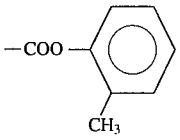 | 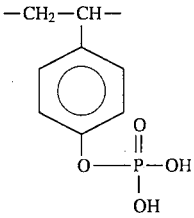 | 75/25 |
| 134 | A-134 | 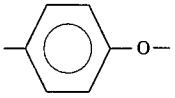 | $-H/-H$ | $-C_6H_5$ | 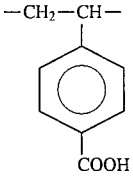 | 70/30 |
| 135 | A-135 | $\vert$ $CONHC(=S)-S-$ | $-H/-CH_3$ | $-COOCH_2C_6H_5$ | 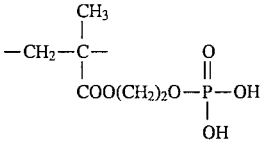 | 85/15 |

Synthesis examples of the resin (B) are specifically illustrated below.

SYNTHESIS EXAMPLE 1 OF RESIN (B): Resin (B-1)

A mixed solution of 100 g of methyl methacrylate and 200 g of tetrahydrofuran was sufficiently degassed under nitrogen gas stream and cooled to −20° C. Then, 0.8 g of 1,1-diphenylbutyl lithium was added to the mixture, and the reaction was conducted for 12 hours. Furthermore, a mixed solution of 60 g of methyl acrylate, 6 g of triphenylmethyl methacrylate and 5 g of tetrahydrofuran was sufficiently degassed under nitrogen gas stream, and, after adding the mixed solution to the above described mixture, the reaction was further conducted for 8 hours. The reaction mixture was adjusted to 0° C. and after adding thereto 10 ml of methanol, the reaction was conducted for 30 minutes and the polymerization was terminated.

The temperature of the polymer solution obtained was adjusted to a temperature of 30° C. under stirring and, after adding thereto 3 ml of an ethanol solution of 30% hydrogen chloride, the resulting mixture was stirred for one hour. Then, the solvent of the reaction mixture was distilled off under reduced pressure until the whole volume was reduced to a half, and then the mixture was reprecipitated from one liter of petroleum ether.

The precipitates formed were collected and dried under reduced pressure to obtain 72 g of the polymer having an Mw of $7.3\times10^4$.

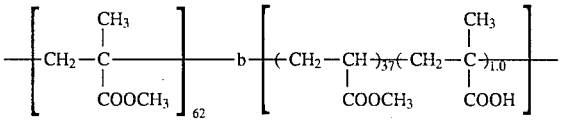

(weight ratio)

Resin (B-1)

b: A bond connecting blocks (hereinafter the same)

SYNTHESIS EXAMPLE 2 OF RESIN (B): Resin (B-2)

A mixed solution of 70 g of methyl methacrylate, 30 g of methyl acrylate, 0.5 g of (tetraphenyl prophynato) aluminum methyl, and 60 g of methylene chloride was raised to a temperature of 30° C. under nitrogen gas stream. The mixture was irradiated with light from a xenon lamp of 300 W at a distance of 25 cm through a glass filter, and the reaction was conducted for 12 hours. To the mixture were further added 60 g of methyl acrylate and 3.2 g of benzyl methacrylate, after light-irradiating in the same manner as above for 8 hours, 3 g of methanol was added to the reaction mixture followed by stirring for 30 minutes, and the reaction was terminated. Then, Pd—C was added to the reaction mixture, and a catalytic reduction reaction was conducted for one hour at a temperature of 25° C.

After removing insoluble substances from the reaction mixture by filtration, the reaction mixture was reprecipitated from 500 ml of petroleum ether and the precipitates formed were collected and dried to obtain 118 g of the resin having an Mw of $8\times10^4$.

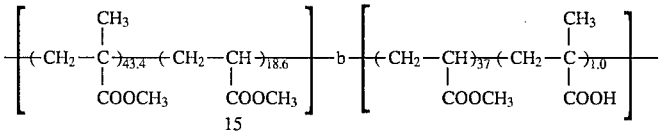

Resin (B-2)

SYNTHESIS EXAMPLE 3 OF RESIN (B): Resin (B-3)

A mixed solution of 100 g of ethyl methacrylate and 200 g of toluene was sufficiently degassed under nitrogen gas stream and cooled to 0° C. Then, 2.5 g of 1,1-diphenyl-3-methylpentyl lithium was added to the mixture followed by stirring for 6 hours. Further, 60 g of methyl methacrylate and 11.7 g of 4-vinylbenzenecarboxylic acid triisopropylsilyl ester were added to the mixture and, after stirring the mixture for 6 hours, 3 g of methanol was added to the mixture followed by stirring for 30 minutes.

Then, to the reaction mixture was added 10 g of an ethanol solution of 30% hydrogen chloride and, after stirring the mixture at 25° C. for one hour, the mixture was reprecipitated from one liter of methanol. The precipitates thus formed were collected, washed twice with 300 ml of methanol and dried to obtain 121 g of the polymer having an Mw of $6.5\times10^4$.

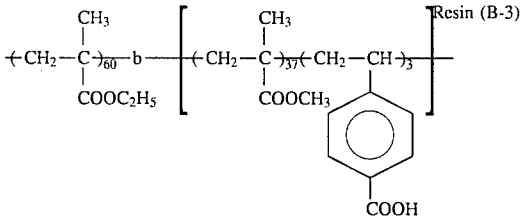

Resin (B-3)

SYNTHESIS EXAMPLE 4 OF RESIN (B): Resin (B-4)

A mixture of 67 g of methyl methacrylate and 4.8 g of benzyl N,N-diethyldithiocarbamate was placed in a vessel under nitrogen gas stream followed by closing the vessel and heated to a temperature of 50° C. The mixture was irradiated with light from a high-pressure mercury lamp of 400 W at a distance of 10 cm through a glass filter for 6 hours to conduct photopolymerization.

Then, 32 g of methyl acrylate, 1 g of acrylic acid and 180 g of methyl ethyl ketone were added to the mixture and, after replacing the gas in the vessel with nitrogen, the mixture was light-irradiated again for 10 hours. The reaction mixture was reprecipitated from one liter of methanol and the precipitates formed were collected and dried to obtain 73 g of the polymer having an Mw of $4.8\times10^4$.

Resin (B-4)

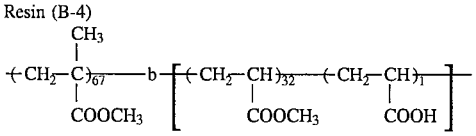

SYNTHESIS EXAMPLE 5 OF RESIN (B): Resin (B-5)

A mixture of 50 g of methyl methacrylate, 25 g of ethyl methacrylate and 1.0 g of benzyl isopropylxanthate was placed in a vessel under nitrogen gas stream followed by closing the vessel and heated to a temperature of 50° C. The mixture was irradiated with light from a high-pressure mercury lamp of 400 W at a distance of 10 cm through a glass filter for 6 hours to conduct photopolymerization. The polymerization product was dissolved in tetrahydrofuran to make a 40% solution, then 22 g of methyl acrylate was added thereto and, after replacing the gas in the vessel with nitrogen, the mixture was light-irradiated again for 10 hours.

Then, 3 g of 2-(2'-carboxyethyl)carbonyloxyethyl methacrylate was added to the mixture and, after replacing the gas in the vessel with nitrogen, the mixture was light-irradiated again for 8 hours. The reaction mixture was reprecipitated from 2 liters of methanol and the powder collected was dried to obtain 63 g of a polymer having an Mw of $6\times10^4$.

Resin (B-5)

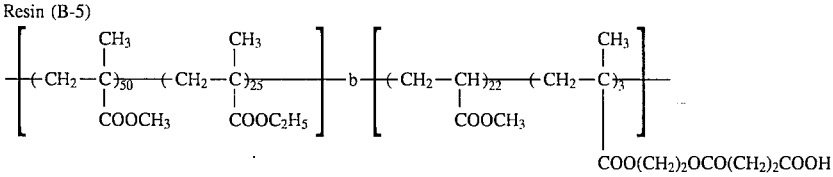

SYNTHESIS EXAMPLE 6 OF RESIN (B): Resin (B-6)

A mixed solution of 97 g of ethyl acrylate, 3 g of methacrylic acid, 2 g of 2-mercaptoethanol and 200 g of tetrahydrofuran was heated to a temperature of 60° C. under nitrogen gas stream with stirring, and 1.0 g of 2,2'-azobisisovaleronitrile (abbreviated as AIVN) was added thereto to effect a reaction for 4 hours. To the reaction mixture was further added 0.5 g of AIVN, followed by reacting for 4 hours. The temperature of the reaction mixture was adjusted to a temperature of 20° C., then a mixed solution of 8.6 g of 4,4'-azobis(cyanovaleric acid), 12 g of dicyclohexylcarbodiimide, 0.2 g of 4-(N,N-dimethylamino)pyridine and 30 g of tetrahydrofuran was added dropwise thereto over a period of one hour. After further stirring for 2 hours, 5 g of a 85% aqueous formic acid solution was added thereto, followed by stirring for 30 minutes. The crystals thus-deposited were removed by filtration, the filtrate was distilled under reduced pressure at a temperature of 25° C. to remove the solvent. The polymer thus-obtained (polymer initiator) shown below had an Mw of $6.3\times10^3$.

Polymer Initiator

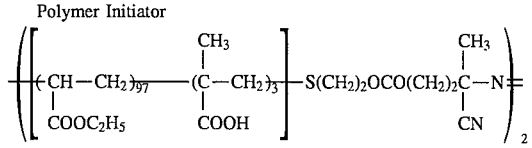

A mixed solution of 70 g of methyl methacrylate and 170 g of toluene was heated to a temperature of 70° C. under nitrogen gas stream with stirring. A solution prepared by dissolving 30 g of the above described polymer initiator in 30 g of toluene and replacing the gas in the vessel with nitrogen was added to the above mixed solution, followed by reacting for 8 hours. The polymer formed was reprecipitated from 2 liters of methanol and the powder collected was dried to obtain 72 g of the polymer having an Mw of $4\times10^4$.

Resin (B-6)

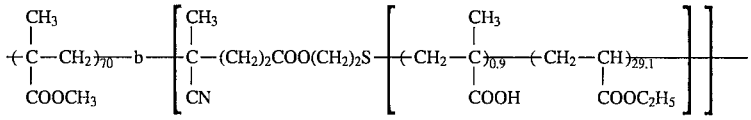

SYNTHESIS EXAMPLES 7 TO 16 OF RESIN (B): Resins (B-7) to (B-16)

Each of the resins (B) shown in Table 7 below was synthesized in the same reaction procedure as described in Synthesis Example 3 of Resin (B). The Mw of each of the resins obtained was in the range of from $5\times10^4$ to $9\times10^4$.

TABLE 7

$$\left(\left(CH_2-\underset{\underset{COOR^{32}}{|}}{\overset{\overset{CH_3}{|}}{C}}\right)_p\left(X_1\right)_q\right)-b-\left(\left(CH_2-\underset{\underset{COOR^{33}}{|}}{CH}\right)_r\left(Y_2\right)_y\left(Z_3\right)_z\right)$$

| Synthesis Examples of Resin (B) | Resin (B) | $R^{32}$ | $-X_1-$ | $R^{33}$ | $-Y_2-$ | $-Z_3-$ | p/g/r/y/z (weight ratio) |
|---|---|---|---|---|---|---|---|
| 7 | B-7 | $-CH_3$ | — | $-CH_3$ | — | $-CH_2-\underset{\underset{COO(CH_2)_2COOH}{\mid}}{CH}-$ | 65/0/32/0/3 |
| 8 | B-8 | $-CH_3$ | — | $-C_2H_5$ | — | 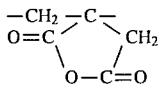 | 72/0/25/0/3 |
| 9 | B-9 | $-CH_3$ | $-CH_2-\underset{\underset{COOCH_3}{\mid}}{CH}-$ | $-CH_3$ | 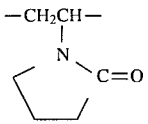 | $-CH_2-\overset{\overset{CH_3}{\mid}}{\underset{\underset{COOH}{\mid}}{C}}-$ | 66/10/20/3/1 |
| 10 | B-10 | $-C_2H_5$ | $-CH_2-\underset{\underset{COOCH_2C_6H_5}{\mid}}{CH}-$ | $-CH_3$ | — | $-CH_2-\underset{\underset{COO(CH_2)_3SO_3H}{\mid}}{CH}-$ | 74.2/10/15/0/0.8 |
| 11 | B-11 | $-C_3H_7$ | 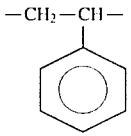 | $-CH_3$ | $-CH_2\underset{\underset{COOCH_2CH_2OCH_3}{\mid}}{CH}-$ | $-CH_2-\overset{\overset{COOH}{\mid}}{\underset{\underset{CH_2COOH}{\mid}}{C}}-$ | 61/10/20/8/1.0 |
| 12 | B-12 | $-CH_3$ | $-CH_2-\underset{\underset{COOC_2H_5}{\mid}}{CH}-$ | $-CH_3$ | $-CH_2-\underset{\underset{COCH_3}{\mid}}{CH}-$ | $-CH_2\overset{\overset{CH_3}{\mid}}{\underset{\underset{COO(CH_2)_2O-\overset{\overset{O}{\mid\mid}}{\underset{\underset{OH}{\mid}}{P}}-OH}{\mid}}{C}}-$ | 59/10/20/10/1.0 |

TABLE 7-continued
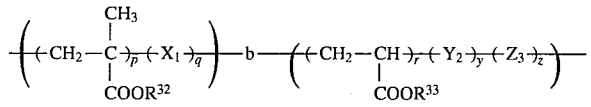
| Synthesis Examples of Resin (B) | Resin (B) | $R^{32}$ | $-X_1-$ | $R^{33}$ | $-Y_2-$ | $-Z_3-$ | p/g/r/y/z (weight ratio) |
|---|---|---|---|---|---|---|---|
| 13 | B-13 | $-CH_3$ | — | $-C_2H_5$ | — | 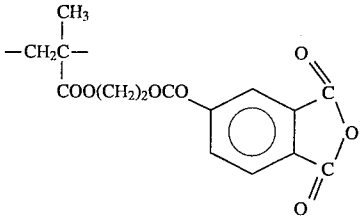 | 81/0/15/0/4 |
| 14 | B-14 | $-C_6H_5$ | 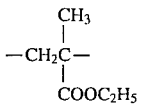 | $-CH_3$ | 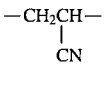 | 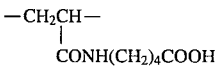 | 30/20/45/3/2 |
| 15 | B-15 | $-CH_2C_6H_5$ | — | $-CH_3$ | 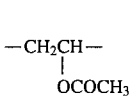 | 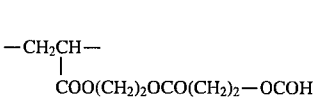 | 75/0/15/6.5/3.5 |
| 16 | B-16 | $-CH_3$ | — | $-C_2H_5$ | 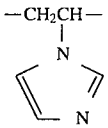 | 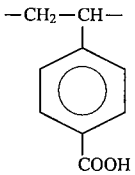 | 80/0/14/4/2 |

SYNTHESIS EXAMPLES 17 TO 23 OF RESIN (B): Resins (B-17) to (B-23)

Each of the resins (B) shown in Table 8 below was synthesized in the same reaction procedure as described in Synthesis Example 4 of Resin (B). The Mw of each of the resins obtained was in a range of from $4\times10^4$ to $8\times10^4$.

for 400 W at a distance of 10 cm through a glass filter for 8 hours to conduct photopolymerization. The reaction mixture obtained was reprecipitated from 500 ml of petroleum ether, and the precipitates formed were collected and dried to obtain 41 g of a polymer having an Mw of $1.0\times10^4$.

TABLE 8

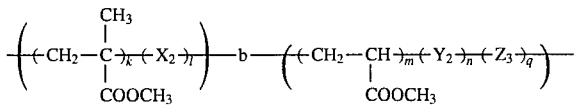

| Synthesis Example of Resin (B) | Resin (B) | $-X_2-$ | $-Y_2-$ | $-Z_3-$ | k/l/m/n/q (weight ratio) |
|---|---|---|---|---|---|
| 17 | B-17 | $-CH_2-CH(COOC_2H_5)-$ | $-CH_2-CH(OCH_3)-$ | $-CH_2-CH(COOH)-$ | 64/15/15/4.8/1.2 |
| 18 | B-18 | — | $-CH_2-CH(OC_2H_5)-$ | $-CH_2-C(CH_3)(COOH)-$ | 70/0/20/9/1.0 |
| 19 | B-19 | — | — | $-CH_2-C(CH_3)(COO(CH_2)_2OP(=O)(OH)-OH)-$ | 67/0/31.5/0/1.5 |
| 20 | B-20 | — | $-CH_2-CH(COO(CH_2)_2)-$ 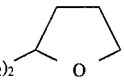 | $-CH_2-CH(COOH)-$ | 65/0/28/6/1.0 |
| 21 | B-21 | $-CH_2-C(CH_3)(COOC_2H_5)-$ | $-CH_2-CH(CH_3)(COO(CH_2)_2)-$ 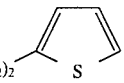 | $-CH_2-CH(COO(CH_2)_2COOH)-$ | 53.4/10/30/5/1.6 |
| 22 | B-22 | $-CH_2-CH(CN)-$ | $-CH_2-CH(COOC_2H_5)-$ | $-CH(CH_3)-CH(COOH)-$ | 64/5/20/10/1.0 |
| 23 | B-23 | — | $-CH_2-CH(N)-$ 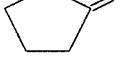 | $-CH_2-CH(CONH-C_6H_4-P(=O)(OH)-OH)-$ | 70/0/25/3/2.0 |

SYNTHESIS EXAMPLE 101 OF RESIN (B): Resin (B-101)

A mixture of 47.5 g of methyl acrylate, 2.5 g of acrylic acid, 7.6 g of 2-carboxyethyl N,N-diethyldithiocarbamate (Initiator I-101) and 50 g of tetrahydrofuran was placed in a vessel under nitrogen gas stream followed by closing the vessel and heated to a temperature of 50° C. The mixture was irradiated with light from a high-pressure mercury lamp A mixture of 10 g of the above described polymer (polymer initiator), 65 g of methyl methacrylate, 25 g of methyl acrylate and 100 g of tetrahydrofuran was heated to a temperature of 50° C. under nitrogen gas stream and irradiated with light under the same condition as above for 10 hours to conduct photopolymerization. The reaction mixture was reprecipitated from one liter of methanol and the precipitates thus formed were collected and dried to obtain 85 g of a block polymer having an Mw of $8.5\times10^4$.

Resin (B-101)

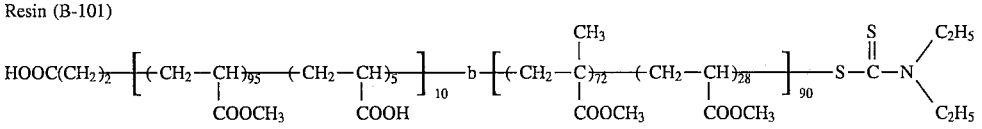

SYNTHESIS EXAMPLE 102 OF RESIN (B): Resin (B-102)

A mixed solution of 67 g of methyl methacrylate, 33 g of methyl acrylate, 2.2 g of benzyl N-ethyl-N-(2-carboxyethyl)dithiocarbamate (Initiator I-102) and 100 g of tetrahydrofuran was heated to a temperature of 50° C. under nitrogen gas stream and irradiated with light under the same condition as described in Synthesis Example 101 for 8 hours to conduct photopolymerization. The reaction mixture was reprecipitated from one liter of methanol and the precipitates formed were collected and dried to obtain 85 g of a polymer having an Mw of $8\times10^4$.

A mixture of 85 g of the above described polymer, 14 g of methyl methacrylate, 1 g of methacrylic acid and 150 g of tetrahydrofuran was heated to a temperature of 50° C. under nitrogen gas stream and irradiated to light under the same condition as described in Synthesis Example 101 for 16 fours to conduct photopolymerization. The reaction mixture was reprecipitated from one liter of methanol, and the precipitates formed were collected and dried to obtain 83 g of a block polymer having an Mw of $9.5\times10^4$.

SYNTHESIS EXAMPLES 104 TO 113 OF RESIN (B): Resins (B-104) to (B-113)

Each of the resins (B) shown in Table 9 below was synthesized in the same reaction procedure as described in Synthesis Example 102 of Resin (B). The Mw of each of the resins obtained was in a range of from $7\times10^4$ to $9\times10^4$.

Resin (B-102)

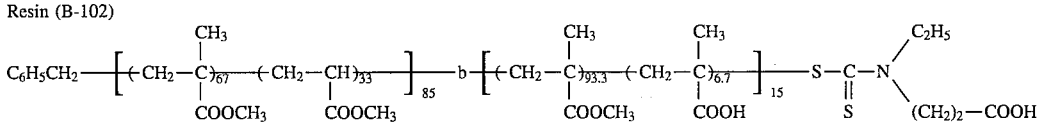

SYNTHESIS EXAMPLE 103 OF RESIN (B): Resin (B-103)

A mixed solution of 80 g of ethyl methacrylate and 200 g of toluene was sufficiently degassed under nitrogen gas stream and cooled to −20° C. Then, 2.0 g of 1,1-diphenyl-3-methylpentyl lithium was added to the mixture followed by stirring for 12 hours. To the mixture were further added 19 g of methyl methacrylate and 1.5 g of 4-vinylphenylcarbonyloxytrimethylsilane, and the mixture was subjected to a reaction for 12 hours. Then, the mixture was reacted for 2 hours under carbon dioxide gas stream, followed by reacting at 0° C. for 2 hours. To the reaction mixture was added dropwise one liter of a methanol solution containing 10 g of 30% hydrochloric acid with stirring over a period of 30 minutes, followed by stirring for one hour. The powder thus deposited was collected by filtration, washed with methanol and dried to obtain 75 g of a block polymer having an Mw of $6.5\times10^4$.

Resin (B-103)

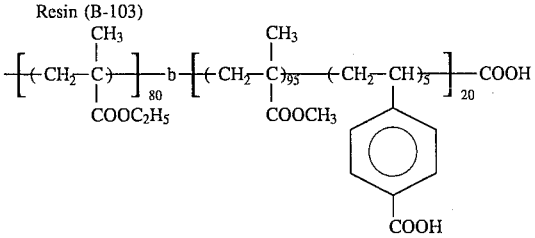

TABLE 9
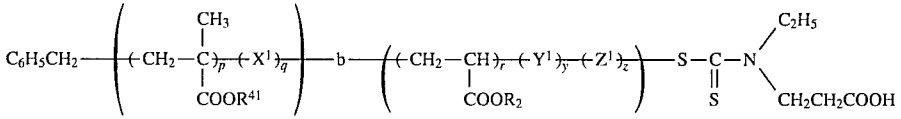
| Synthesis Examples of Resin (B) | Resin (B) | $R^{41}$ | $-X^1-$ | $R_2$ | $-Y^1-$ | $-Z^1-$ | p/q/r/y/z (weight ratio) |
|---|---|---|---|---|---|---|---|
| 104 | B-104 | $-CH_3$ | — | $-CH_3$ | — | $-CH_2-CH(COO(CH_2)_2COOH)-$ | 65/0/32/0/3 |
| 105 | B-105 | $-CH_3$ | — | $-C_2H_5$ | — | 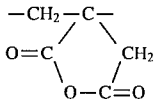 | 72/0/25/0/3 |
| 106 | B-106 | $-CH_3$ | $-CH_2-CH(COOCH_3)-$ | $-CH_3$ | 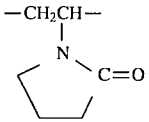 | $-CH_2-C(CH_3)(COOH)-$ | 66/10/20/3/1 |
| 107 | B-107 | $-C_2H_5$ | $-CH_2-CH(COOCH_2C_6H_5)-$ | $-CH_3$ | — | $-CH_2-CH(COO(CH_2)_3SO_3H)-$ | 74.2/10/15/0/0.8 |
| 108 | B-108 | $-C_3H_7$ | 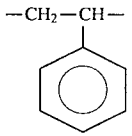 | $-CH_3$ | $-CH_2-CH(COOCH_2CH_2OCH_3)-$ | $-CH_2-C(COOH)(CH_2COOH)-$ | 61/10/20/8/1.0 |
| 109 | B-109 | $-CH_3$ | $-CH_2-CH(COOCH_3)-$ | $-CH_3$ | $-CH_2-CH(COCH_3)-$ | $-CH_2-C(CH_3)(COO(CH_2)_2O-P(=O)(OH)-OH)-$ | 59/10/20/10/1.0 |

TABLE 9-continued
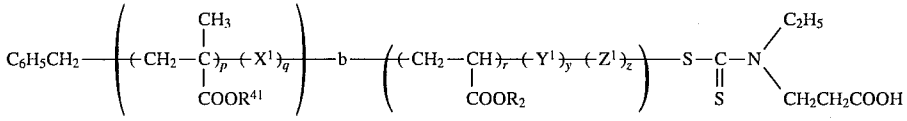
| Synthesis Examples of Resin (B) | Resin (B) | $R^{41}$ | $-X^1-$ | $R_2$ | $-Y^1-$ | $-Z^1-$ | p/q/r/y/z (weight ratio) |
|---|---|---|---|---|---|---|---|
| 110 | B-110 | $-CH_3$ | — | $-C_2H_5$ | — | 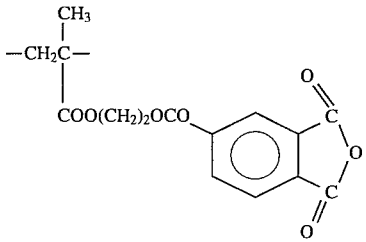 | 81/0/15/0/4 |
| 111 | B-111 | $-C_6H_5$ | 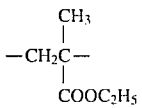 | $-CH_3$ | 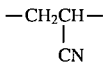 | 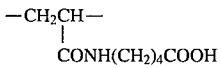 | 30/20/45/3/2 |
| 112 | B-112 | $-CH_2C_6H_5$ | — | $-CH_3$ | 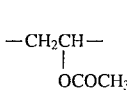 | 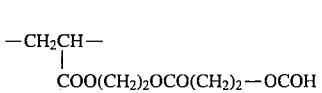 | 75/0/15/6.5/3.5 |
| 113 | B-113 | $-CH_3$ | — | $-C_2H_5$ | 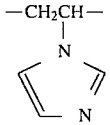 | 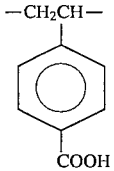 | 80/0/14/4/2 |

SYNTHESIS EXAMPLES 114 TO 120 OF RESIN (B): Resins (B-114) to (B-120)

Each of the block polymers shown in Table 10 below was synthesized in the same manner as described in Synthesis Example 101 except for using $4.2\times10^{-3}$ moles of each of the initiators shown in Table 10 below in place of 7.6 g of Initiator (I-101) used in Synthesis Example 101. The Mw of each of the resins was in a range of from $8\times10^{4}$ to $10\times10^{4}$.

TABLE 10

| Synthesis Example of Resin (B) | Resin (B) | Initiator | |
|---|---|---|---|
| 114 | B-114 | I-103 | 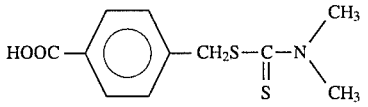 |
| 115 | B-115 | I-104 | 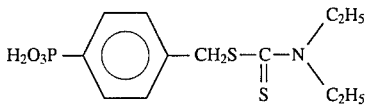 |
| 116 | B-116 | I-105 | 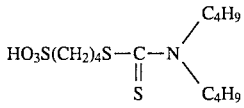 |
| 117 | B-117 | I-106 | 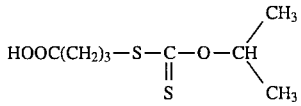 |
| 118 | B-118 | I-107 | 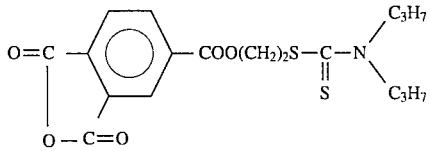 |
| 119 | B-119 | I-108 | 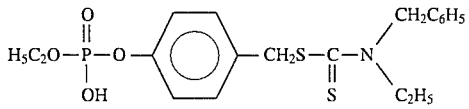 |
| 120 | B-120 | I-109 | 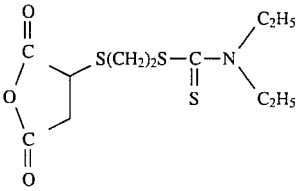 |

SYNTHESIS EXAMPLES 121 TO 130 OF RESIN (B): Resins (B-121) to (B-130)

Each of the resins (B) shown in Table 11 below was synthesized by a photopolymerization reaction in the same manner as described in Synthesis Example 102. The Mw of each of the resins was in a range of from $6\times10^{4}$ to $8\times10^{4}$.

TABLE 11
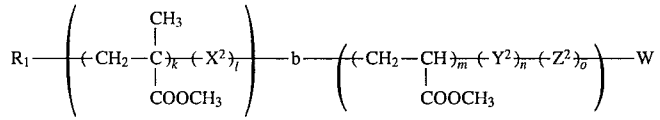
| Synthesis Example of Resin (B) | Resin (B) | $R_1$ | —W— | —$X^2$— | —$Y^2$— | —$Z^2$— | k/l/m/n/o (weight ratio) |
|---|---|---|---|---|---|---|---|
| 121 | B-121 | $C_4H_9$— | 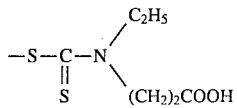 | —$CH_2$—CH(—$COOC_2H_5$)— | —$CH_2$—CH(—$OCH_3$)— | —$CH_2$—CH(—COOH)— | 64/15/15/4.8/1.2 |
| 122 | B-122 | $C_4H_9$— | 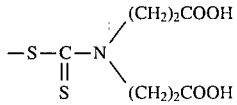 | — | —$CH_2$—C($CH_3$)(—$COO(CH_2)_2NHCOOCH_3$)— | —$CH_2$—C($CH_3$)(—COOH)— | 70/0/20/9/1.0 |
| 123 | B-123 | $C_6H_5CH_2$— | —S—C(=S)—$O(CH_2)_3COOH$ | —$CH_2$—CH(—$COOCH_3$)— | — | —$CH_2$—C($CH_3$)(—$COO(CH_3)OP(=O)(OH)OH$)— | 47/20/32/0/1.0 |
| 124 | B-124 | $C_6H_5CH_2$— | 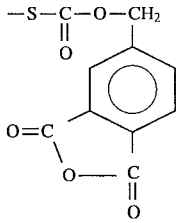 | —$CH_2$—CH(—$COOC_2H_5$)— | —$CH_2$—C($CH_3$)(—$COOCH_3$)— | —$CH_2$—C($CH_3$)(—$COO(CH_2)_2OCO(CH_2)_2COOH$)— | 48.5/10/10/30/1.5 |

TABLE 11-continued

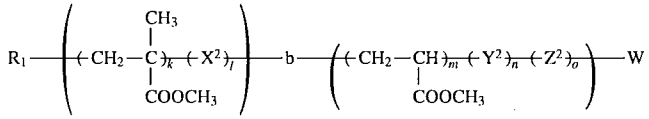

| Synthesis Example of Resin (B) | Resin (B) | $R_1$ | —W— | $-X^2-$ | $-Y^2-$ | $-Z^2-$ | k/l/m/n/o (weight ratio) |
|---|---|---|---|---|---|---|---|
| 125 | B-125 | $C_6H_{13}-$ | $-S-C(=S)-O(CH_2)_3SO_3H$ | $-CH_2-CH(COOCH_3)-$ | $-CH_2-C(CH_3)(COOCH_2C_6H_5)-$ | $-CH_2-CH(CONHCH_2COC(CH_3)(CH_3)-SO_3H)-$ | 59/10.2/10/20/0.8 |
| 126 | B-126 | $C_6H_5CH_2-$ | $-S-C(=S)-N(C_3H_7)(CH_2)_2COOH$ | — | $-CH_2-C(CH_3)(COO(CH_2)_2OCH_3)-$ | $-CH_2-CH(COOH)-$ | 80/0/16.3/2.5/1.2 |
| 127 | B-127 | $C_6H_{13}-$ | $-S-C(=S)-N(H)(CH_2)_2O-P(=O)(OH)-OH$ | — | $-CH_2-CH(COO(CH_2)_2$ 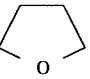 | $-CH_2-CH(COOH)-$ | 80/0/16/3/1.0 |
| 128 | B-128 | $C_6H_5CH_2-$ | $-S-C(=S)-O-C(CH_2)_4COOH$ | $-CH_2-C(CH_3)(COOC_2H_5)-$ | $-CH_2-C(CH_3)(COO(CH_2)_2$ 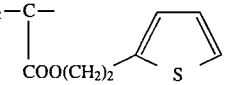 | $-CH_2-CH(COO(CH_2)_2COOH)-$ | 40/45/11/2.5/1.5 |
| 129 | B-129 | $C_3H_7-$ | $-S-C(=S)-N(C_2H_5)(CH_2)_2COOH$ | $-CH_2-CH(CN)-$ | $-CH_2-CH(COOC_2H_5)-$ | $-CH(CH_3)-CH(COOH)-$ | 64/5/20/10/1.0 |

TABLE 11-continued
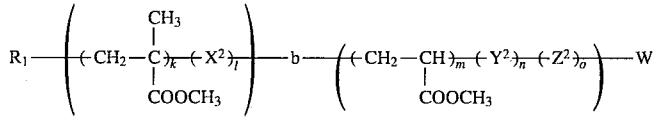
| Synthesis Example of Resin (B) | Resin (B) | $R_1$ | —W— | —$X^2$— | —$Y^2$— | —$Z^2$— | k/l/m/n/o (weight ratio) |
|---|---|---|---|---|---|---|---|
| 130 | B-130 | $C_8H_{17}$— | 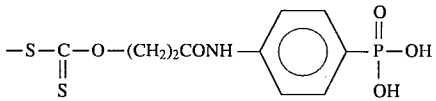 | —$CH_2$—CH— (COOCH$_3$) | —$CH_2$CH— (N, O) | —$CH_2$—CH— (CONH) 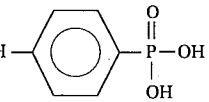 | 50/25/21/2.5/1.5 |

SYNTHESIS EXAMPLE 201 OF RESIN (B): Resin (B-201)

A mixed solution of 90 g of methyl acrylate, 10 g of acrylic acid and 13.4 g of Initiator (I-201) shown below was heated to a temperature of 40° C. under nitrogen gas stream.

Initiator (I-201)

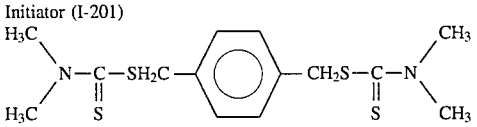

The solution was irradiated with light from a high-pressure mercury lamp of 400 W at a distance of 10 cm through a glass filter for 10 hours to conduct photopolymerization. The reaction mixture obtained was reprecipitated in one liter of methanol, and the precipitates formed were collected and dried to obtain 78 g of the polymer having a weight average molecular weight (Mw) of $2\times10^4$.

A mixed solution of 10 g of the above described polymer, 65 g of methyl methacrylate, 25 g of methyl acrylate and 100 g of tetrahydrofuran was heated to a temperature of 50° C. under nitrogen gas stream and irradiated with light under the same condition as above for 15 hours. The reaction mixture was reprecipitated from 1.5 liters of methanol, and the precipitates thus formed were collected and dried to obtain 75 g of the polymer having an Mw of $8\times10^4$.

SYNTHESIS EXAMPLE 203 OF RESIN (B): Resin (B-203)

A mixed solution of 80 g of methyl methacrylate, 20 g of ethyl acrylate, 13.5 g of Initiator (I-203) shown below and 150 g of tetrahydrofuran was heated at a temperature of 50° C. under nitrogen gas stream. The mixture was irradiated with light under the same condition as described in Synthesis Example 201 for 10 hours.

Initiator (I-203)

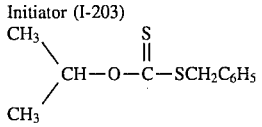

The reaction mixture obtained was reprecipitated from one liter of methanol, and the precipitates thus formed were collected and dried to obtain the polymer.

A mixed solution of 60 g of the above described polymer, 30 g of methyl acrylate, 10 g of methacrylic acid and 100 g of tetrahydrofuran was heated to a temperature of 50° C. under nitrogen gas stream and subjected to light irradiation in the same manner as above for 10 hours. The reaction mixture obtained was reprecipitated from one liter of methanol and the precipitates formed were collected and dried to obtain 73 g of the polymer as powder. A mixed solution of 60 g of the polymer thus obtained, 30 g of ethyl methacrylate, 10 g of methyl acrylate and 100 g of tetrahydrofuran was heated to a temperature of 50° C. under nitrogen gas stream and subjected to light irradiation in the same manner as above for 10 hours. The reaction mixture obtained was reprecipitated from 1.5 liters of methanol and the precipitates formed were collected and dried to obtain 76 g of the polymer having an Mw of $9\times10^4$.

Resin (B-201)

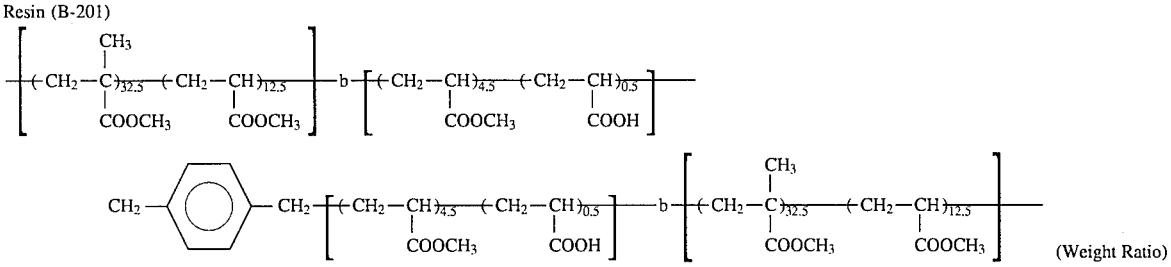

(Weight Ratio)

SYNTHESIS EXAMPLE 202 OF RESIN (B): Resin (B-202)

A reaction procedure was conducted under the same condition as Synthesis Example 201 of Resin (B) except using 14.8 g of Initiator (I-202) shown below in place of 13.4 g of Initiator (I-201) used in Synthesis Example 201 to obtain 73 g of a polymer having an Mw of $5\times10^4$.

Initiator (I-202)

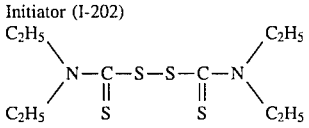

Resin (B-202)

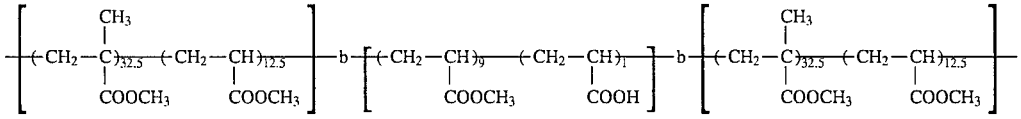

Resin (B-203)

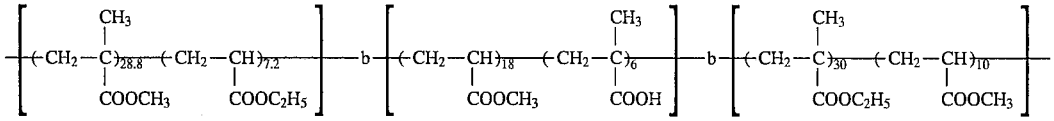

SYNTHESIS EXAMPLE 204 OF RESIN (B): Resin (B-204)

A mixed solution of 50 g of methyl methacrylate and 100 g of tetrahydrofuran was sufficiently degassed under nitrogen gas stream and cooled to −20° C. Then, 1.2 g of 1,1-diphenylpentyl lithium was added to the mixture, and the reaction was conducted for 12 hours. Separately, a mixed solution of 30 g of methyl acrylate, 3 g of triphenylmethyl methacrylate and 50 g of tetrahydrofuran was sufficiently degassed under nitrogen gas stream, and the resulting mixed solution was added to the above described mixture, and then reaction was further conducted for 8 hours. Separately, a mixed solution of 50 g of methyl methacrylate and 50 g of tetrahydrofuran was sufficiently degassed under nitrogen gas stream, and the resulting mixed solution was added to the above described mixture, and then reaction was further conducted for 10 hours. The temperature of the reaction mixture was adjusted to 0° C., 10 ml of methanol was added thereto, followed by reacting for 30 minutes, and the polymerization reaction was terminated. The temperature of the polymer solution obtained was adjusted to a temperature of 30° C. with stirring, 3 ml of an ethanol solution of 30% hydrogen chloride was added thereto, and the mixture was stirred for one hour. Then, the solvent of the reaction mixture was distilled off under reduced pressure until the whole volume was reduced to a half, and the mixture was reprecipitated from one liter of methanol. The precipitates thus formed were collected and dried under reduced pressure to obtain 65 g of the polymer having an Mw of $8.5\times10^4$.

Resin (B-205)

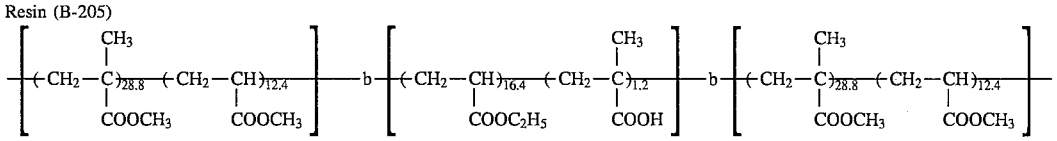

Resin (B-204)

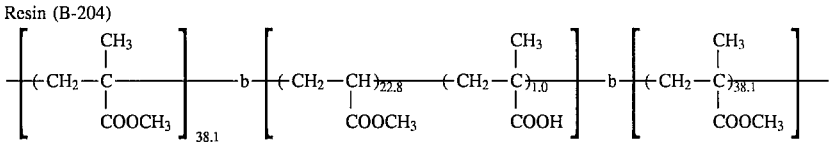

SYNTHESIS EXAMPLE 205 OF RESIN (B): Resin (B-205)

A mixed solution of 70 g of methyl methacrylate, 30 g of methyl acrylate, 0.5 g of (tetraphenyl porphinato) aluminum methyl and 200 g of methylene chloride was raised to a temperature of 30° C. under nitrogen gas stream. The mixture was irradiated with light from a xenon lamp of 300 W at a distance of 25 cm through a glass filter, and the reaction was conducted for 12 hours. To the mixture were further added 40 g of ethyl acrylate and 6.4 g of benzyl methacrylate, followed by reacting for 10 hours with light irradiation in the same manner as above. Further, 70 g methyl methacrylate and 30 g of methyl acrylate were added to the mixture, followed by reacting for 12 hours with light irradiation in the same manner as above. Then, 3 g of methanol was added to the reaction mixture, followed by stirring for 30 minutes, and the reaction was terminated. Then, Pd—C was added to the reaction mixture, and a catalytic reduction reaction was conducted for one hour at a temperature of 25° C. After removing the insoluble substances from the reaction mixture by filtration, the reaction mixture was reprecipitated from 2 liters of methanol, and the precipitates thus formed were collected by filtration and dried to obtain 180 g of the polymer having an Mw of $8.5\times10^4$.

SYNTHESIS EXAMPLES 206 TO 215 OF RESIN (B): Resins (B-206) to (B-215)

Each of the resins (B) shown in Table 12 below was synthesized in the same reaction procedure as described in Synthesis Example 202 of Resin (B). The Mw of each of the polymers obtained was in a range of from $5\times10^4$ to $7\times10^4$.

TABLE 12
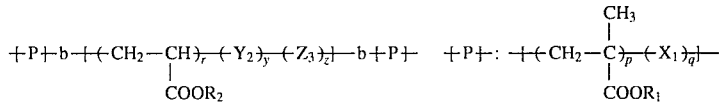
| Synthesis Examples of Resin (B) | Resin (B) | $R_1$ | $-X_1-$ | $R_2$ | $-Y_2-$ | p/q/r/y/z $-Z_3-$ | (weight ratio) |
|---|---|---|---|---|---|---|---|
| 206 | B-206 | $-CH_3$ | — | $-CH_3$ | — | $-CH_2-CH(COO(CH_2)_2COOH)-$ | 32.5/0/32/0/3 |
| 207 | B-207 | $-CH_3$ | — | $-C_2H_5$ | — | 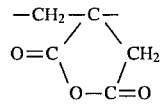 | 36/0/12.5/0/3 |
| 208 | B-208 | $-CH_3$ | $-CH_2-CH(COOCH_3)-$ | $-CH_3$ | 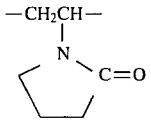 | $-CH_2-C(CH_3)(COOH)-$ | 33/5/20/3/1 |
| 209 | B-209 | $-C_2H_5$ | $-CH_2-CH(COOCH_2C_6H_5)-$ | $-CH_3$ | — | $-CH_2-CH(COO(CH_2)_3SO_3H)-$ | 37.1/5/15/0/0.8 |
| 210 | B-210 | $-C_3H_7$ | 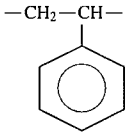 | $-CH_3$ | $-CH_2CH(COOCH_2CH_2OCH_3)-$ | $-CH_2-C(COOH)(CH_2COOH)-$ | 30.5/5/20/8/1.0 |
| 211 | B-211 | $-CH_3$ | $-CH_2-CH(COOCH_2C_6H_5)-$ | $-CH_3$ | $-CH_2CH(COCH_3)-$ | $-CH_2C(CH_3)(COO(CH_2)_2O-P(=O)(OH)-OH)-$ | 30/5/19/10/1.0 |

TABLE 12-continued
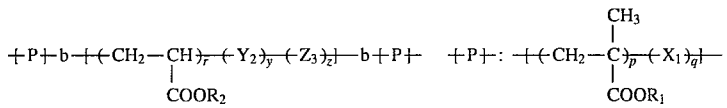
| Synthesis Examples of Resin (B) | Resin (B) | $R_1$ | $-X_1-$ | $R_2$ | $-Y_2-$ | p/q/r/y/z $-Z_3-$ | (weight ratio) |
|---|---|---|---|---|---|---|---|
| 212 | B-212 | $-CH_3$ | $-CH_2-C(CH_3)(COOCH_2C_6H_5)-$ | $-C_2H_5$ | — | $-CH_2C(CH_3)(COO(CH_2)_2OCO\text{-}C_6H_3(C(=O)O)C(=O))-$ | 40.5/0/15/0/4 |
| 213 | B-213 | $-C_6H_5$ | $-CH_2C(CH_3)(COOC_2H_5)-$ | $-CH_3$ | $-CH_2CH(CN)-$ | $-CH_2CH(CONH(CH_2)_4COOH)-$ | 15/10/45/3/2 |
| 214 | B-214 | $-CH_2C_6H_5$ | — | $-CH_3$ | $-CH_2CH(OCOCH_3)-$ | $-CH_2CH(COO(CH_2)_2OCO(CH_2)_2-COOH)-$ | 37.5/0/15/6.5/3.5 |
| 215 | B-215 | $-C_6H_5$ | $-CH_2-CH(COOC_6H_5)-$ | $-C_2H_5$ | $-CH_2CH(N{=}CH{-}CH{=}N)-$ | $-CH_2CH(C_6H_4COOH)-$ | 40/0/14/4/2 |

SYNTHESIS EXAMPLES 216 TO 219 OF RESIN (B): Resins (B-216) to (B-219)

Each of the polymers shown in Table 13 below was synthesized in the same procedure as described in Synthesis Example 201 of Resin (B) except for using $5\times10^{-2}$ moles of each of the initiators shown in Table 13 below in place of 13.4 g of Initiator (I-201) used in Synthesis Examples 201 of Resin (B). The Mw of each of the polymers was in a range of from $7\times10^{4}$ to $8.5\times10^{4}$.

TABLE 13

| Synthesis Examples of Resin (B) | Resin (B) | Initiator | |
|---|---|---|---|
| 216 | B-216 | 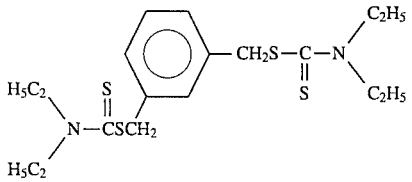 | I-204 |
| 217 | B-217 | 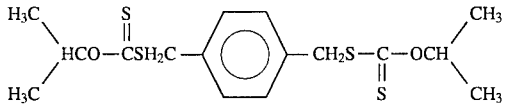 | I-205 |
| 218 | B-218 | 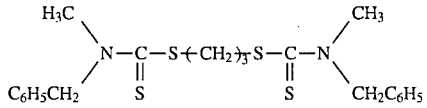 | I-206 |
| 219 | B-219 | 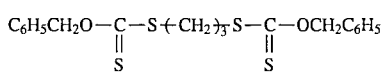 | I-207 |

SYNTHESIS EXAMPLES 220 TO 226 OF RESIN (B): Resins (B-220) to (B-226)

A mixed solution of 90 g of benzyl methacrylate, 10 g of acrylic acid and 7.8 g of Initiator (I-208) having the following structure was heated to a temperature of 40° C. under nitrogen gas stream. The mixture was reacted under the same condition of light irradiation as described in Synthesis Example 201 of Resin (B) for 5 hours. The polymer obtained was dissolved in 200 g of tetrahydrofuran, reprecipitated from 1.0 liter of methanol, and the precipitates formed were collected by filtration and dried.

Initiator (I-208)

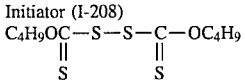

A mixed solution of 20 g of the polymer thus obtained, a monomer corresponding to each of the polymer components shown in Table 14 below and 100 g of tetrahydrofuran was reacted with light irradiation in the same manner as above for 15 hours. The polymer obtained was reprecipitated from 1.5 liters of methanol and the precipitates formed were collected by filtration and dried. The yield of each polymer was in a range of from 60 to 70 g and the Mw thereof was in a range of from $4\times10^{4}$ to $7\times10^{4}$.

TABLE 14

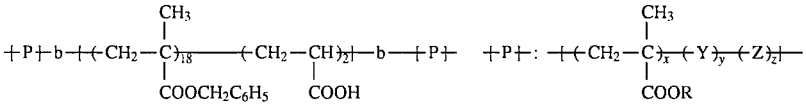

| Synthesis Example of Resin (B) | Resin (B) | −R | −Y− | −Z− | x/y/z (weight ratio) |
|---|---|---|---|---|---|
| 220 | B-220 | $-CH_3$ | — | — | 40/0/0 |
| 221 | B-221 | $-C_2H_5$ | $-CH_2-CH(CN)-$ | — | 38/2/0 |
| 222 | B-222 | $-CH_3$ | $-CH_2-CH(COOCH_3)-$ | $-CH_2-CH(CN)-$ | 27/12/1 |

TABLE 14-continued

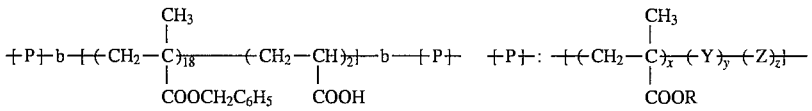

| Synthesis Example of Resin (B) | Resin (B) | −R | −Y− | −Z− | x/y/z (weight ratio) |
|---|---|---|---|---|---|
| 223 | B-223 | $-CH_3$ | $-CH_2-CH-$ (COO(CH₂)₂OCH₃) | — | 37/3/0 |
| 224 | B-224 | $-CH_2C_6H_5$ | $-CH_2-CH-$ (N, O) | — | 38.5/1.5/0 |
| 225 | B-225 | $-C_2H_5$ | — | — | 40/0/0 |
| 226 | B-226 | $-C_2H_5$ | $-CH_2-CH-$ | $-CH_2-CH-$ (CON, O) | 30/7.5/2.5 |

EXAMPLE I-1

A mixture of 6 g (solid basis) of Resin (A-2), 34 g (solid basis) of Resin (B-1), 200 g of photo-conductive zinc oxide, 0.018 g of Methine Dye (I-1) having the following structure, 0.45 g of phthalic anhydride and 300 g of toluene was dispersed by a homogenizer (manufactured by Nippon Seiki K.K.) at a rotation of $6\times10^3$ r.p.m. for 10 minutes to prepare a coating composition for a light-sensitive layer. The coating composition was coated on paper, which had been subjected to electrically conductive treatment, by a wire bar at a dry coverage of 22 g/m$^2$, followed by drying at 110° C. for 10 seconds. The coated material was then allowed to stand in a dark place at 20° C. and 65% RH for 24 hours to prepare an electrophotographic light-sensitive material (hereinafter, simply referred to as a light-sensitive material, sometimes).

Methine Dye (I-1)

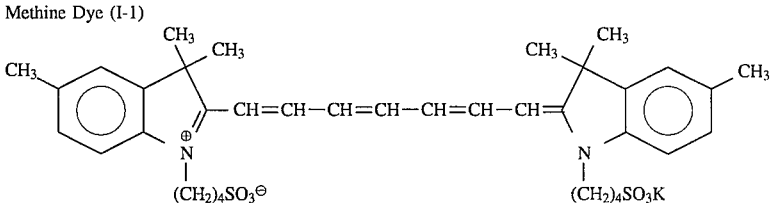

Comparative Example I-1

An electrophotographic light-sensitive material was prepared in the same manner as in Example I-1, except for using 34 g of Resin (R-I-1) having the following structure in place of 34 g of Resin (B-1) used in Example I-1.

Comparative Resin (R-I-1)

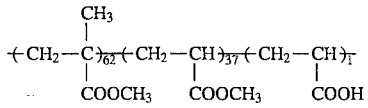

Mw: $7\times10^4$ (random copolymer)

Comparative Example I-2

An electrophotographic light-sensitive material was prepared in the same manner as in Example I-1, except for using 34 g of Resin (R-I-2) having the following structure in place of 34 g of Resin (B-1) used in Example I-1.

Comparative Resin (R-I-2)

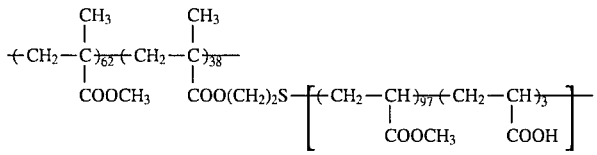

Mw: $7.5 \times 10^4$ (graft copolymer)

With each of the light-sensitive material thus prepared, electrostatic characteristics and image forming performance were evaluated. The results obtained are shown in Table I-1 below.

TABLE I-1

| | Example I-1 | Comparative Example I-1 | Comparative Example I-2 |
|---|---|---|---|
| Electrostatic Characteristics*1) | | | |
| $V_{10}$ (−V) | | | |
| I (20° C., 65% RH) | 680 | 685 | 680 |
| II (30° C., 80% RH) | 665 | 660 | 660 |
| D.R.R. (90 sec value) (%) | | | |
| I (20° C., 65% RH) | 88 | 83 | 85 |
| II (30° C., 80% RH) | 84 | 79 | 81 |
| $E_{1/10}$ (erg/cm$^2$) | | | |
| I (20° C., 65% RH) | 17 | 25 | 20 |
| II (30° C., 80% RH) | 19 | 30 | 27 |
| $E_{1/100}$ (erg/cm$^2$) | | | |
| I (20° C., 65% RH) | 26 | 40 | 31 |
| II (30° C., 80% RH) | 30 | 47 | 43 |
| Image Forming Performance*2) | | | |
| I (20° C., 65% RH) | Very good | Scratches of fine lines and letters, unevenness in half tone area | Scratches of fine lines and letters, unevenness in half tone area |
| II (30° C., 80% RH) | Very good | Scratches of fine lines and letters, unevenness in half tone area | Scratches of fine lines and letters, unevenness in half tone area |

The evaluation of each item shown in Table I-1 was conducted in the following manner.

*1) Electrostatic Characteristics

The light-sensitive material was charged with a corona discharge to a voltage of −6 kV for 20 seconds in a dark room using a paper analyzer ("Paper Analyzer SP-428" manufactured by Kawaguchi Denki K.K.). Ten seconds after the corona discharge, the surface potential $V_{10}$ was measured. The sample was then allowed to stand in the dark for an additional 90 seconds, and the potential $V_{100}$ was measured. The dark charge retention rate (DRR; %), i.e., percent retention of potential after dark decay for 90 seconds, was calculated from the following equation:

$$DRR\ (\%)=(V_{100}/V_{10})\times 100$$

Separately, the surface of photoconductive layer was charged to −400 V with a corona discharge and then exposed to light emitted from a gallium-aluminum-arsenic semiconductor laser (oscillation wavelength: 780 nm), and the time required for decay of the surface potential $V_{10}$ to one-tenth was measured, and the exposure amount $E_{1/10}$ (erg/cm$^2$) was calculated therefrom. Further, in the same manner as described above the time required for decay of the surface potential $V_{10}$ to one-hundredth was measured, and the exposure amount $E_{1/100}$ (erg/cm$^2$) was calculated therefrom. The measurements were conducted under ambient condition of 20° C. and 65% RH (I) or 30° C. and 80% RH (II).

*2) Image Forming Performance

After the light-sensitive material was allowed to stand for one day under the ambient condition shown below, the light-sensitive material was charged to −6 kV and exposed to light emitted from a gallium-aluminum-arsenic semiconductor laser (oscillation wavelength: 780 nm; output: 2.8 mW) at an exposure amount of 64 erg/cm$^2$ (on the surface of the photoconductive layer) at a pitch of 25 μm and a scanning speed of 300 m/sec. The thus formed electrostatic latent image was developed with a liquid developer ELP-T (produced by Fuji Photo Film Co., Ltd.), washed with a rinse solution of iso-paraffinic solvent Isopar G (manufactured by Esso Chemical K.K.) and fixed. The duplicated image obtained was visually evaluated for fog and image quality. The ambient condition at the time of image formation was 20° C. and 65% RH (I) or 30° C. and 80% RH (II).

As shown in Table I-1, the light-sensitive material according to the present invention had good electrostatic characteristics, and the duplicated image obtained thereon was clear and free from background fog. On the contrary, with the light-sensitive materials of Comparative Examples I-1 and I-2 the decrease in photosensitivity ($E_{1/10+cc}$ and $E_{+c,fra\ 1/100}$) occurred, and in the duplicated images the scratches of fine lines and letters were observed and a background fog remained without removing after the rinse treatment. Further, the occurrence of unevenness in half tone areas of continuous gradation of the original was observed regardless of the electrostatic characteristics.

The value of $E_{1/100}$ is largely different between the light-sensitive material of the present invention and those of the comparative examples. The value of $E_{1/100}$ indicates an electrical potential remaining in the non-image areas after exposure at the practice of image formation. The smaller the value, the less the background fog in the non-image areas. More specifically, it is requested that the remaining potential is decreased to −10 V or less. Therefore, an amount of exposure necessary to make the remaining potential below −10 V is an important factor. In the scanning exposure system using a semiconductor laser beam, it is quite important to make the remaining potential below −10 V by a small exposure amount in view of a design for an optical system of a duplicator (such as cost of the device, and accuracy of the optical system).

From all these considerations, it is thus clear that an electrophotographic light-sensitive material satisfying both requirements of electrostatic characteristics and image forming performance and being advantageously employed particularly in a scanning exposure system using a semiconductor laser beam can be obtained only using the binder resin according to the present invention.

EXAMPLE I-2

A mixture of 5 g (solid basis) of Resin (A-10), 35 g (solid basis) of Resin (B-2), 200 g of photoconductive zinc oxide, 0.020 g of Methine Dye (I-II) having the following structure, 0.20 g of N-hydroxymalinimide and 300 g of toluene was treated in the same manner as described in Example I-1 to prepare an electrophotographic light-sensitive material.

Methine Dye (I-II)

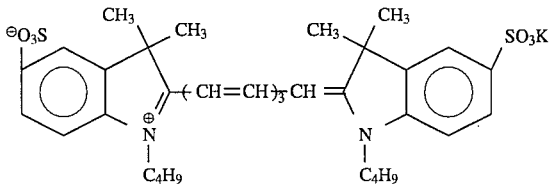

With the light-sensitive material thus-prepared, a film property in terms of surface smoothness, electrostatic characteristics and image forming performance were evaluated. Further, printing property was evaluated when it was used as an electrophotographic lithographic printing plate precursor. The results obtained are shown in Table I-2 below.

TABLE I-2

| | | Example I-2 |
|---|---|---|
| Smoothness of Photoconductive Layer*3) (sec/cc) | | 650 |
| Electrostatic Characteristics | | |
| $V_{10}$ (−V) | I (20° C., 65% RH) | 680 |
| | II (30° C., 80% RH) | 665 |
| D.R.R. | I (20° C., 65% RH) | 88 |
| (90 sec value) (%) | II (30° C., 80% RH) | 85 |
| $E_{1/10}$ (erg/cm$^2$) | I (20° C., 65% RH) | 15 |
| | II (30° C., 80% RH) | 17 |
| $E_{1/100}$ (erg/cm$^2$) | I (20° C., 65% RH) | 24 |
| | II (30° C., 80% RH) | 28 |
| Image Forming | I (20° C., 65% RH) | Very good |
| Performance | II (30° C., 80% RH) | Very good |
| Contact Angle with Water*4) (°) | | 10 or less |
| Printing Durability*5) | | 10,000 |

The evaluation of each item shown in Table I-2 was conducted in the following manner.

*3) Smoothness of Photoconductive Layer

The smoothness (sec/cc) of the light-sensitive material was measured using a Beck's smoothness test machine (manufactured by Kumagaya Riko K.K.) under an air volume condition of 1 cc.

*4) Contact Angle with Water

The light-sensitive material was passed once through an etching processor using a solution prepared by diluting an oil-desensitizing solution ELP-EX (produced by Fuji Photo Film Co., Ltd.) to a two-fold volume with distilled water to conduct oil-desensitization treatment on the surface of the photoconductive layer. On the thus oil-desensitized surface was placed a drop of 2 μl of distilled water, and the contact angle formed between the surface and water was measured using a goniometer.

*5) Printing Durability

The light-sensitive material was subjected to plate making in the same manner as described in *2) above to form toner images, and the surface of the photoconductive layer was subjected to oil-desensitization treatment under the same condition as in *4) above. The resulting lithographic printing plate was mounted on an offset printing machine ("Oliver Model 52", manufactured by Sakurai Seisakusho K.K.), and printing was carried out on paper. The number of prints obtained until background stains in the non-image areas appeared or the quality of the image areas was deteriorated was taken as the printing durability. The larger the number of the prints, the higher the printing durability.

As shown in Table I-2, the light-sensitive material according to the present invention had good electrostatic characteristics of the photoconductive layer, and the duplicated image obtained was clear and free from background fog in the non-image area. Also, surface smoothness and film strength of the photoconductive layer were good. These results appear to be due to sufficient adsorption of the binder resin onto the photoconductive substance and sufficient covering of the surface of the particles with the binder resin. For the same reason, when it was used as an offset master plate precursor, oil-desensitization of the offset master plate precursor with an oil-desensitizing solution was sufficient to render the non-image areas satisfactorily hydrophilic, as shown by a small contact angle of 10° or less with water. On practical printing using the resulting master plate, 10,000 prints of clear image without background stains were obtained.

From these results it is believed that the resin (A) and the resin (B) according to the present invention suitably interacts with zinc oxide particles to form the condition under which an oil-desensitizing reaction proceeds easily and sufficiently with an oil-desensitizing solution and that the remarkable improvement in film strength is achieved by the action of the resin (B).

EXAMPLES I-3 TO I-18

Each electrophotographic light-sensitive material was prepared in the same manner as described in Example I-2, except for using each of Resins (A) and Resins (B) shown in Table I-3 below in place of Resin (A-10) and Resin (B-2) used in Example I-2, respectively. The electrostatic characteristics of the resulting light-sensitive materials were evaluated in the same manner as described in Example I-2. The results obtained are shown in Table I-3 below.

TABLE I-3

| Example | Resin (A) | Resin (B) | $V_{10}$ (−V) | D.R.R. (%) | $E_{1/10}$ (erg/cm$^2$) | $E_{1/100}$ (erg/cm$^2$) |
|---|---|---|---|---|---|---|
| I-3 | A-1 | B-1 | 585 | 77 | 30 | 47 |
| I-4 | A-2 | B-3 | 640 | 83 | 20 | 32 |
| I-5 | A-4 | B-4 | 595 | 80 | 30 | 44 |
| I-6 | A-7 | B-5 | 585 | 80 | 22 | 41 |
| I-7 | A-9 | B-7 | 660 | 83 | 19 | 30 |
| I-8 | A-10 | B-8 | 600 | 80 | 21 | 39 |
| I-9 | A-11 | B-9 | 610 | 81 | 21 | 37 |
| I-10 | A-14 | B-10 | 590 | 79 | 23 | 45 |
| I-11 | A-19 | B-11 | 575 | 78 | 25 | 48 |
| I-12 | A-20 | B-13 | 645 | 82 | 20 | 32 |
| I-13 | A-22 | B-15 | 650 | 83 | 19 | 29 |
| I-14 | A-23 | B-16 | 660 | 83 | 19 | 27 |
| I-15 | A-25 | B-18 | 600 | 78 | 24 | 38 |
| I-16 | A-27 | B-21 | 580 | 78 | 25 | 41 |
| I-17 | A-28 | B-22 | 580 | 77 | 27 | 47 |
| I-18 | A-29 | B-17 | 665 | 83 | 19 | 30 |

The electrostatic characteristics were evaluated under condition of 30° C. and 80% RH.

As a result of the evaluation on image forming performance of each light-sensitive material, it was found that clear duplicated images having good reproducibility of fine lines and letters and no occurrence of unevenness in half tone areas without the formation of background fog were obtained.

Further, when these electrophotographic light-sensitive materials were employed as offset master plate precursors under the same printing condition as described in Example I-2, more than 10,000 good prints were obtained respectively.

It can be seen from the results described above that each of the light-sensitive materials according to the present invention was satisfactory in all aspects of the surface smoothness and film strength of the photo-conductive layer, electrostatic characteristics and printing property. Also, it can be seen that the electrostatic characteristics are further improved by the use of the resin (A').

EXAMPLES I-19 TO I-22

Each electrophotographic light-sensitive material was prepared in the same manner as described in Example I-1, except for using each of the dyes shown in Table I-4 below in place of Methine Dye (I-1) used in Example I-1.

EXAMPLES I-23 AND I-24

A mixture of 6.5 g of Resin (A-1) (Example I-23) or Resin (A-2) (Example I-24), 33.5 g of Resin (B-8), 200 g of photoconductive zinc oxide, 0.02 g of uranine, 0.03 g of Methine Dye (I-VII) having the following structure, 0.03 g of Methine Dye (I-VIII) having the following structure, 0.18 g of p-hydroxybenzoic acid and 300 g of toluene was dispersed by a homogenizer at a rotation of $7\times10^3$ r.p.m. for 10 minutes to prepare a coating composition for a light-sensitive layer. The coating composition was coated on paper, which had been subjected to electrically conductive treatment, by a wire bar at a dry coverage of 20 g/m$^2$, and dried for 20 seconds at 110° C. Then, the coated material was allowed to stand in a dark place for 24 hours under the conditions of 20° C. and 65% RH to prepare each electrophotographic light-sensitive material.

TABLE I-4

| Example | Dye | Chemical Structure of Dye |
|---|---|---|
| I-19 | (I-III) | 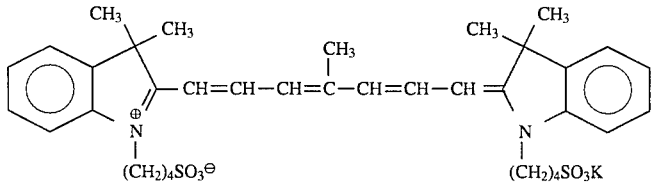 |
| I-20 | (I-IV) | 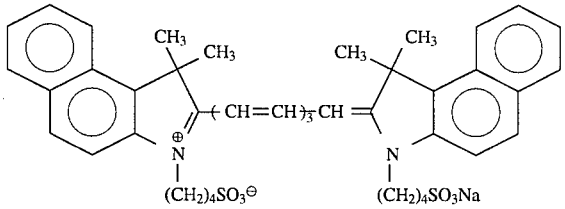 |
| I-21 | (I-V) | 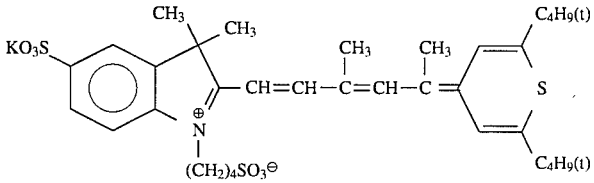 |
| I-22 | (I-VI) | 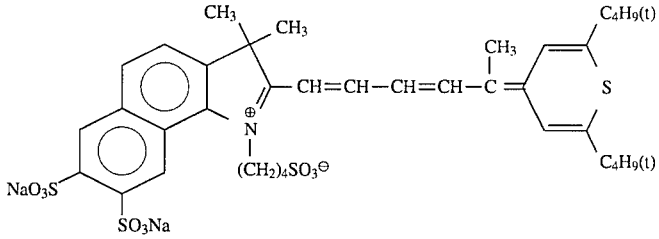 |

Each of the light-sensitive materials according to the present invention was excellent in charging properties, dark charge retention rate and photosensitivity, and provided clear duplicated images free from background fog even when processed under severe condition of high temperature and high humidity (30° C. and 80% RH).

Methine Dye (I-VII)

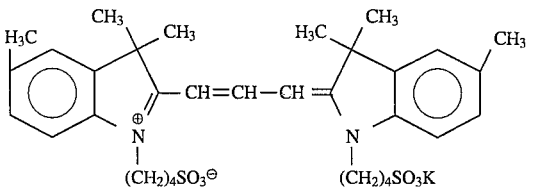

Methine Dye (I-VIII)

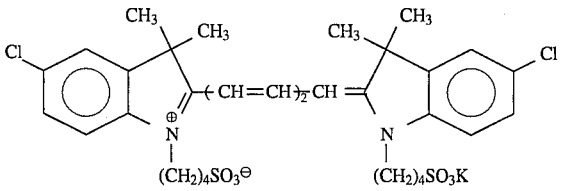

Comparative Example I-3

An electrophotographic light-sensitive material was prepared in the same manner as in Example I-23, except for using 33.5 g of Resin (R-I-3) having the following structure in place of 33.5 g of Resin (B-8) used in Example I-23.

Comparative Resin (R-I-3)

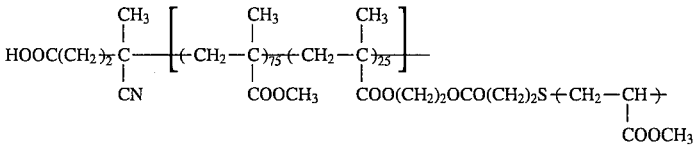

Mw: $7.5 \times 10^4$

With each of the light-sensitive materials thus prepared, various characteristics were evaluated in the same manner as in Example I-2. The results obtained are shown in Table I-5 below.

TABLE I-5

| | | Example I-23 | Example I-24 | Comparative Example I-3 |
|---|---|---|---|---|
| Binder Resin | | (A-1)/(B-8) | (A-2)/(B-8) | (A-1)/(R-I-3) |
| Smoothness of Photoconductive Layer (sec/cc) | | 500 | 550 | 485 |
| Electrostatic Characteristics*6) | | | | |
| $V_{10}$ (−V) | I (20° C., 65% RH) | 590 | 650 | 590 |
| | II (30° C., 80% RH) | 575 | 640 | 570 |
| D.R.R. (%) | I (20° C., 65% RH) | 93 | 96 | 89 |
| | II (30° C., 80% RH) | 90 | 93 | 85 |
| $E_{1/10}$ (lux · sec) | I (20° C., 65% RH) | 10.3 | 8.5 | 13.0 |
| | II (30° C., 80% RH) | 10.9 | 9.3 | 14.0 |
| $E_{1/100}$ (lux · sec) | I (20° C., 65% RH) | 16.0 | 13.0 | 22 |
| | II (30° C., 80% RH) | 17.5 | 14.5 | 24 |
| Image Forming*7) Performance | I (20° C., 65% RH) | Good | Very good | Edge mark of cutting |
| | II (30° C., 80% RH) | Good | Very good | Edge mark of cutting, unevenness in half tone area |
| Contact Angle with Water (°) | | 10 or less | 10 or less | 10 or less |
| Printing Durability | | 10,000 Prints | 10,000 Prints | Background stain due to edge mark of cutting occurred from the start of printing |

The characteristics were evaluated in the same manner as in Example I-2, except that some electrostatic characteristics and image forming performance were evaluated according to the following test methods.

*6) Electrostatic Characteristics: $E_{1/10+cc}$ and $E_{+c,fra\ 1/10}$

The surface of the photoconductive layer was charged to −400 V with corona discharge, and then irradiated by visible light of the illuminance of 2.0 lux. Then, the time required for decay of the surface potential ($V_{10}$) to 1/10 or 1/100 thereof was determined, and the exposure amount $E_{1/10}$ or $E_{1/100}$ (lux·sec) was calculated therefrom.

*7) Image Forming Performance

The electrophotographic light-sensitive material was allowed to stand for one day under the ambient condition described below, the light-sensitive material was subjected to plate making by a full-automatic plate making machine ELP-404V (manufactured by Fuji Photo Film Co., Ltd.) using ELP-T as a toner. The duplicated image thus obtained was visually evaluated for fog and image quality. The ambient condition at the time of image formation was 20° C. and 65% RH (I) or 30° C. and 80% RH (II). The original used for the duplication was composed of cuttings of other originals pasted up thereon.

From the results shown above, it can be seen that each light-sensitive material exhibited almost the same properties with respect to the surface smoothness of the photoconductive layer. However, on the electrostatic characteristics, the light-sensitive material of Comparative Example I-3 had the particularly large value of photosensitivity $E_{1/100}$, and this tendency increased under the high temperature and high humidity condition. On the contrary, the electrostatic characteristics of the light-sensitive material according to the present invention were good. Further, those of Example I-24 using the resin (A) having the specified substituent were very good. The value of $E_{1/100}$ thereof was particularly small.

With respect to image forming performance, the edge mark of cuttings pasted up was observed as back-ground fog in the non-image areas in the light-sensitive material of Comparative Example I-3. On the contrary, the light-sensitive materials according to the present invention provided clear duplicated images free from background fog.

Further, each of these light-sensitive materials was subjected to the oil-desensitizing treatment to prepare an offset printing plate and using the resulting plate printing was conducted. The plates according to the present invention provided 10,000 prints of clear image without background stains. However, with the plate of Comparative Example I-3, the above described edge mark of cuttings pasted up was not removed with the oil-desensitizing treatment and the background stains occurred from the start of printing.

It can be seen from the results described above that only the light-sensitive materials according to the present invention could provide excellent performance.

EXAMPLE I-25

A mixture of 5 g of Resin (A-22), 35 g of Resin (B-11), 200 g of photoconductive zinc oxide, 0.02 g of uranine, 0.04 g of Rose Bengal, 0.03 g of bromophenol blue, 0.40 g of phthalic anhydride and 300 g of toluene was treated in the same manner as described in Example I-23 to prepare an electrophotographic light-sensitive material.

As the result of the evaluation of various characteristics in the same manner as described in Example I-23, it can be seen that the light-sensitive material according to the present invention is excellent in charging properties, dark charge retention rate and photosensitivity, and provides a clear duplicated image free from background fog under severe conditions of high temperature and high humidity (30° C. and 80% RH). Further, when the material was employed as an offset master plate precursor, 10,000 prints of clear image were obtained.

EXAMPLES I-26 TO I-37

Each electrophotographic light-sensitive material was prepared in the same manner as described in Example I-25, except for using 5 g of each of Resin (A) and 35 g of each of Resin (B) shown in Table I-6 below in place of 5 g of Resin (A-22) and 35 g of Resin (B-11) used in Example I-25, respectively.

TABLE I-6

| Example | Resin (A) | Resin (B) |
|---|---|---|
| I-26 | A-1 | B-10 |
| I-27 | A-3 | B-2 |
| I-28 | A-4 | B-3 |
| I-29 | A-5 | B-4 |
| I-30 | A-6 | B-5 |
| I-31 | A-15 | B-14 |
| I-32 | A-18 | B-17 |
| I-33 | A-21 | B-19 |
| I-34 | A-24 | B-20 |

TABLE I-6-continued

| Example | Resin (A) | Resin (B) |
|---|---|---|
| I-35 | A-25 | B-21 |
| I-36 | A-26 | B-22 |
| I-37 | A-28 | B-12 |

Each of the light-sensitive materials according to the present invention was excellent in charging properties, dark charge retention rate and photosensitivity, and provided a clear duplicated image free from background fog even under severe condition of high temperature and high humidity (30° C. and 80% RH). Further, when these materials were employed as offset master plate precursors, more than 10,000 prints of a clear image free from background stains were obtained respectively. Moreover, the light-sensitive materials containing the resin (A) having a methacrylate component substituted with the specified aryl group provided better performance.

EXAMPLE II-1

A mixture of 6 g (solid basis) of Resin (A-102), 34 g (solid basis) of Resin (B-1), 200 g of photo-conductive zinc oxide, 0.018 g of Methine Dye (II-1) having the following structure, 0.10 g of phthalic anhydride and 300 g of toluene was dispersed by a homogenizer (manufactured by Nippon Seiki K.K.) at a rotation of $6\times10^3$ r.p.m. for 10 minutes to prepare a coating composition for a light-sensitive layer. The coating composition was coated on paper, which had been subjected to electrically conductive treatment, by a wire bar at a dry coverage of 22 g/m$^2$, followed by drying at 110° C. for 10 seconds. The coated material was then allowed to stand in a dark place at 20° C. and 65% RH for 24 hours to prepare an electrophotographic light-sensitive material.

Methine Dye (II-1)

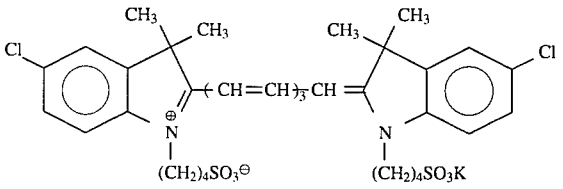

Comparative Example II-1

An electrophotographic light-sensitive material was prepared in the same manner as in Example II-1, except for using 34 g of Resin (R-II-1) having the following structure in place of 34 g of Resin (B-1) used in Example II-1.

Comparative Resin (R-II-1)

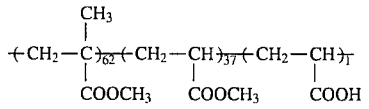

Mw: $7\times10^4$ (random copolymer)

Comparative Example II-2

An electrophotographic light-sensitive material was prepared in the same manner as in Example II-1, except for using 34 g of Resin (R-II-2) having the following structure in place of 34 g of Resin (B-1) used in Example II-1.

Comparative Resin (R-II-2)

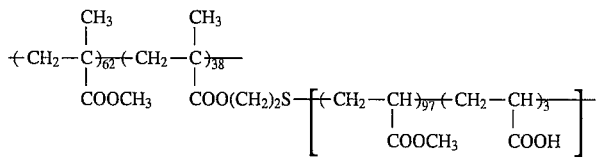

Mw: $7.5 \times 10^4$ (graft copolymer)

With each of the light-sensitive material thus prepared, electrostatic characteristics and image forming performance were evaluated. The results obtained are shown in Table II-1 below.

TABLE II-1

| | Example II-1 | Comparative Example II-1 | Comparative Example II-2 |
|---|---|---|---|
| Electrostatic*1) Characteristics $V_{10}$ (−V) | | | |
| I (20° C., 65% RH) | 680 | 650 | 665 |
| II (30° C., 80% RH) | 660 | 625 | 645 |
| III (15° C., 30% RH) | 700 | 670 | 685 |
| D.R.R. (90 sec value) (%) | | | |
| I (20° C., 65% RH) | 88 | 85 | 87 |
| II (30° C., 80% RH) | 85 | 81 | 85 |
| III (15° C., 30% RH) | 88 | 86 | 86 |
| $E_{1/10}$ (erg/cm$^2$) | | | |
| I (20° C., 65% RH) | 15.8 | 25 | 22 |
| II (30° C., 80% RH) | 15.0 | 23 | 20 |
| III (15° C., 30% RH) | 19 | 28 | 26 |
| Image Forming*2) Performance | | | |
| I (20° C., 65% RH) | Very good | Good | Good |
| II (30° C., 80% RH) | Good | Unevenness in half tone area, slight background fog | Unevenness in half tone area, slight background fog |
| III (15° C., 30% RH) | Good | White spots in image portion | White spots in image portion |

The evaluation of each item shown in Table II-1 was conducted in the following manner.

*1) Electrostatic Characteristics

The light-sensitive material was charged with a corona discharge to a voltage of −6 kV for 20 seconds in a dark room using a paper analyzer ("Paper Analyzer SP- 428" manufactured by Kawaguchi Denki K.K.). Ten seconds after the corona discharge, the surface potential $V_{10}$ was measured. The sample was then allowed to stand in the dark for an additional 90 seconds, and the potential $V_{100}$ was measured. The dark charge retention rate (DRR; %), i.e., percent retention of potential after dark decay for 90 seconds, was calculated from the following equation:

$$DRR\ (\%)=(V_{100}/V_{10})\times 100$$

Separately, the surface of photoconductive layer was charged to −400 V with a corona discharge and then exposed to light emitted from a gallium-aluminum-arsenic semiconductor laser (oscillation wavelength: 780 nm). and the time required for decay of the surface potential $V_{10}$ to one-tenth was measured, and the exposure amount $E_{1/10}$ (erg/cm$^2$) was calculated therefrom. The measurements were conducted under ambient condition of 20° C. and 65% RH (I), 30° C. and 80% RH (II) or 15° C. and 30% RH (III).

*2) Image Forming Performance

After the light-sensitive material was allowed to stand for one day under the ambient condition shown below, the light-sensitive material was charged to −6 kV and exposed to light emitted from a gallium-aluminum-arsenic semiconductor laser (oscillation wavelength: 780 nm; output: 2.8 mW) at an exposure amount of 64 erg/cm$^2$ (on the surface of the photoconductive layer) at a pitch of 25 μm and a scanning speed of 300 m/sec. The thus formed electrostatic latent image was developed with a liquid developer ELP-T (produced by Fuji Photo Film Co., Ltd.), washed with a rinse solution of iso-paraffinic solvent Isopar G (manufactured by Esso Chemical K.K.) and fixed. The duplicated image obtained was visually evaluated for fog and image quality.

The ambient condition at the time of image formation was 20° C. and 65% RH (I), 30° C. and 80% RH (II) or 15° C. and 30% RH (III).

As shown in Table II-1, the light-sensitive material according to the present invention exhibited good electrostatic characteristics and provided duplicated image which was clear and free from background fog, even when the ambient condition was fluctuated. On the contrary, while the light-sensitive materials of Comparative Examples II-1 and II-2 exhibited good image forming performance under the ambient condition of normal temperature and normal humidity (I), the occurrence of unevenness of density was observed in the highly accurate image portions, in particular, half tone areas of continuous gradation under the ambient condition of high temperature and high humidity (II) regardless of the electrostatic characteristics. Also a slight background fog remained without removing after the rinse treatment. Further, the occurrence of unevenness of small white spots at random in the image portion was observed under the ambient condition of low temperature and low temperature (III).

From all these considerations, it is thus clear that an electrophotographic light-sensitive material satisfying both requirements of electrostatic characteristics and image forming performance (in particular, for highly accurate image) and being advantageously employed particularly in a scanning exposure system using a semiconductor laser beam can be obtained only using the binder resin according to the present invention.

EXAMPLE II-2

A mixture of 5 g (solid basis) of Resin (A-111) 35 g (solid basis) of Resin (B-2), 200 g of photoconductive zinc oxide, 0.020 g of Methine Dye (II-II) having the following structure, 0.20 g of N-hydroxymalinimide and 300 g of toluene was treated in the same manner as described in Example II-1 to prepare an electrophotographic light-sensitive material.

Methine Dye (II-II)

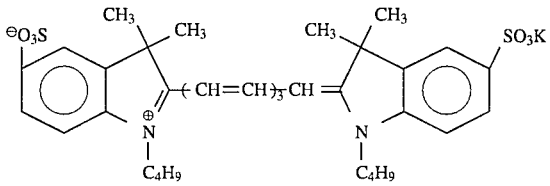

Comparative Example II-3

An electrophotographic light-sensitive material was prepared in the same manner as in Example II-2, except for using 35 g of Resin (R-II-3) having the following structure in place of 35 g of Resin (B-2) used in Example II-2.

Comparative Resin (R-II-3)

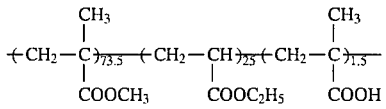

Mw: $6.5 \times 10^4$ (random copolymer)

Comparative Example II-4

An electrophotographic light-sensitive material was prepared in the same manner as in Example II-2, except for using 35 g of Resin (R-II-4) having the following structure in place of 35 g of Resin (B-2) used in Example II-2.

Comparative Resin (R-II-4)

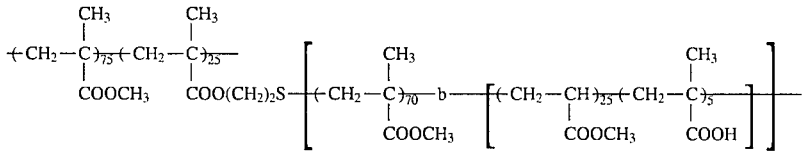

Mw: $5.5 \times 10^4$ (graft copolymer)
—b— represents a bond between blocks.

With each of the light-sensitive materials thus-prepared, a film property in terms of surface smoothness, mechanical strength, electrostatic characteristics and image forming performance were evaluated. Further, printing property was evaluated when it was used as an electrophotographic lithographic printing plate precursor. The results obtained are shown in Table II-2 below.

TABLE II-2

| | | Example II-2 | Comparative Example II-3 | Comparative Example II-4 |
|---|---|---|---|---|
| Smoothness of Photoconductive Layer (sec/cc) | | 380 | 350 | 400 |
| Mechanical Strength of Photoconductive Layer (%) | | 95 | 80 | 85 |
| Electrostatic Characteristics | | | | |
| $V_{10}$ (−V) | I (20° C., 65% RH) | 730 | 700 | 730 |
| | II (30° C., 80% RH) | 700 | 670 | 700 |
| | III (15° C., 30% RH) | 750 | 725 | 745 |
| D.R.R. (%) (90 sec value) | I (20° C., 65% RH) | 90 | 85 | 88 |
| | II (30° C., 80% RH) | 85 | 79 | 83 |
| | III (15° C., 30% RH) | 91 | 88 | 90 |
| $E_{1/10}$ (erg/cm$^2$) | I (20° C., 65% RH) | 15.0 | 24 | 21 |
| | II (30° C., 80% RH) | 14.8 | 22 | 18 |
| | III (15° C., 30% RH) | 20 | 30 | 23 |
| Image Forming | I (20° C., 65% RH) | Good | Good | Good |

TABLE II-2-continued

| | | Example II-2 | Comparative Example II-3 | Comparative Example II-4 |
|---|---|---|---|---|
| Performance | II (30° C., 80% RH) | Good | Unevenness in half tone area | Slight unevenness in half tone area |
| | III (15° C., 30% RH) | Good | Unevenness in half tone area, unevenness of white spots in image portion | Unevenness in half tone area, unevenness of white spots in image portion |
| Water Retentivity of *5) Light-Sensitive Material | | No background stain at all | Background stain | Slight background stain |
| Printing Durability *6) | | 10,000 Prints | 4,000 Prints | 6,000 Prints |

The evaluation of each item shown in Table II-2 was conducted in the following manner.

*3) Smoothness of Photoconductive Layer

The smoothness (sec/cc) of the light-sensitive material was measured using a Beck's smoothness test machine (manufactured by Kumagaya Riko K.K.) under an air volume condition of 1 cc.

*4) Mechanical Strength of Photoconductive Layer

The surface of the light-sensitive material was repeatedly (1000 times) rubbed with emery paper (#1000) under a load of 75 g/cm$^2$ using a Heidon 14 Model surface testing machine (manufactured by Shinto Kagaku K.K.). After dusting, the abrasion loss of the photoconductive layer was measured to obtain film retention (%).

*5) Water Retentivity of Light-Sensitive Material

A light-sensitive material without subjecting to plate making was passed twice through an etching processor using an aqueous solution obtained by diluting an oil-desensitizing solution ELP-EX (produced by Fuji Photo Film Co., Ltd.) to a five-fold volume with distilled water to conduct an oil-desensitizing treatment of the surface of the photoconductive layer. The material thus-treated was mounted on an offset printing machine ("611XLA-II Model" manufactured by Hamada Printing Machine Manufacturing Co.) and printing was conducted using distilled water as dampening water. The extent of background stain occurred on the 50th print was visually evaluated. This tesing method corresponds to evaluation of water retentivity after oil-desensitizing treatment of the light-sensitive material under the forced condition.

*6) Printing Durability

The light-sensitive material was subjected to plate making in the same manner as described in *2) above to form toner images, and the surface of the photoconductive layer was subjected to oil-desensitization treatment by passing twice through an etching processor using ELP-EX. The resulting lithographic printing plate was mounted on an offset printing machine ("Oliver Model 52", manufactured by Sakurai Seisakusho K.K.), and printing was carried out on paper. The number of prints obtained until background stains in the non-image areas appeared or the quality of the image areas was deteriorated was taken as the printing durability. The larger the number of the prints, the higher the printing durability.

As shown in Table II-2, the light-sensitive material according to the present invention had good surface smoothness, film strength and electrostatic characteristics of the photoconductive layer, and the duplicated image obtained was clear and free from background fog in the non-image area. These results appear to be due to sufficient adsorption of the binder resin onto the photoconductive substance and sufficient covering of the surface of the particles with the binder resin. For the same reason, when it was used as an offset master plate precursor, oil-desensitization of the offset master plate precursor with an oil-desensitizing solution was sufficient to render the non-image areas satisfactorily hydrophilic and adhesion of ink was not observed at all as a result of the evaluation of water retentivity under the forced condition. On practical printing using the resulting master plate, 10,000 prints of clear image without background stains were obtained.

On the contrary, with the light-sensitive materials of Comparative Examples II-3 and II-4, the occurrence of slight background stain in non-image area, unevenness in highly accurate image of continuous gradation and unevenness of white spots in image portion was observed when the image formation was conducted under severe conditions. Further, as a result of the test on water retentivity of these light-sensitive materials to make offset master plates, the adhesion of ink was observed. The printing durability thereof was in a range of from 4,000 to 6,000 prints.

From these results it is believed that the resin (A) and the resin (B) according to the present invention suitably interacts with zinc oxide particles to form the condition under which an oil-desensitizing reaction proceeds easily and sufficiently with an oil-desensitizing solution and that the remarkable improvement in film strength is achieved by the action of the resin (B).

EXAMPLES II-3 TO II-18

Each electrophotographic light-sensitive material was prepared in the same manner as described in Example II-2, except for using each of Resins (A) and Resins (B) shown in Table II-3 below in place of Resin (A-111) and Resin (B-2) used in Example II-2, respectively. The electrostatic characteristics of the resulting light-sensitive materials were evaluated in the same manner as described in Example II-2.

TABLE II-3

| Example | Resin (A) | Resin (B) |
|---|---|---|
| II-3 | A-107 | B-4 |
| II-4 | A-108 | B-6 |
| II-5 | A-109 | B-7 |
| II-6 | A-110 | B-8 |
| II-7 | A-112 | B-9 |
| II-8 | A-113 | B-10 |
| II-9 | A-114 | B-11 |
| II-10 | A-118 | B-12 |

TABLE II-3-continued

| Example | Resin (A) | Resin (B) |
|---|---|---|
| II-11 | A-120 | B-13 |
| II-12 | A-121 | B-15 |
| II-13 | A-124 | B-16 |
| II-14 | A-126 | B-17 |
| II-15 | A-129 | B-20 |
| II-16 | A-130 | B-21 |
| II-17 | A-131 | B-22 |
| II-18 | A-135 | B-23 |

The electrostatic characteristics and image forming performance of each of the light-sensitive materials were determined in the same manner as described in Example II-1. Each light-sensitive material exhibited good electrostatic characteristics. As a result of the evaluation on image forming performance of each light-sensitive material, it was found that clear duplicated images having good reproducibility of fine lines and letters and no occurrence of unevenness in half tone areas without the formation of background fog were obtained.

Further, when these electrophotographic light-sensitive materials were employed as offset master plate precursors under the same printing condition as described in Example II-2, more than 10,000 good prints were obtained respectively.

It can be seen from the results described above that each of the light-sensitive materials according to the present invention was satisfactory in all aspects of the surface smoothness and film strength of the photo-conductive layer, electrostatic characteristics and printing property.

EXAMPLES II-19 TO II-22

Each electrophotographic light-sensitive material was prepared in the same manner as described in Example II-1, except for using each of the dye shown in Table II-4 below in place of Methine Dye (II-1) used in Example II-1.

TABLE II-4

| Example | Dye | Chemical Structure of Dye |
|---|---|---|
| II-19 | (II-III) | 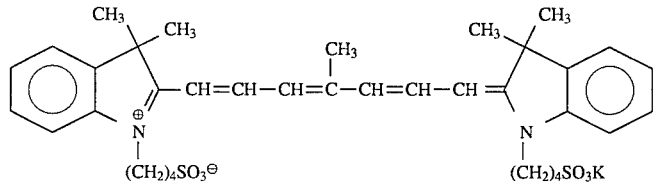 |
| II-20 | (II-IV) | 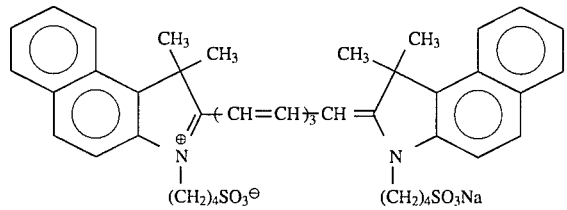 |
| II-21 | (II-V) | 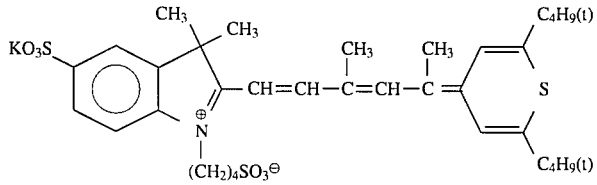 |
| II-22 | (II-VI) | 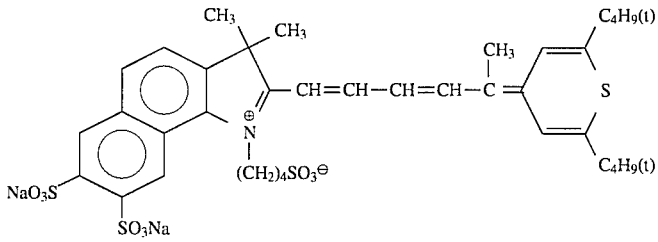 |

Each of the light-sensitive materials according to the present invention was excellent in charging properties, dark charge retention rate and photosensitivity, and provided clear duplicated images free from background fog even when processed under severe conditions of high temperature and high humidity (30° C. and 80% RH) and low temperature and low humidity (15° C. and 30% RH).

EXAMPLES II-23 AND II-24

A mixture of 6.5 g of Resin (A-101) (Example II-23) or Resin (A-118) (Example II-24), 33.5 g of Resin (B-23), 200 g of photoconductive zinc oxide, 0.02 g of uranine, 0.03 g of Methine Dye (II-VII) having the following structure, 0.03 g of Methine Dye (II-VIII) having the following structure, 0.18 g of p-hydroxybenzoic acid and 300 g of toluene was dispersed by a homogenizer at a rotation of $7\times10^3$ r.p.m. for 10 minutes to prepare a coating composition for a light-sensitive layer. The coating composition was coated on paper, which had been subjected to electrically conductive treatment, by a wire bar at a dry coverage of 25 g/m$^2$, and dried for 20 seconds at 110° C. Then, the coated material was allowed to stand in a dark place for 24 hours under the conditions of 20° C. and 65% RH to prepare each electrophotographic light-sensitive material.

Methine Dye (II-VII)

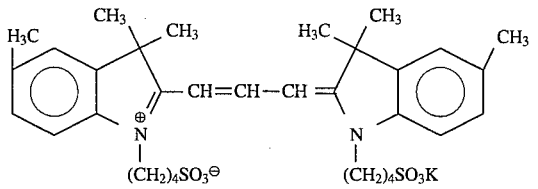

Methine Dye (II-VIII)

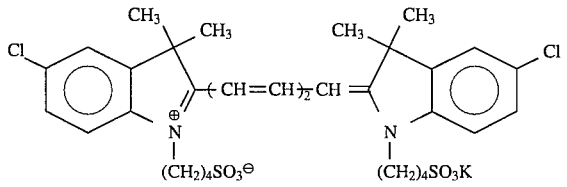

Comparative Example II-5

An electrophotographic light-sensitive material was prepared in the same manner as in Example II-23, except for using 33.5 g of Resin (R-II-5) shown below in place of 33.5 g of Resin (B-23) used in Example II-23.

Comparative Resin (R-II-5)

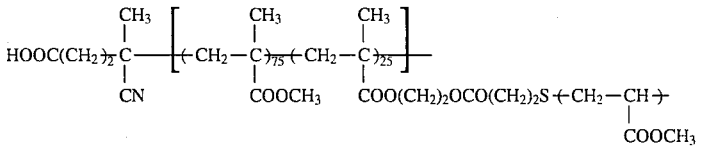

Mw: $7.5\times10^4$

With each of the light-sensitive materials thus prepared, various characteristics were evaluated in the same manner as in Example II-2. The results obtained are shown in Table II-5 below.

TABLE II-5

| | Example II-23 | Example II-24 | Comparative Example II-5 |
|---|---|---|---|
| Binder Resin | (A-101)/(B-23) | (A-118)/(B-23) | (A-101)/(R-II-5) |
| Smoothness of Photoconductive Layer (sec/cc) | 400 | 385 | 410 |
| Mechanical Strength of | 96 | 94 | 79 |

TABLE II-5-continued

| | | Example II-23 | Example II-24 | Comparative Example II-5 |
|---|---|---|---|---|
| Photoconductive Layer (%) Electrostatic Characteristics*7) | | | | |
| $V_{10}$ (−V) | I (20° C., 65% RH) | 650 | 710 | 635 |
| | II (30° C., 80% RH) | 630 | 685 | 615 |
| | III (15° C., 30% RH) | 665 | 730 | 650 |
| D.R.R. (%) | I (20° C., 65% RH) | 95 | 97 | 90 |
| | II (30° C., 80% RH) | 90 | 94 | 85 |
| | III (15° C., 30% RH) | 96 | 97 | 94 |
| $E_{1/10}$ (lux · sec) | I (20° C., 65% RH) | 8.6 | 13.8 | 13.0 |
| | II (30° C., 80% RH) | 7.5 | 11.2 | 11.6 |
| | III (15° C., 30% RH) | 10.3 | 15.6 | 14.4 |
| Image Forming*8) Performance | I (20° C., 65% RH) | Good | Very good | Good |
| | II (30° C., 80% RH) | Good | Very good | Edge mark of cutting, unevenness in half tone area |
| | III (15° C., 30% RH) | Good | Very good | Edge mark of cutting, unevenness in image portion |
| Water Retentivity of Light-Sensitive Material | | Good | Good | Slight background stain |
| Printing Durability | | 10,000 Prints | 10,000 Prints | Background stain from the start of printing |

The characteristics were evaluated in the same manner as in Example II-2, except that some electrostatic characteristics and image forming performance were evaluated according to the following test methods.

*7) Electrostatic Characteristics: $E_{1/10}$

The surface of the photoconductive layer was charged to −400 V with corona discharge, and then irradiated by visible light of the illuminance of 2.0 lux. Then, the time required for decay of the surface potential ($V_{10}$) to 1/10 thereof was determined, and the exposure amount $E_{1/10}$ (lux·sec) was calculated therefrom.

*8) Image Forming Performance

The electrophotographic light-sensitive material was allowed to stand for one day under the ambient condition described below, the light-sensitive material was subjected to plate making by a full-automatic plate making machine ELP-404V (manufactured by Fuji Photo Film Co., Ltd.) using ELP-T as a toner. The duplicated image thus obtained was visually evaluated for fog and image quality. The ambient condition at the time of image formation was 20° C. and 65% RH (I), 30° C. and 80% RH (II) or 15° C. and 30% RH (III). The original used for the duplication was composed of cuttings of other originals pasted up thereon.

From the results, it can be seen that each of the light-sensitive materials according to the present invention exhibited good mechanical strength of the photoconductive layer. On the contrary, with the light-sensitive material of Comparative Example II-5 the value of mechanical strength was lower than them, and the value of $E_{1/10}$ of electrostatic characteristics degraded particularly under the ambient condition of low temperature and low humidity (III), while they were good under the ambient condition of normal temperature and normal humidity (I). On the other hand, the electrostatic characteristics of the light-sensitive materials according to the present invention were good. Particularly, those of Example II-24 using the resin (A) having the specified substituent were very good. The value of $E_{1/10}$ thereof was particularly small.

With respect to image forming performance, the edge mark of cuttings pasted up was observed as background fog in the non-image areas in the light-sensitive material of Comparative Example II-5. Also the occurrence of unevenness in half tone area of continuous gradation and unevenness of small white spots in image portion were observed on the duplicated image when the ambient conditions at the time of the image formation were high temperature and high humidity (II) and low temperature and low humidity (III).

Further, each of these light-sensitive materials was subjected to the oil-desensitizing treatment to prepare an offset printing plate and using the plate printing was conducted. The plates according to the present invention provided 10,000 prints of clear image without background stains. However, with the plate of Comparative Example II-5, the above described edge mark of cuttings pasted up was not removed with the oil-desensitizing treatment and the background stains occurred from the start of printing.

It can be seen from the results described above that only the light-sensitive materials according to the present invention could provide excellent performance.

EXAMPLE II-25

A mixture of 5 g of Resin (A-123), 35 g of Resin (B-22), 200 g of photoconductive zinc oxide, 0.02 g of uranine, 0.04 g of Rose Bengal, 0.03 g of bromophenol blue, 0.40 g of phthalic anhydride and 300 g of toluene was treated in the same manner as described in Example II-24 to prepare an electrophotographic light-sensitive material.

As the result of the evaluation of various characteristics in the same manner as described in Example II-24, it can be seen that the light-sensitive material according to the present invention is excellent in charging properties, dark charge retention rate and photosensitivity, and provides a clear duplicated image free from background fog under severe conditions of high temperature and high humidity (30° C. and 80% RH) and low temperature and low humidity (15° C. and 30% RH). Further, when the material was employed as an offset master plate precursor, 10,000 prints of clear image were obtained.

EXAMPLES II-26 TO II-49

Each electrophotographic light-sensitive material was prepared in the same manner as described in Example II-25, except for using 5 g of each of Resin (A) and 35 g of each of Resin (B) shown in Table II-6 below in place of 5 g of Resin (A-123) and 35 g of Resin (B-22) used in Example II-25, respectively.

TABLE II-6

| Example | Resin (A) | Resin (B) |
|---|---|---|
| II-26 | A-102 | B-6 |
| II-27 | A-103 | B-8 |
| II-28 | A-104 | B-11 |
| II-29 | A-106 | B-13 |
| II-30 | A-107 | B-16 |
| II-31 | A-110 | B-18 |
| II-32 | A-112 | B-19 |
| II-33 | A-113 | B-20 |
| II-34 | A-114 | B-21 |

TABLE II-6-continued

| Example | Resin (A) | Resin (B) |
|---|---|---|
| II-35 | A-115 | B-22 |
| II-36 | A-116 | B-23 |
| II-37 | A-117 | B-17 |
| II-38 | A-123 | B-2 |
| II-39 | A-129 | B-5 |
| II-40 | A-130 | B-14 |
| II-41 | A-131 | B-17 |
| II-42 | A-132 | B-16 |
| II-43 | A-133 | B-1 |
| II-44 | A-134 | B-3 |
| II-45 | A-135 | B-21 |
| II-46 | A-105 | B-22 |
| II-47 | A-124 | B-23 |
| II-48 | A-125 | B-15 |
| II-49 | A-128 | B-12 |

Each of the light-sensitive materials according to the present invention was excellent in charging properties, dark charge retention rate and photosensitivity, and provided a clear duplicated image free from background fog and scratches of fine lines even under severe conditions of high temperature and high humidity (30° C. and 80% RH) and low temperature and low humidity (15° C. and 30% RH). Further, when these materials were employed as offset master plate precursors, 10,000 prints of a clear image free from background stains were obtained respectively.

EXAMPLE III-1

A mixture of 7 g (solid basis) of Resin (A-7), 33 g (solid basis) of Resin (B-101), 200 g of photo-conductive zinc oxide, 0.017 g of Methine Dye (III-1) having the following structure, 0.18 g of phthalic anhydride and 300 g of toluene was dispersed by a homogenizer (manufactured by Nippon Seiki K.K.) at a rotation of $6\times10^3$ r.p.m. for 7 minutes to prepare a coating composition for a light-sensitive layer. The coating composition was coated on paper, which had been subjected to electrically conductive treatment, by a wire bar at a dry coverage of 25 g/m$^2$, followed by drying at 100° C. for 30 seconds. The coated material was then allowed to stand in a dark place at 20° C. and 65% RH for 24 hours to prepare an electrophotographic light-sensitive material.

Methine Dye (III-1)

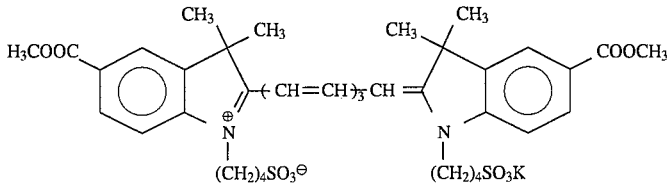

Comparative Example III-1

An electrophotographic light-sensitive material was prepared in the same manner as in Example III-1, except for using 33 g of Resin (R-III-1) having the following structure in place of 33 g of Resin (B-101) used in Example III-1.

Comparative Resin (R-III-1)

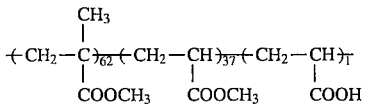

Mw: $8\times10^4$ (random copolymer)

Comparative Example III-2

An electrophotographic light-sensitive material was prepared in the same manner as in Example III-1, except for using 33 g of Resin (R-III-2) having the following structure in place of 33 g of Resin (B-101) used in Example III-1.

Comparative Resin (R-III-2)

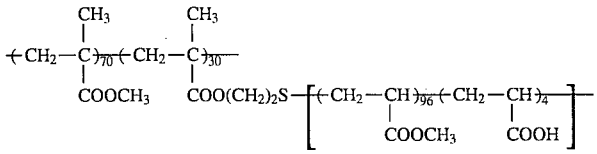

Mw: $6.3\times10^4$ (graft copolymer)

Comparative Example III-3

An electrophotographic light-sensitive material was prepared in the same manner as in Example III-1, except for using 33 g of Resin (R-III-3) having the following structure in place of 33 g of Resin (B-101) used in Example III-1.

Comparative Resin (R-III-3)

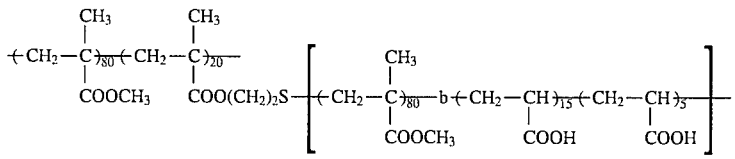

Mw: $6 \times 10^4$ (AB block graft copolymer)

With each of the light-sensitive material thus prepared, mechanical strength of photoconductive layer, electrostatic characteristics and image forming performance were evaluated. The results obtained are shown in Table III-1 below.

TABLE III-1

| | | Example III-1 | Comparative Example III-1 | Comparative Example III-2 | Comparative Example III-3 |
|---|---|---|---|---|---|
| Mechanical Strength of*1) photoconductive layer | | 90 | 91 | 84 | 83 |
| Electrostatic Characteristics*2) | | | | | |
| $V_{10}$ (−V) | I (20° C., 65% RH) | 700 | 550 | 590 | 600 |
| | II (30° C., 80% RH) | 685 | 470 | 570 | 585 |
| D.R.R. (90 sec value) (%) | | | | | |
| | I (20° C., 65% RH) | 86 | 75 | 80 | 82 |
| | II (30° C., 80% RH) | 82 | 50 | 70 | 74 |
| $E_{1/10}$ (erg/cm$^2$) | I (20° C., 65% RH) | 21 | 105 | 51 | 45 |
| | II (30° C., 80% RH) | 25 | 150 or more | 60 | 53 |
| $E_{1/100}$ (erg/cm$^2$) | I (20° C., 65% RH) | 34 | unmeasurable | 84 | 75 |
| | II (30° C., 80% RH) | 43 | unmeasurable | 100 | 90 |
| Image Forming Performance*3) | I (20° C., 65% RH) | Very good | Scratches of fine lines and letters, severe background fog | Scratches of fine lines and letters, slight background fog | Good |
| | II (30° C., 80% RH) | Good | Severe decrease in density, severe unevenness in half tone area | Severe decrease in density, severe unevenness in half tone area | Severe decrease in density, severe unevenness in half tone area |

The evaluation of each item shown in Table III-1 was conducted in the following manner.

*1) Mechanical Strength of Photoconductive Layer

The surface of the light-sensitive material was repeatedly (1000 times) rubbed with emery paper (#1000) under a load of 50 g/cm$^2$ using a Heidon 14 Model surface testing machine (manufactured by Shinto Kagaku K.K.). After dusting, the abrasion loss of the photoconductive layer was measured to obtain film retention (%).

*2) Electrostatic Characteristics

The light-sensitive material was charged with a corona discharge to a voltage of −6 kV for 20 seconds in a dark room at a temperature of 20° C. and at 65% RH using a paper analyzer ("Paper Analyzer SP-428" manufactured by Kawaguchi Denki K.K.). Ten seconds after the corona discharge, the surface potential $V_{10}$ was measured. The sample was then allowed to stand in the dark for an additional 90 seconds, and the potential $V_{100}$ was measured. The dark charge retention rate (DRR; %), i.e., percent retention of potential after dark decay for 90 seconds, was calculated from the following equation:

$$DRR\ (\%)=(V_{100}/V_{10})\times 100$$

Separately, the surface of photoconductive layer was charged to −400 V with a corona discharge and then exposed to light emitted from a gallium-aluminum-arsenic semiconductor laser (oscillation wavelength: 780 nm), and the time required for decay of the surface potential $V_{10}$ to one-tenth was measured, and the exposure amount $E_{1/10}$ (erg/cm$^2$) was calculated therefrom. Further, in the same manner as described above the time required for decay of the surface potential $V_{10}$ to one-hundredth was measured, and the exposure amount $E_{1/100}$ (erg/cm$^2$) was calculated therefrom. The measurements were conducted under ambient condition of 20° C. and 65% RH (I) or 30° C. and 80% RH (II).

*3) Image Forming Performance

After the light-sensitive material was allowed to stand for one day under the ambient condition shown below, the light-sensitive material was charged to −6 kV and exposed to light emitted from a gallium-aluminum-arsenic arsenic semi-conductor laser (oscillation wavelength: 780 nm; output: 2.8 mW) at an exposure amount of 64 erg/cm$^2$ (on the surface of the photoconductive layer) at a pitch of 25 μm and a scanning speed of 300 m/sec. The thus formed electrostatic latent image was developed with a liquid developer ELP-T (produced by Fuji Photo Film Co., Ltd.), washed with a rinse solution of iso-paraffinic solvent Isopar G (manufactured by Esso Chemical K.K.) and fixed. The duplicated image obtained was visually evaluated for fog and image quality. The ambient condition at the time of image formation was 20° C. and 65% RH (I) or 30° C. and 80% RH (II).

As shown in Table III-1, the light-sensitive material according to the present invention had good electrostatic characteristics, and the duplicated image obtained thereon was clear and free from background fog. On the contrary, with the light-sensitive materials of Comparative Examples III-1, III-2 and III-3 the decrease in photosensitivity ($E_{1/10+cc}$ and $E_{+c,fra\ 1/100}$) occurred, and in the duplicated images the scratches of fine lines and letters were observed and a background fog remained without removing after the rinse treatment. Further, the occurrence of unevenness in half tone areas of continuous gradation of the original was observed regardless of the electrostatic characteristics.

The value of $E_{1/100}$ is largely different between the light-sensitive material of the present invention and those of the comparative examples. The value of $E_{1/100}$ indicates an electrical potential remaining in the non-image areas after exposure at the practice of image formation. The smaller this value, the less the background fog in the non-image areas. More specifically, it is requested that the remaining potential is decreased to −10 V or less. Therefore, an amount of exposure necessary to make the remaining potential below −10 V is an important factor. In the scanning exposure system using a semiconductor laser beam, it is quite important to make the remaining potential below −10 V by a small exposure amount in view of a design for an optical system of a duplicator (such as cost of the device, and accuracy of the optical system).

From all these considerations, it is thus clear that an electrophotographic light-sensitive material satisfying both requirements of electrostatic characteristics and image forming performance and being advantageously employed particularly in a scanning exposure system using a semiconductor laser beam can be obtained only using the binder resin according to the present invention.

EXAMPLE III-2

A mixture of 6 g (solid basis) of Resin (A-9), 34 g (solid basis) of Resin (B-102), 200 g of photo-conductive zinc oxide, 0.020 g of Methine Dye (III-II) having the following structure, 0.20 g of N-hydroxymalinimide and 300 g of toluene was treated in the same manner as described in Example III-1 to prepare an electrophotographic light-sensitive material.

Methine Dye (III-II)

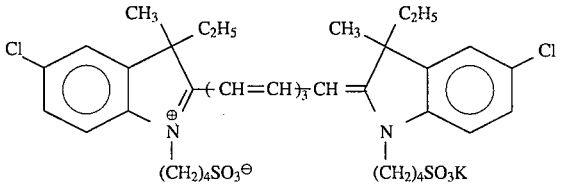

With the light-sensitive material thus-prepared, a film property in terms of surface smoothness, electrostatic characteristics and image forming performance were evaluated. Further, printing property was evaluated when it was used as an electrophotographic lithographic printing plate precursor. The results obtained are shown in Table III-2 below.

TABLE III-2

| | | Example III-2 |
|---|---|---|
| Smoothness of Photoconductive Layer*4) (sec/cc) | | 210 |
| Electrostatic Characteristics | | |
| $V_{10}$ (−V) | I (20° C., 65% RH) | 750 |
| | II (30° C., 80% RH) | 730 |

TABLE III-2-continued

| | | Example III-2 |
|---|---|---|
| D.R.R. | I (20° C., 65% RH) | 88 |
| (90 sec value) (%) | II (30° C., 80% RH) | 83 |
| $E_{1/10}$ (erg/cm$^2$) | I ( 20° C., 65% RH) | 20 |
| | II (30° C., 80% RH) | 23 |
| $E_{1/100}$ (erg/cm$^2$) | I (20° C., 65% RH) | 33 |
| | II (30° C., 80% RH) | 40 |
| Image Forming | I (20° C., 65% RH) | Very good |
| Performance | II (30° C., 80% RH) | Good |
| Contact Angle with Water*5) (°) | | 0 |
| Printing Durability*6) | | 10,000 Prints |

The evaluation of each item shown in Table III-2 was conducted in the following manner.

*4) Smoothness of Photoconductive Layer

The smoothness (sec/cc) of the light-sensitive material was measured using a Beck's smoothness test machine (manufactured by Kumagaya Riko K.K.) under an air volume condition of 1 cc.

*5) Contact Angle with Water

The light-sensitive material was passed once through an etching processor using a solution prepared by diluting an oil-desensitizing solution ("ELP-EX" produced by Fuji Photo Film Co., Ltd.) to a two-fold volume with distilled water to conduct oil-desensitization treatment on the surface of the photoconductive layer. On the thus oil-desensitized surface was placed a drop of 2 μl of distilled water, and the contact angle formed between the surface and water was measured using a goniometer.

*6) Printing Durability

The light-sensitive material was subjected to plate making in the same manner as described in *3) above to form toner images, and the surface of the photoconductive layer was subjected to oil-desensitization treatment under the same condition as in *5) above. The resulting lithographic printing plate was mounted on an offset printing machine ("Oliver Model 52", manufactured by Sakurai Seisakusho K.K.), and printing was carried out on paper. The number of prints obtained until background stains in the non-image areas appeared or the quality of the image areas was deteriorated was taken as the printing durability. The larger the number of the prints, the higher the printing durability.

As shown in Table III-2, the light-sensitive material according to the present invention had good surface smoothness and electrostatic characteristics of the photoconductive layer, and the duplicated image obtained was clear and free from background fog in the non-image area. These results appear to be due to sufficient adsorption of the binder resin onto the photoconductive substance and sufficient covering of the surface of the particles with the binder resin. For the same reason, when it was used as an offset master plate precursor, oil-desensitization of the offset master plate precursor with an oil-desensitizing solution was sufficient to render the non-image areas satisfactorily hydrophilic, as shown by a small contact angle of 0° with water. On practical printing using the resulting master plate, 10,000 prints of clear image without background stains were obtained.

From these results it is believed that the resin (A) and the resin (B) according to the present invention suitably interacts with zinc oxide particles to form the condition under which an oil-desensitizing reaction proceeds easily and sufficiently with an oil-desensitizing solution and that the remarkable improvement in film strength is achieved by the action of the resin (B).

EXAMPLES III-3 TO III-20

Each electrophotographic light-sensitive material was prepared in the same manner as described in Example III-2, except for using each of Resins (A) and Resins (B) shown in Table III-3 below in place of Resin (A-9) and Resin (B-102) used in Example III-2, respectively.

TABLE III-3

| Example | Resin (A) | Resin (B) |
|---|---|---|
| III-3 | A-2 | B-104 |
| III-4 | A-4 | B-105 |
| III-5 | A-8 | B-106 |
| III-6 | A-7 | B-107 |
| III-7 | A-10 | B-109 |
| III-8 | A-11 | B-110 |
| III-9 | A-14 | B-113 |
| III-10 | A-15 | B-115 |
| III-11 | A-18 | B-116 |
| III-12 | A-22 | B-118 |
| III-13 | A-23 | B-119 |
| III-14 | A-24 | B-120 |
| III-15 | A-26 | B-122 |
| III-16 | A-27 | B-123 |
| III-17 | A-28 | B-125 |
| III-18 | A-29 | B-127 |
| III-19 | A-20 | B-128 |
| III-20 | A-25 | B-130 |

The electrostatic characteristics of the resulting light-sensitive materials were evaluated in the same manner as described in Example III-2, and good results were obtained.

As a result of the evaluation on image forming performance of each light-sensitive material, it was found that clear duplicated images having good reproducibility of fine lines and letters and no occurrence of unevenness in half tone areas without the formation of background fog were obtained.

Further, when these electrophotographic light-sensitive materials were employed as offset master plate precursors under the same printing condition as described in Example III-2, more than 10,000 good prints were obtained respectively.

It can be seen from the results described above that each of the light-sensitive materials according to the present invention was satisfactory in all aspects of the surface smoothness and film strength of the photo-conductive layer, electrostatic characteristics, and printing property.

EXAMPLES III-21 TO III-24

Each electrophotographic light-sensitive material was prepared in the same manner as described in Example III-1, except for using each of the dye shown in Table III-4 below in place of Methine Dye (III-1) used in Example III-1.

TABLE III-4

| Example | Dye | Chemical Structure of Dye |
|---|---|---|
| III-21 | (III-III) | 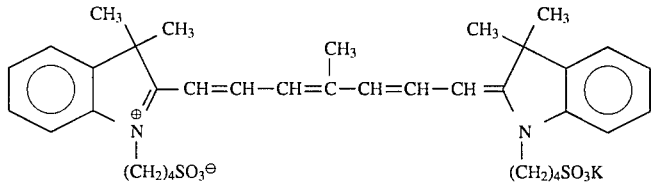 |
| III-22 | (II-IV) | 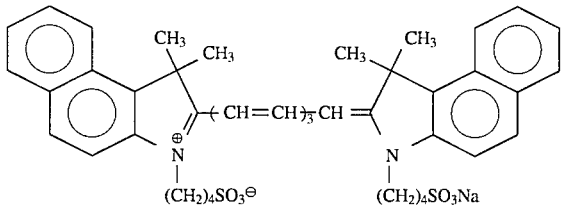 |
| III-23 | (III-V) | 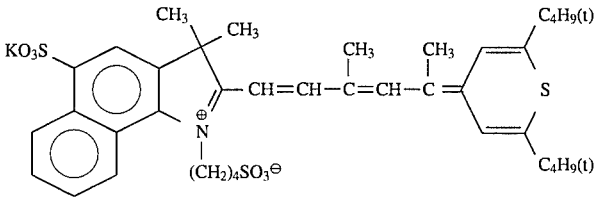 |

TABLE III-4-continued

| Example | Dye | Chemical Structure of Dye |
|---|---|---|
| III-24 | (III-VI) | 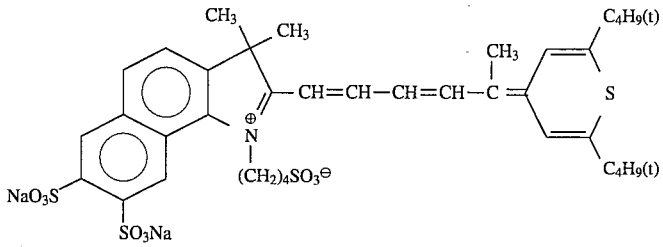 |

Each of the light-sensitive materials according to the present invention was excellent in charging properties, dark charge retention rate and photosensitivity, and provided clear duplicated images free from background fog even when processed under severe condition of high temperature and high humidity (30° C. and 80% RH).

EXAMPLES III-25 AND III-26

A mixture of 6.5 g of Resin (A-19) (Example III-25) or Resin (A-29) (Example III-26), 33.5 g of Resin (B-106), 200 g of photoconductive zinc oxide, 0.02 g of uranine, 0.035 g of Rose Bengal, 0.025 g of bromophenol blue, 0.18 g of p-hydroxybenzoic acid and 300 g of toluene was dispersed by a homogenizer at a rotation of $7\times10^3$ r.p.m. for 5 minutes to prepare a coating composition for a light-sensitive layer. The coating composition was coated on paper, which had been subjected to electrically conductive treatment, by a wire bar at a dry coverage of 25 g/m$^2$, and dried for 20 seconds at 110° C. Then, the coated material was allowed to stand in a dark place for 24 hours under the conditions of 20° C. and 65% RH to prepare each electrophotographic light-sensitive material.

Comparative Example III-4

An electrophotographic light-sensitive material was prepared in the same manner as in Example III-25, except for using 33.5 g of Comparative Resin (R-III-2) described above in place of 33.5 g of Resin (B-106) used in Example III-25.

With each of the light-sensitive materials thus prepared, various characteristics were evaluated in the same manner as in Example III-2. The results obtained are shown in Table III-5 below.

TABLE III-5

| | | Example III-25 | Example III-26 | Comparative Example III-4 |
|---|---|---|---|---|
| Binder Resin | | (A-19)/(B-106) | (A-29)/(B-106) | (A-19)/(R-III-2) |
| Smoothness of Photoconductive Layer (sec/cc) | | 185 | 180 | 190 |
| Electrostatic Characteristics*7) | | | | |
| $V_{10}$ (−V) | I (20° C., 65% RH) | 595 | 730 | 580 |
| | II (30° C., 80% RH) | 580 | 715 | 560 |
| D.R.R. (%) | I (20° C., 65% RH) | 87 | 94 | 85 |
| | II (30° C., 80% RH) | 84 | 91 | 82 |
| $E_{1/10}$ (lux · sec) | I (20° C., 65% RH) | 10.3 | 9.5 | 11.5 |
| | II (30° C., 80% RH) | 11.0 | 10.0 | 12.2 |
| $E_{1/100}$ (lux · sec) | I (20° C., 65% RH) | 18 | 16 | 23 |
| | II (30° C., 80% RH) | 20 | 17 | 31 |
| Image Forming*8) Performance | I (20° C., 65% RH) | Good | Very good | Slight edge mark of cutting |
| | II (30° C., 80% RH) | Good | Very good | Unevenness in half tone area, edge mark of cutting |
| Contact Angle with Water (°) | | 0 | 0 | 0 |
| Printing Durability | | 10,000 Prints | 10,000 Prints | Unevenness of image occurred from the start of printing |

The characteristics were evaluated in the same manner as in Example III-2, except that some electrostatic characteristics and image forming performance were evaluated according to the following test methods.

*7) Electrostatic Characteristics: $E_{1/10+ce}$ and $E_{+c,fra\ 1/100}$

The surface of the photoconductive layer was charged to −400 V with corona discharge, and then irradiated by visible light of the illuminance of 2.0 lux. Then, the time required for decay of the surface potential ($V_{10}$) to 1/10 or 1/100 thereof was determined, and the exposure amount $E_{1/10}$ or $E_{1/100}$ (lux·sec) was calculated therefrom.

*8) Image Forming Performance

The electrophotographic light-sensitive material was allowed to stand for one day under the ambient condition described below, the light-sensitive material was subjected to plate making by a full-automatic plate making machine ELP-404V (manufactured by Fuji Photo Film Co., Ltd.) using ELP-T as a toner. The duplicated image thus obtained was visually evaluated for fog and image quality. The ambient condition at the time of image formation was 20° C. and 65% RH (I) or 30° C. and 80% RH (II). The original used for the duplication was composed of cuttings of other originals pasted up thereon.

From the results shown above, it can be seen that each light-sensitive material exhibited almost the same properties with respect to the surface smoothness of the photoconductive layer. The electrostatic characteristics of the light-sensitive materials according to the present invention were good. Particularly, those of Example III-26 using the resin (A) having the specified substituent were very good. The value of $E_{1/100}$ thereof was particularly small.

With respect to image forming performance, the edge mark of cuttings pasted up was observed as background fog in the non-image areas in the light-sensitive material of Comparative Example III-4. On the contrary, the light-sensitive materials according to the present invention provided clear duplicated images free from background fog.

Further, each of these light-sensitive materials was subjected to the oil-desensitizing treatment to prepare an offset printing plate and using the resulting plate printing was conducted. The plates according to the present invention provided 10,000 prints of clear image without background stains. However, with the plate of Comparative Example III-4, the above described edge mark of cuttings pasted up was not removed with the oil-desensitizing treatment and the background stains occurred from the start of printing.

It can be seen from the results described above that only the light-sensitive materials according to the present invention could provide excellent performance.

EXAMPLES III-27 TO III-42

Each electrophotographic light-sensitive material was prepared in the same manner as described in Example III-25, except for using 6.5 g of each of Resin (A) and 33.5 g of each of Resin (B) shown in Table III-6 below in place of 6.5 g of Resin (A-19) and 33.5 g of Resin (B-106) used in Example III-25, respectively.

TABLE III-6

| Example | Resin (A) | Resin (B) |
|---|---|---|
| III-27 | A-1 | B-104 |
| III-28 | A-3 | B-105 |
| III-29 | A-4 | B-107 |
| III-30 | A-5 | B-108 |
| III-31 | A-6 | B-110 |
| III-32 | A-13 | B-112 |
| III-33 | A-16 | B-113 |
| III-34 | A-22 | B-115 |
| III-35 | A-24 | B-116 |
| III-36 | A-25 | B-120 |
| III-37 | A-26 | B-124 |
| III-38 | A-27 | B-127 |
| III-39 | A-28 | B-125 |
| III-40 | A-29 | B-130 |
| III-41 | A-7 | B-129 |
| III-42 | A-8 | B-119 |

Each of the light-sensitive materials according to the present invention was excellent in charging properties, dark charge retention rate and photosensitivity, and provided a clear duplicated image free from background fog even under severe condition of high temperature and high humidity (30° C. and 80% RH). Further, when these materials were employed as offset master plate precursors, 10,000 prints of a clear image free from background stains were obtained respectively. Moreover, the light-sensitive materials using the resin (A) containing a methacrylate component substituted with the specific aryl group exhibited better performance.

EXAMPLE IV-1

A mixture of 6 g (solid basis) of Resin (A-121), 34 g (solid basis) of Resin (B-101), 200 g of photo-conductive zinc oxide, 0.017 g of Methine Dye (IV-1) having the following structure, 0.18 g of phthalic anhydride and 300 g of toluene was dispersed by a homogenizer (manufactured by Nippon Seiki K.K.) at a rotation of $6\times10^3$ r.p.m. for 6 minutes to prepare a coating composition for a light-sensitive layer. The coating composition was coated on paper, which has been subjected to electrically conductive treatment, by a wire bar at a dry coverage of 25 g/m$^2$, followed by drying at 100° C. for 30 seconds. The coated material was then allowed to stand in a dark place at 20° C. and 65% RH (relative humidity) for 24 hours to prepare an electrophotographic light-sensitive material.

Methine Dye (IV-1)

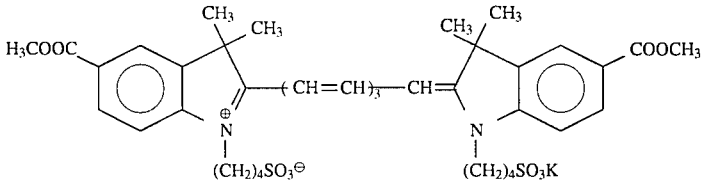

Comparative Example IV-1

An electrophotographic light-sensitive material was prepared in the same manner as in Example IV-1, except for using 34 g of Resin (R-IV-1) shown below in place of 34 g of Resin (B-101) used in Example IV-1.

Comparative Resin (R-IV-1)

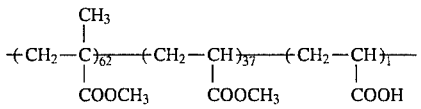

Mw: $8\times10^4$ (random copolymer)

Comparative Example IV-2

An electrophotographic light-sensitive material was prepared in the same manner as in Example IV-1, except for using 34 g of Resin (R-IV-2) shown below in place of 34 g of Resin (B-101) used in Example IV-1.

Comparative Resin (R-IV-2)

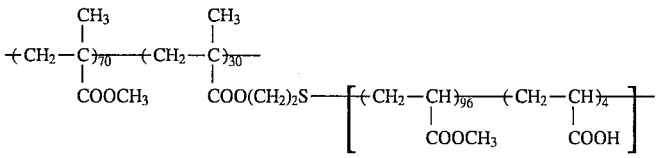

Mw: $6.3 \times 10^4$ (graft copolymer)

Comparative Example IV-3

An electrophotographic light-sensitive material was prepared in the same manner as in Example IV-1, except for using 34 g of Resin (R-IV-3) shown below in place of 34 g of Resin (B-101) used in Example IV-1.

Comparative Resin (R-IV-3)

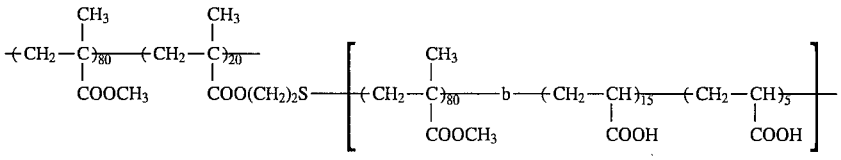

Mw: $6 \times 10^4$ (AB block graft copolymer)

With each of the light-sensitive material thus prepared, mechanical strength of photoconductive layer, electrostatic characteristics and image forming performance were evaluated. The results obtained are shown in Table IV-1 below.

TABLE IV-1

| | | Example IV-1 | Comparative Example IV-1 | Comparative Example IV-2 | Comparative Example IV-3 |
|---|---|---|---|---|---|
| Mechanical Strength of*1) photoconductive layer | | 92 | 88 | 85 | 87 |
| Electrostatic Characteristics*2) | | | | | |
| $V_{10}$ (−V) | I (20° C., 65% RH) | 740 | 700 | 710 | 720 |
| | II (30° C., 80% RH) | 720 | 670 | 685 | 695 |
| D.R.R. (90 sec value) (%) | | | | | |
| | I (20° C., 65% RH) | 89 | 84 | 85 | 86 |
| | II (30° C., 80% RH) | 85 | 75 | 78 | 78 |
| $E_{1/10}$ (erg/cm$^2$) | I (20° C., 65% RH) | 20 | 31 | 28 | 25 |
| | II (30° C., 80% RH) | 23 | 35 | 30 | 30 |
| $E_{1/100}$ (erg/cm$^2$) | I (20° C., 65% RH) | 35 | 52 | 48 | 45 |
| | II (30° C., 80% RH) | 40 | 60 | 54 | 52 |
| Image Forming Performance*3) | I (20° C., 65% RH) | Very good | Unevenness in half tone area, background fog | Unevenness in half tone area, background fog | Unevenness in half tone area, background fog |
| | II (30° C., 80% RH) | Very good | Unevenness in half tone area, scratches of fine lines and letters | Unevenness in half tone area, scratches of fine lines and letters | Unevenness in half tone area, scratches of fine lines and letters |

The evaluation of each item shown in Table IV-1 was conducted in the following manner.

*1) Mechanical Strength of Photoconductive Layer

The surface of the light-sensitive material was repeatedly (1000 times) rubbed with emery paper (#1000) under a load of 50 g/cm$^2$ using a Heidon 14 Model surface testing machine (manufactured by Shinto Kagaku K.K.). After dusting, the abrasion loss of the photoconductive layer was measured to obtain film retention (%).

*2) Electrostatic Characteristics

The light-sensitive material was charged with a corona discharge to a voltage of −6 kV for 20 seconds in a dark room at a temperature of 20° C. and at 65% RH using a paper analyzer ("Paper Analyzer SP-428" manufactured by Kawaguchi Denki K.K.). Ten seconds after the corona discharge, the surface potential $V_{10}$ was measured. The sample was then allowed to stand in the dark for an additional 90 seconds, and the potential $V_{100}$ was measured. The dark charge retention rate (DRR; %), i.e., percent retention of potential after dark decay for 90 seconds, was calculated from the following equation:

$$DRR\ (\%)=(V_{100}/V_{10})\times 100$$

Separately, the surface of photoconductive layer was charged to −400 V with a corona discharge and then exposed to light emitted from a gallium-aluminum-arsenic semiconductor laser (oscillation wavelength: 780 nm), and the time required for decay of the surface potential $V_{10}$ to one-tenth was measured, and the exposure amount $E_{1/10}$ (erg/cm$^2$) was calculated therefrom. Further, in the same manner as described above the time required for decay of the surface potential $V_{10}$ to one-hundredth was measured, and the exposure amount $E_{1/100}$ (erg/cm$^2$) was calculated therefrom. The measurements were conducted under ambient condition of 20° C. and 65% RH (I) or 30° C. and 80% RH (II).

*3) Image Forming Performance

After the light-sensitive material was allowed to stand for one day under the ambient condition shown below, the light-sensitive material was charged to −6 kV and exposed to light emitted from a gallium-aluminum-arsenic semiconductor laser (oscillation wavelength: 780 nm; output: 2.8 mW) at an exposure amount of 64 erg/cm$^2$ (on the surface of the photoconductive layer) at a pitch of 25 μm and a scanning speed of 300 m/sec. The thus formed electrostatic latent image was developed with a liquid developer ELP-T (produced by Fuji Photo Film Co., Ltd.), washed with a rinse solution of iso-paraffinic solvent Isopar G (manufactured by Esso Chemical K.K.) and fixed. The duplicated image obtained was visually evaluated for fog and image quality. The ambient condition at the time of image formation was 20° C. and 65% RH (I) or 30° C. and 80% RH (II).

As shown in Table IV-1, the light-sensitive material according to the present invention had good electrostatic characteristics, and the duplicated image obtained thereon was clear and free from background fog. On the contrary, with the light-sensitive materials of Comparative Examples IV-1, IV-2 and IV-3 the decrease in photosensitivity ($E_{1/10+cc}$ and $E_{+c,fra\ 1/100}$) occurred, and in the duplicated images the scratches of fine lines and letters were observed and a background fog remained without removing after the rinse treatment. Further, the occurrence of unevenness in half tone areas of continuous gradation of the original was observed regardless of the electrostatic characteristics.

The value of $E_{1/100}$ is largely different between the light-sensitive material of the present invention and those of the comparative examples. The value of $E_{1/100}$ indicates an electrical potential remaining in the non-image areas after exposure at the practice of image formation. The smaller the value, the less the background fog in the non-image areas. More specifically, it is required that the remaining potential is decreased to −10 V or less. Therefore, an amount of exposure necessary to make the remaining potential below −10 V is an important factor. In the scanning exposure system using a semiconductor laser beam, it is quite important to make the remaining potential below −10 V by a small exposure amount in view of a design for an optical system of a duplicator (such as cost of the device, and accuracy of the optical system).

From all these considerations, it is thus clear that an electrophotographic light-sensitive material satisfying both requirements of electrostatic characteristics and image forming performance and being advantageously employed particularly in a scanning exposure system using a semiconductor laser beam can be obtained only using the binder resin according to the present invention.

EXAMPLE IV-2

A mixture of 6 g (solid basis) of Resin (A-113), 34 g (solid basis) of Resin (B-102), 200 g of photo-conductive zinc oxide, 0.020 g of Methine Dye (IV-II) having the following formula, 0.20 g of N-hydroxymalinimide and 300 g of toluene was treated in the same manner as described in Example IV-1 to prepare an electrophotographic light-sensitive material.

Methine Dye (IV-II)

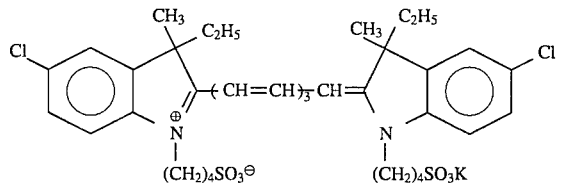

With the light-sensitive material thus-prepared, a film property in terms of surface smoothness, electrostatic characteristics and image forming performance were evaluated. Further, printing property was evaluated when it was used as an electrophotographic lithographic printing plate precursor. The results obtained are shown in Table IV-2 below.

TABLE IV-2

| | | Example IV-2 |
|---|---|---|
| Smoothness of Photoconductive Layer*4) (sec/cc) | | 210 |
| Electrostatic Characteristics | | |
| $V_{10}$ (−V) | I (20° C., 65% RH) | 675 |
| | II (30° C., 80% RH) | 660 |
| D.R.R. | I (20° C., 65% RH) | 87 |
| (90 sec value) (%) | II (30° C., 80% RH) | 83 |
| $E_{1/10}$ (erg/cm$^2$) | I (20° C., 65% RH) | 24 |
| | II (30° C., 80% RH) | 27 |
| $E_{1/100}$ (erg/cm$^2$) | I (20° C., 65% RH) | 38 |
| | II (30° C., 80% RH) | 44 |
| Image Forming Performance | I (20° C., 65% RH) | Very good |
| | II (30° C., 80% RH) | Very good |
| Contact Angle with Water*5) (°) | | 0 |
| Printing Durability*6) | | 10,000 |

The evaluation of each item shown in Table IV-2 was conducted in the following manner.

*4) Smoothness of Photoconductive Layer

The smoothness (sec/cc) of the light-sensitive material was measured using a Beck's smoothness test machine (manufactured by Kumagaya Riko K.K.) under an air volume condition of 1 cc.

*5) Contact Angle with Water

The light-sensitive material was passed once through an etching processor using a solution prepared by diluting an oil-desensitizing solution ELP-EX (produced by Fuji Photo Film Co., Ltd.) to a two-fold volume with distilled water to conduct oil-desensitization treatment on the surface of the photoconductive layer. On the thus oil-desensitized surface was placed a drop of 2 μl of distilled water, and the contact angle formed between the surface and water was measured using a goniometer.

*6) Printing Durability

The light-sensitive material was subjected to plate making in the same manner as described in *3) above to form toner images, and the surface of the photoconductive layer was subjected to oil-desensitization treatment under the same condition as in *5) above. The resulting lithographic printing plate was mounted on an offset printing machine ("Oliver Model 52", manufactured by Sakurai Seisakusho K.K.), and printing was carried out on paper. The number of prints obtained until background stains in the non-image areas appeared or the quality of the image areas was deteriorated was taken as the printing durability. The larger the number of the prints, the higher the printing durability.

As shown in Table IV-2, the light-sensitive material according to the present invention had good electrostatic characteristics, and the duplicated image obtained was clear and free from background fog in the non-image area. Also, surface smoothness and film strength of the photoconductive layer were good. These results appear to be due to sufficient adsorption of the binder resin onto the photoconductive substance and sufficient covering of the surface of the particles with the binder resin. For the same reason, when it was used as an offset master plate precursor, oil-desensitization of the offset master plate precursor with an oil-desensitizing solution was sufficient to render the non-image areas satisfactorily hydrophilic, as shown by a small contact angle of 0° with water. On practical printing using the resulting master plate, 10,000 prints of clear image without background stains were obtained.

From these results it is believed that the resin (A) and the resin (B) according to the present invention suitably interacts with zinc oxide particles to form the condition under which an oil-desensitizing reaction proceeds easily and sufficiently with an oil-desensitizing solution and that the remarkable improvement in film strength is achieved by the action of the resin (B).

EXAMPLES IV-3 TO IV-20

Each electrophotographic light-sensitive material was prepared in the same manner as described in Example IV-2, except for using each of Resins (A) and Resins (B) shown in Table IV-3 below in place of Resin (A-113) and Resin (B-102) used in Example IV-2, respectively.

TABLE IV-3

| Example | Resin (A) | Resin (B) |
|---|---|---|
| IV-3 | A-111 | B-103 |
| IV-4 | A-112 | B-105 |
| IV-5 | A-113 | B-106 |
| IV-6 | A-114 | B-107 |
| IV-7 | A-118 | B-109 |
| IV-8 | A-119 | B-110 |
| IV-9 | A-121 | B-111 |
| IV-10 | A-122 | B-113 |
| IV-11 | A-110 | B-115 |
| IV-12 | A-124 | B-116 |
| IV-13 | A-125 | B-118 |
| IV-14 | A-127 | B-119 |

TABLE IV-3-continued

| Example | Resin (A) | Resin (B) |
|---|---|---|
| IV-15 | A-128 | B-123 |
| IV-16 | A-129 | B-124 |
| IV-17 | A-130 | B-125 |
| IV-18 | A-134 | B-127 |
| IV-19 | A-133 | B-128 |
| IV-20 | A-135 | B-130 |

The electrostatic characteristics of the resulting light-sensitive materials were evaluated in the same manner as described in Example IV-2, and good results were obtained.

As a result of the evaluation on image forming performance of each light-sensitive material, it was found that clear duplicated images having good reproducibility of fine lines and letters and no occurrence of unevenness in half tone areas without the formation of background fog were obtained.

Further, when these electrophotographic light-sensitive materials were employed as offset master plate precursors under the same printing condition as described in Example IV-2, more than 10,000 good prints were obtained respectively.

It can be seen from the results described above that each of the light-sensitive materials according to the present invention was satisfactory in all aspects of the surface smoothness and film strength of the photoconductive layer, electrostatic characteristics, and printing property.

EXAMPLES IV-21 TO IV-24

Each electrophotographic light-sensitive material was prepared in the same manner as described in Example IV-1, except for using each of the dye shown in Table IV-4 below in place of Methine Dye (IV-1) used in Example IV-1.

TABLE IV-4

| Example | Dye | Chemical structure of Dye |
|---|---|---|
| IV-21 | (IV-III) | 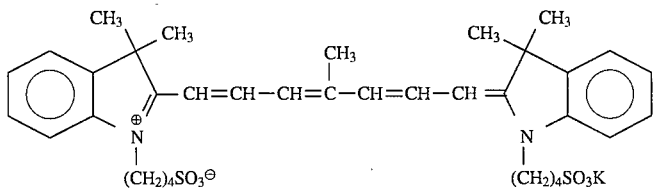 |

TABLE IV-4-continued

| Example | Dye | Chemical structure of Dye |
|---|---|---|
| IV-22 | (IV-IV) | 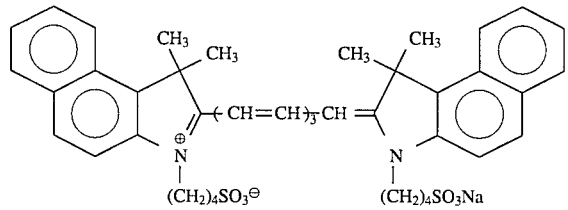 |
| IV-23 | (IV-V) | 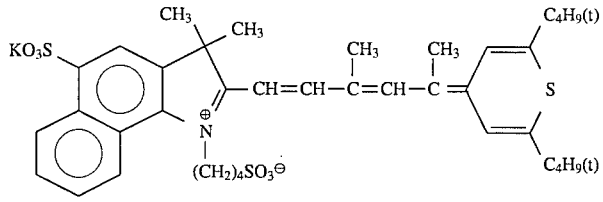 |
| IV-24 | (IV-VI) | 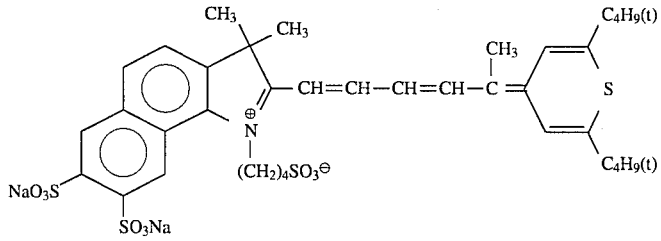 |

Each of the light-sensitive materials according to the present invention was excellent in charging properties, dark charge retention rate and photosensitivity, and provided clear duplicated images free from background fog even when processed under severe condition of high temperature and high humidity (30° C. and 80% RH).

EXAMPLES IV-25 AND IV-26

A mixture of 6.5 g of Resin (A-101) (Example IV-25) or Resin (A-120) (Example IV-26), 33.5 g of Resin (B-130), 200 g of photoconductive zinc oxide, 0.02 g of uranine, 0.035 g of Rose Bengal, 0.025 g of bromophenol blue, 0.18 g of p-hydroxybenzoic acid and 300 g of toluene was dispersed by a homogenizer at a rotation of $6\times10^3$ r.p.m. for 6 minutes to prepare a coating composition for a light-sensitive layer. The coating composition was coated on paper, which had been subjected to electrically conductive treatment, by a wire bar at a dry coverage of 25 g/m$^2$, and dried for 20 seconds at 110° C. Then, the coated material was allowed to stand in a dark place for 24 hours under the conditions of 20° C. and 65% RH to prepare each electrophotographic light-sensitive material.

Comparative Example IV-4

An electrophotographic light-sensitive material was prepared in the same manner as in Example IV-25, except for using 33.5 g of Comparative Resin (R-IV-2) described above in place of 33.5 g of Resin (B-130) used in Example IV-25.

With each of the light-sensitive materials thus prepared, various characteristics were evaluated in the same manner as in Example IV-2. The results obtained are shown in Table IV-5 below.

TABLE IV-5

| | | Example IV-25 | Example IV-26 | Comparative Example IV-4 |
|---|---|---|---|---|
| Binder Resin | | (A-101)/(B-130) | (A-120)/(B-130) | (A-101)/(R-IV-2) |
| Smoothness of Photoconductive Layer (sec/cc) | | 230 | 235 | 230 |
| Electrostatic Characteristics*7) | | | | |
| $V_{10}$ (−V) | I (20° C., 65% RH) | 595 | 725 | 700 |
| | II (30° C., 80% RH) | 580 | 710 | 680 |
| D.R.R. (%) | I (20° C., 65% RH) | 88 | 94 | 83 |
| | II (30° C., 80% RH) | 85 | 92 | 78 |
| $E_{1/10}$ (lux · sec) | I (20° C., 65% RH) | 10.5 | 8.8 | 13.4 |
| | II (30° C., 80% RH) | 11.3 | 9.4 | 14.8 |
| $E_{1/100}$ (lux · sec) | I (20° C., 65% RH) | 17 | 14 | 23 |
| | II (30° C., 80% RH) | 20 | 16 | 27 |

TABLE IV-5-continued

| | | Example IV-25 | Example IV-26 | Comparative Example IV-4 |
|---|---|---|---|---|
| Image Forming*8) Performance | I (20° C., 65% RH) | Good | Very good | Slight edge mark of cutting |
| | II (30° C., 80% RH) | Good | Very good | Unevenness in half tone area, edge mark of cutting |
| Contact Angle with Water (°) | | 0 | 0 | 0 |
| Printing Durability | | 10,000 Prints | 10,000 Prints | Background stain and unevenness of image occurred from the start of printing |

The characteristics were evaluated in the same manner as in Example IV-2, except that some electrostatic characteristics and image forming performance were evaluated according to the following test methods.

*7) Measurement of Electrostatic Characteristics: $E_{1/10+ce}$ and $E_{+c,fra\ 1/100}$ The surface of the photoconductive layer was charged to −400 V with corona discharge, and then irradiated by visible light of the illuminance of 2.0 lux. Then, the time required for decay of the surface potential ($V_{10}$) to 1/10 or 1/100 thereof was determined, and the exposure amount $E_{1/10}$ or $E_{1/100}$ (lux·sec) was calculated therefrom.

*8) Image Forming Performance

The electrophotographic light-sensitive material was allowed to stand for one day under the ambient condition described below, the light-sensitive material was subjected to plate making by a full-automatic plate making machine ELP-404V (manufactured by Fuji Photo Film Co., Ltd.) using ELP-T as a toner. The duplicated image thus obtained was visually evaluated for fog and image quality. The ambient condition at the time of image formation was 20° C. and 65% RH (I) or 30° C. and 80% RH (II). The original used for the duplication was composed of cuttings of other originals pasted up thereon.

From the results shown above, it can be seen that each light-sensitive material exhibited almost the same properties with respect to the surface smoothness of the photoconductive layer. The electrostatic characteristics of the light-sensitive materials according to the present invention were good. Particularly, those of Example IV-26 using the resin (A) having the specified substituent were very good. The value of $E_{1/100}$ thereof was particularly small.

With respect to image forming performance, the edge mark of cuttings pasted up was observed as background fog in the non-image areas in the light-sensitive material of Comparative Example IV-4. On the contrary, the light-sensitive materials according to the present invention provided clear duplicated images free from background fog.

Further, each of these light-sensitive materials was subjected to the oil-desensitizing treatment to prepare an offset printing plate and using the resulting plate printing was conducted. The plates according to the present invention provided 10,000 prints of clear image without background stains. However, with the plate of Comparative Example IV-4, the above described edge mark of cuttings pasted up was not removed with the oil-desensitizing treatment and the background stains occurred from the start of printing.

It can be seen from the results described above that only the light-sensitive materials according to the present invention can have excellent performance.

EXAMPLES IV-27 TO IV-42

Each electrophotographic light-sensitive material was prepared in the same manner as described in Example IV-25, except for using 6.5 g of each of Resin (A) and 33.5 g of each of Resin (B) shown in Table IV-6 below in place of 6.5 g of Resin (A-101) and 33.5 g of Resin (B-130) used in Example IV-25, respectively.

TABLE IV-6

| Example | Resin (A) | Resin (B) |
|---|---|---|
| IV-27 | A-101 | B-104 |
| IV-28 | A-102 | B-105 |
| IV-29 | A-103 | B-106 |
| IV-30 | A-104 | B-107 |
| IV-31 | A-106 | B-110 |
| IV-32 | A-107 | B-111 |
| IV-33 | A-109 | B-112 |
| IV-34 | A-115 | B-119 |
| IV-35 | A-116 | B-121 |
| IV-36 | A-117 | B-122 |
| IV-37 | A-121 | B-123 |
| IV-38 | A-123 | B-125 |
| IV-39 | A-124 | B-126 |
| IV-40 | A-125 | B-127 |
| IV-41 | A-129 | B-128 |
| IV-42 | A-130 | B-129 |

Each of the light-sensitive materials according to the present invention was excellent in charging properties, dark charge retention rate and photosensitivity, and provided a clear duplicated image free from background fog even under severe condition of high temperature and high humidity (30° C. and 80% RH). Further, when these materials were employed as offset master plate precursors, 10,000 prints of a clear image free from background stains were obtained respectively. Moreover, the light-sensitive materials using the resin (A) containing a methacrylate component substituted with the specific aryl group exhibited better performance.

EXAMPLE V-1

A mixture of 6 g (solid basis) of Resin (A-2), 34 g (solid basis) of Resin (B-201), 200 g of photoconductive zinc oxide, 0.018 g of Methine Dye (V-1) having the following structure, 0.15 g of phthalic anhydride and 300 g of toluene was dispersed by a homogenizer (manufactured by Nippon Seiki K.K.) at a rotation of $7\times10^3$ r.p.m. for 10 minutes to prepare a coating composition for a light-sensitive layer. The coating composition was coated on paper, which had been subjected to electrically conductive treatment, by a wire bar at a dry coverage of 25 g/m$^2$, followed by drying at 110° C. for 10 seconds. The coated material was then allowed to stand in a dark place at 20° C. and 65% RH (relative humidity) for 24 hours to prepare an electrophotographic light-sensitive material.

Methine Dye (V-1)

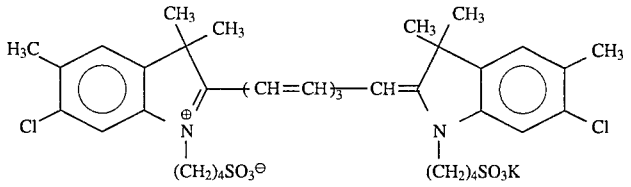

Comparative Example V-1

An electrophotographic light-sensitive material was prepared in the same manner as in Example V-1, except for using 34 g of Resin (R-V-1) having the following structure in place of 34 g of Resin (B-201) used in Example V-1.

Comparative Resin (R-V-1)

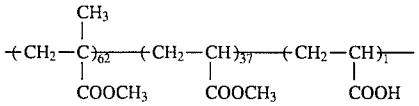

Mw: $7 \times 10^4$ (random copolymer)

Comparative Example V-2

An electrophotographic light-sensitive material was prepared in the same manner as in Example V-1, except for using 34 g of Resin (R-V-2) shown below in place of 34 g of Resin (B-201) used in Example V-1.

Comparative Resin (R-V-2)

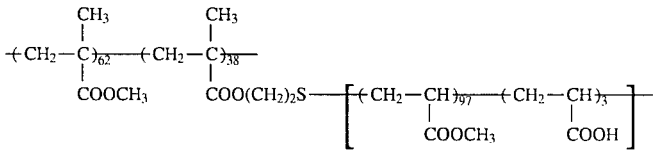

Mw: $7.5 \times 10^4$ (graft copolymer)

With each of the light-sensitive material thus prepared, electrostatic characteristics and image forming performance were evaluated. The results obtained are shown in Table V-1 below.

TABLE V-1

| | Example V-1 | Comparative Example V-1 | Comparative Example V-2 |
|---|---|---|---|
| Electrostatic*1) Characteristics $V_{10}$ (−V) | | | |
| I (20° C., 65% RH) | 740 | 690 | 700 |
| II (30° C., 80% RH) | 725 | 665 | 680 |
| III (15° C., 30% RH) | 755 | 700 | 710 |
| D.R.R. (90 sec value) (%) | | | |
| I (20° C., 65% RH) | 88 | 87 | 88 |
| II (30° C., 80% RH) | 83 | 81 | 81 |
| III (15° C., 30% RH) | 87 | 87 | 87 |
| $E_{1/100}$ (erg/cm$^2$) | | | |
| I (20° C., 65% RH) | 20 | 28 | 23 |
| II (30° C., 80% RH) | 19 | 26.5 | 21 |
| III (15° C., 30% RH) | 26 | 33 | 28 |

TABLE V-1-continued

| | Example V-1 | Comparative Example V-1 | Comparative Example V-2 |
|---|---|---|---|
| Image Forming*2) Performance | | | |
| I (20° C., 65% RH) | Very good | Good | Good |
| II (30° C., 80% RH) | Good | Unevenness in half tone area, slight background fog | Unevenness in half tone area, slight background fog |
| III (15° C., 30% RH) | Good | White spots in image portion | White spots in image portion |

The evaluation of each item shown in Table V-1 was conducted in the following manner.

*1) Electrostatic Characteristics

The light-sensitive material was charged with a corona discharge to a voltage of −6 kV for 20 seconds in a dark room at a temperature of 20° C. and at 65% RH using a paper analyzer ("Paper Analyzer SP-428" manufactured by Kawaguchi Denki K.K.). Ten seconds after the corona discharge, the surface potential $V_{10}$ was measured. The sample was then allowed to stand in the dark for an additional 90 seconds, and the potential $V_{100}$ was measured. The dark charge retention rate (DRR; %), i.e., percent retention of potential after dark decay for 90 seconds, was calculated from the following equation:

$$DRR\ (\%)=(V_{100}/V_{10})\times 100$$

Separately, the surface of photoconductive layer was charged to −400 V with a corona discharge and then exposed to light emitted from a gallium-aluminum-arsenic semiconductor laser (oscillation wavelength: 780 nm), and the time required for decay of the surface potential $V_{10}$ to one-tenth was measured, and the exposure amount $E_{1/10}$ (erg/cm$^2$) was calculated therefrom. The measurements were conducted under ambient condition of 20° C. and 65% RH (I), 30° C. and 80% RH (II) or 15° C. and 30% RH (III).

*2) Image Forming Performance

After the light-sensitive material was allowed to stand for one day under the ambient condition shown below, the light-sensitive material was charged to −6 kV and exposed to light emitted from a gallium-aluminum-arsenic semiconductor laser (oscillation wavelength: 780 nm; output: 2.8 mW) at an exposure amount of 64 erg/cm$^2$ (on the surface of the photoconductive layer) at a pitch of 25 μm and a scanning speed of 300 m/sec. The thus formed electrostatic latent image was developed with a liquid developer ELP-T (produced by Fuji Photo Film Co., Ltd.), washed with a rinse solution of iso-paraffinic solvent Isopar G (manufactured by Esso Chemical K.K.) and fixed. The duplicated image obtained was visually evaluated for fog and image quality. The ambient condition at the time of image formation was 20° C. and 65% RH (I), 30° C. and 80% RH (II) or 15° C. and 30% RH (III).

As can be seen from the results shown in Table V-1, the light-sensitive material according to the present invention exhibited good electrostatic characteristics and provided duplicated image which was clear and free from background fog, even when the ambient condition was fluctuated. On the contrary, while the light-sensitive materials of Comparative Examples V-1 and V-2 exhibited good image forming performance under the ambient condition of normal temperature and normal humidity (I), the occurrence of unevenness of density was observed in the highly accurate image portions, in particular, half tone areas of continuous gradation under the ambient condition of high temperature and high humidity (II) regardress of the electrostatic characteristics. Also a slight background fog remained without removing after the rinse treatment. Further, the occurrence of unevenness of small white spots at random in the image portion was observed under the ambient condition of low temperature and low temperature (III).

From all these considerations, it is thus clear that an electrophotographic light-sensitive material satisfying both requirements of electrostatic characteristics and image forming performance (in particular, for highly accurate image) and being advantageously employed particularly in a scanning exposure system using a semiconductor conductor laser beam can be obtained only using the binder resin according to the present invention.

EXAMPLE V-2

A mixture of 5 g (solid basis) of Resin (A-23), 35 g (solid basis) of Resin (B-202), 200 g of photo-conductive zinc oxide, 0.020 g of Methine Dye (V-II) having the following structure, 0.23 g of N-hydroxyphthalimide and 300 g of toluene was treated in the same manner as described in Example V-1 to prepare an electrophotographic light-sensitive material.

Methine Dye (V-II)

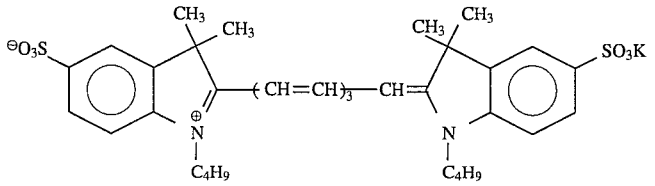

Comparative Example V-3

An electrophotographic light-sensitive material was prepared in the same manner as in Example V-2, except for using 35 g of Resin (R-V-3) having the following structure in place of 35 g of Resin (B-202) used in Example V-2.

Comparative Resin (R-V-3)

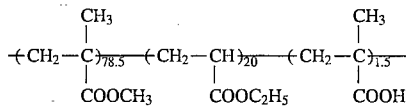

Mw: 6.5 × 10$^4$ (random copolymer)

Comparative Example V-4

An electrophotographic light-sensitive material was prepared in the same manner as in Example V-2, except for using 35 g of Resin (R-V-4) having the following structure in place of 35 g of Resin (B-202) used in Example V-2.

Comparative Resin (R-V-4)

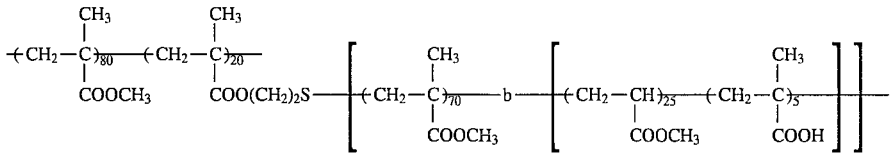

Mw: 5.5 × 10$^4$ (graft copolymer)
—b— represents a bond between blocks.

With each of the light-sensitive materials thus-prepared, a film property in terms of surface smoothness, mechanical strength, electrostatic characteristics and image forming performance were evaluated. Further, printing property was evaluated when it was used as an electrophotographic lithographic printing plate precursor. The results obtained are shown in Table V-2 below.

TABLE V-2

| | | Example V-2 | Comparative Example V-3 | Comparative Example V-4 |
|---|---|---|---|---|
| Smoothness of Photoconductive*3) Layer (sec/cc) | | 430 | 435 | 425 |
| Mechanical Strength of*4) Photoconductive Layer (%) | | 90 | 75 | 83 |
| Electrostatic Characteristics | | | | |
| $V_{10}$ (−V) | I (20° C., 65% RH) | 675 | 645 | 650 |
| | II (30° C., 80% RH) | 660 | 625 | 635 |
| | III (15° C., 30% RH) | 685 | 655 | 660 |
| D.R.R. (%) (90 sec value) | I (20° C., 65% RH) | 88 | 80 | 84 |
| | II (30° C., 80% RH) | 84 | 75 | 79 |
| | III (15° C., 30% RH) | 87 | 81 | 81 |
| $E_{1/10}$ (erg/cm$^2$) | I (20° C., 65% RH) | 23 | 28 | 25 |
| | II (30° C., 80% RH) | 20 | 24 | 23 |
| | III (15° C., 30% RH) | 29 | 35 | 31 |
| Image Forming Performance | I (20° C., 65% RH) | Good | Good | Good |
| | II (30° C., 80% RH) | Good | Unevenness in half tone area | Slight unevenness in half tone area |
| | III (15° C., 30% RH) | Good | Unevenness in half tone area, unevenness of white spots in image portion | Unevenness in half tone area, unevenness of white spots in image portion |
| Water Retentivity of*5) Light-Sensitive Material | | No background stain at all | Background stain | Slight background stain |
| Printing Durability*6) | | 10,000 Prints | 4,500 Prints | 6,000 Prints |

The evaluation of each item shown in Table V-2 was conducted in the following manner.

*3) Smoothness of Photoconductive Layer

The smoothness (sec/cc) of the light-sensitive material was measured using a Beck's smoothness test machine (manufactured by Kumagaya Riko K.K.) under an air volume condition of 1 cc.

*4) Mechanical Strength of Photoconductive Layer

The surface of the light-sensitive material was repeatedly (1000 times) rubbed with emery paper (#1000) under a load of 75 g/cm$^2$ using a Heidon 14 Model surface testing machine (manufactured by Shinto Kagaku K.K.). After dusting, the abrasion loss of the photoconductive layer was measured to obtain film retention (%).

*5) Water Retentivity of Light-Sensitive Material

A light-sensitive material without subjecting to plate making was passed twice through an etching processor using an aqueous solution obtained by diluting an oil-desensitizing solution ELP-EX (produced by Fuji Photo Film Co., Ltd.) to a five-fold volume with distilled water to conduct an oil-desensitizing treatment of the surface of the photoconductive layer. The material thus-treated was mounted on an offset printing machine ("611XLA-II Model" manufactured by Hamada Printing Machine Manufacturing Co.) and printing was conducted using distilled water as dampening water. The extent of background stain occurred on the 50th print was visually evaluated. This testing method corresponds to evaluation of water retentivity after oil-desensitizing treatment of the light-sensitive material under the forced condition.

*6) Printing Durability

The light-sensitive material was subjected to plate making in the same manner as described in *2) above to form toner images, and the surface of the photoconductive layer was subjected to oil-desensitization treatment by passing twice through an etching processor using ELP-EX. The resulting lithographic printing plate was mounted on an offset printing machine ("Oliver Model 52", manufactured by Sakurai Seisakusho K.K.), and printing was carried out on paper. The number of prints obtained until background stains in the non-image areas appeared or the quality of the image areas was deteriorated was taken as the printing durability. The larger the number of the prints, the higher the printing durability.

As shown in Table V-2, the light-sensitive material according to the present invention had good surface smoothness, film strength and electrostatic characteristics of the photoconductive layer. The duplicated image obtained was clear and free from background fog in the non-image area. These results appear to be due to sufficient adsorption of the binder resin onto the photoconductive substance and sufficient covering of the surface of the particles with the binder resin. For the same reason, when it was used as an offset master plate precursor, oil-desensitization of the offset master plate precursor with an oil-desensitizing solution was sufficient to render the non-image areas satisfactorily hydrophilic and adhesion of ink was not observed at all as a result of the evaluation of water retentivity under the forced condition. On practical printing using the resulting master plate, 10,000 prints of clear image without background stains were obtained.

On the contrary, with the light-sensitive materials of Comparative Examples V-3 and V-4, the occurrence of slight background stain in non-image area, unevenness in highly accurate image of continuous gradation and unevenness of white spots in image portion was observed when the image formation was conducted under severe conditions. Further, as a result of the test on water retentivity of these light-sensitive materials to make offset master plates, the adhesion of ink was observed. The printing durability thereof was in a range of from 4,000 to 6,000.

From these results it is believed that the resin (A) and the resin (B) according to the present invention suitably interacts with zinc oxide particles to form the condition under which an oil-desensitizing reaction proceeds easily and sufficiently with an oil-desensitizing solution and that the remarkable improvement in film strength is achieved by the action of the resin (B).

EXAMPLES V-3 TO V-22

Each electrophotographic light-sensitive material was prepared in the same manner as described in Example V-2, except for using each of Resins (A) and each of Resins (B) shown in Table V-3 below in place of Resin (A-23) and Resin (B-202) used in Example V-2, respectively.

TABLE V-3

| Example | Resin (A) | Resin (B) |
|---|---|---|
| V-3 | A-6 | B-203 |
| V-4 | A-7 | B-204 |
| V-5 | A-8 | B-201 |
| V-6 | A-9 | B-205 |
| V-7 | A-11 | B-206 |
| V-8 | A-12 | B-207 |
| V-9 | A-14 | B-208 |
| V-10 | A-15 | B-209 |
| V-11 | A-17 | B-211 |
| V-12 | A-18 | B-212 |
| V-13 | A-21 | B-213 |
| V-14 | A-22 | B-215 |
| V-15 | A-23 | B-216 |
| V-16 | A-24 | B-218 |
| V-17 | A-25 | B-220 |
| V-18 | A-26 | B-221 |
| V-19 | A-27 | B-223 |
| V-20 | A-22 | B-224 |
| V-21 | A-28 | B-226 |
| V-22 | A-29 | B-219 |

The electrostatic characteristics and image forming performance of each of the light-sensitive materials were determined in the same manner as described in Example V-1. Each light-sensitive material exhibited good electrostatic characteristics. As a result of the evaluation on image forming performance of each light-sensitive material, it was found that clear duplicated images having good reproducibility of fine lines and letters and no occurrence of unevenness in half tone areas without the formation of background fog were obtained.

Further, when these electrophotographic light-sensitive materials were employed as offset master plate precursors under the same printing condition as described in Example V-2, more than 10,000 good prints were obtained respectively.

It can be seen from the results described above that each of the light-sensitive materials according to the present invention was satisfactory in all aspects of the surface smoothness and film strength of the photoconductive layer, electrostatic characteristics and printing property.

EXAMPLES V-23 TO V-26

Each electrophotographic light-sensitive material was prepared in the same manner as described in Example V-1, except for using each of the dye shown in Table V-4 below in place of Methine Dye (V-1) used in Example V-1.

TABLE V-4

| Example | Dye | Chemical Structure of Dye |
|---|---|---|
| V-23 | (V-III) | 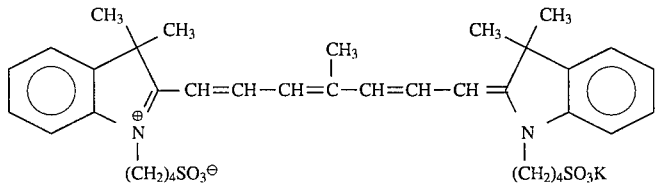 |
| V-24 | (V-IV) | 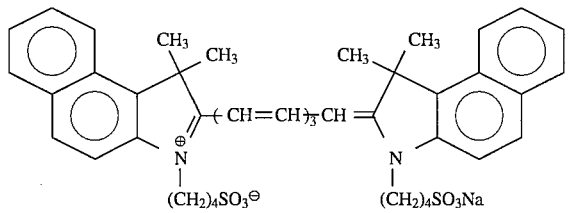 |
| V-25 | (V-V) | 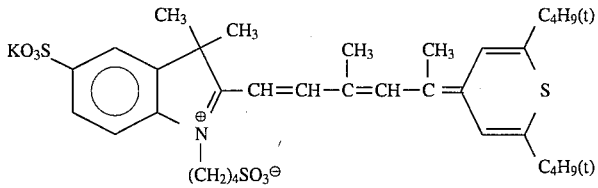 |

TABLE V-4-continued

| Example | Dye | Chemical Structure of Dye |
|---|---|---|
| V-26 | (V-VI) | 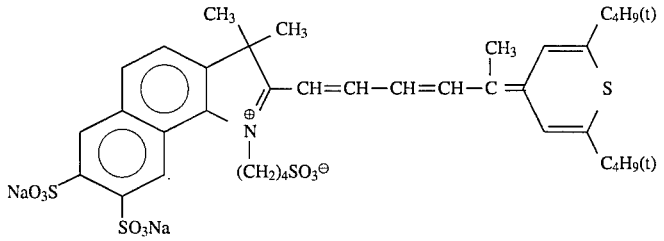 |

Each of the light-sensitive materials according to the present invention was excellent in charging properties, dark charge retention rate and photosensitivity, and provided clear duplicated images free from background fog even when processed under severe conditions of high temperature and high humidity (30° C. and 80% RH) and low temperature and low humidity (15° C. and 30% RH).

EXAMPLES V-27 AND V-28

A mixture of 6.5 g of Resin (A-1) (Example V-27) or Resin (A-9) (Example V-28), 33.5 g of Resin (B-224), 200 g of photoconductive zinc oxide, 0.02 g of uranine 0.03 g of Methine Dye (V-VII) having the following structure, 0.03 g of Methine Dye (V-VIII) having the following structure, 0.18 g of p-hydroxybenzoic acid and 300 g of toluene was dispersed by a homogenizer at a rotation of $7\times10^3$ r.p.m. for 10 minutes to prepare a coating composition for a light-sensitive layer. The coating composition was coated on paper, which had been subjected to electrically conductive treatment, by a wire bar at a dry coverage of 25 g/m$^2$, and dried for 20 seconds at 110° C. Then, the coated material was allowed to stand in a dark place for 24 hours under the conditions of 20° C. and 65% RH to prepare each electrophotographic light-sensitive material.

Methine Dye (V-VII)

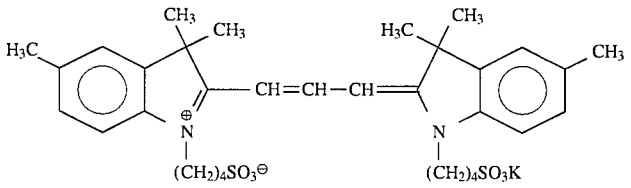

Methine Dye (V-VIII)

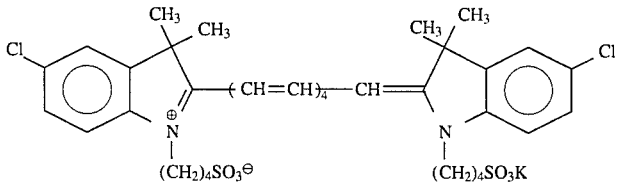

Comparative Example V-5

An electrophotographic light-sensitive material was prepared in the same manner as in Example V-27, except for using 33.5 g of Resin (R-V-5) shown below in place of 33.5 g of Resin (B-224) used in Example V-27.

Comparative Resin (R-V-5)

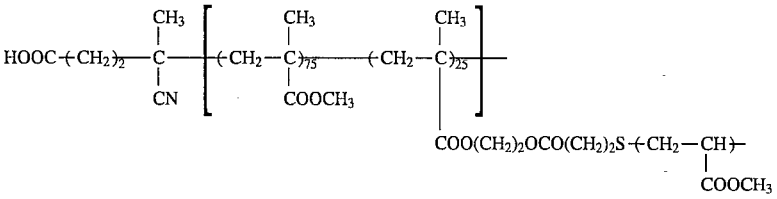

Mw: $7.5 \times 10^4$

With each of the light-sensitive materials thus prepared, various characteristics were evaluated in the same manner as in Example V-2. The results obtained are shown in Table V-5 below.

From the results, it can be seen that each of the light-sensitive materials according to the present invention exhibited good mechanical strength of the photoconductive layer. On the contrary, with the light-sensitive material of Comparative Example V-5 the value of mechanical strength was lower than them, and the value of $E_{1/10}$ of electrostatic characteristics degraded particularly under the ambient condition of low temperature and low humidity (III), while they were good under the ambient condition of normal temperature and normal humidity (I). On the other hand, the electrostatic characteristics of the light-sensitive materials according to the present invention were good. Particularly, those of Example V-28 using the resin (A) having the specified substituent were very good. The value of $E_{1/100}$ thereof was particularly small.

TABLE V-5

| | | Example V-27 | Example V-28 | Comparative Example V-5 |
|---|---|---|---|---|
| Binder Resin | | (A-1)/(B-224) | (A-9)/(B-224) | (A-1)/(R-V-5) |
| Smoothness of Photoconductive Layer (sec/cc) | | 425 | 435 | 420 |
| Mechanical Strength of Photoconductive Layer (%) | | 90 | 92 | 78 |
| Electrostatic Characteristics*7) | | | | |
| $V_{10}$ (−V) | I (20° C., 65% RH) | 625 | 745 | 595 |
| | II (30° C., 80% RH) | 610 | 725 | 575 |
| | III (15° C., 30% RH) | 640 | 760 | 605 |
| D.R.R. (%) | I (20° C., 65% RH) | 90 | 96 | 88 |
| | II (30° C., 80% RH) | 86 | 93 | 83 |
| | III (15° C., 30% RH) | 91 | 97 | 88 |
| $E_{1/10}$ (lux · sec) | I (20° C., 65% RH) | 10.3 | 8.8 | 13.4 |
| | II (30° C., 80% RH) | 9.6 | 8.5 | 12.7 |
| | III (15° C., 30% RH) | 11.2 | 9.6 | 15.0 |
| Image Forming*8) Performance | I (20° C., 65% RH) | Good | Very good | Good |
| | II (30° C., 80% RH) | Good | Very good | Edge mark of cutting, unevenness in half tone area |
| | III (15° C., 30% RH) | Good | Very good | Edge mark of cutting, unevenness in image portion |
| Water Retentivity of Light-Sensitive Material | | Good | Good | Slight background stain |
| Printing Durability | | 10,000 Prints | 10,000 Prints | Background stain from the start of printing |

The characteristics were evaluated in the same manner as in Example V-2, except that some electrostatic characteristics and image forming performance were evaluated according to the following test methods.

*7) Electrostatic Characteristics: $E_{1/10}$

The surface of the photoconductive layer was charged to −400 V with corona discharge, and then irradiated by visible light of the illuminance of 2.0 lux. Then, the time required for decay of the surface potential ($V_{10}$) to 1/10 thereof was determined, and the exposure amount $E_{1/10}$ (lux·sec) was calculated therefrom.

*8) Image Forming Performance

The electrophotographic light-sensitive material was allowed to stand for one day under the ambient condition described below, the light-sensitive material was subjected to plate making by a full-automatic plate making machine ELP-404V (manufactured by Fuji Photo Film Co., Ltd.) using ELP-T as a toner. The duplicated image thus obtained was visually evaluated for fog and image quality. The ambient condition at the time of image formation was 20° C. and 65% RH (I), 30° C. and 80% RH (II) or 15° C. and 30% RH (III). The original used for the duplication was composed of cuttings of other originals pasted up thereon.

With respect to image forming performance, the edge mark of cuttings pasted up was observed as background fog in the non-image areas in the light-sensitive material of Comparative Example V-5. Also the occurrence of unevenness in half tone area of continuous gradation and unevenness of small white spots in image portion were observed on the duplicated image when the ambient conditions at the time of the image formation were high temperature and high humidity (II) and low temperature and low humidity (III).

Further, each of these light-sensitive materials was subjected to the oil-desensitizing treatment to prepare an offset printing plate and using the resulting plate printing was conducted. The plates according to the present invention provided 10,000 prints of clear image without background stains. However, with the plate of Comparative Example V-5, the above described edge mark of cuttings pasted up was not removed with the oil-desensitizing treatment and the background stains occurred from the start of printing.

It can be seen from the results described above that only the light-sensitive materials according to the present invention could provide excellent performance.

EXAMPLE V-29

A mixture of 5 g of Resin (A-7), 35 g of Resin (B-208), 200 g of photoconductive zinc oxide, 0.02 g of uranine, 0.04 g of Rose Bengal, 0.03 g of bromophenol blue, 0.40 g of phthalic anhydride and 300 g of toluene was treated in the same manner as described in Example V-28 to prepare an electrophotographic light-sensitive material.

As the result of the evaluation of various characteristics in the same manner as described in Example V-28, it can be seen that the light-sensitive material according to the present invention is excellent in charging properties, dark charge retention rate and photosensitivity, and provides a clear duplicated image free from background fog under severe conditions of high temperature and high humidity (30° C. and 80% RH) and low temperature and low humidity (15° C. and 30% RH). Further, when the material was employed as an offset master plate precursor, 10,000 prints of clear image were obtained.

EXAMPLES V-30 TO V-53

Each electrophotographic light-sensitive material was prepared in the same manner as described in Example V-29, except for using 5 g of each of Resin (A) and 35 g of each of Resin (B) shown in Table V-6 below in place of 5 g of Resin (A-7) and 35 g of Resin (B-208) used in Example V-29, respectively.

TABLE V-6

| Example | Resin (A) | Resin (B) |
|---|---|---|
| V-30 | A-1 | B-206 |
| V-31 | A-3 | B-201 |
| V-32 | A-4 | B-202 |
| V-33 | A-5 | B-204 |
| V-34 | A-6 | B-205 |
| V-35 | A-9 | B-206 |
| V-36 | A-10 | B-208 |
| V-37 | A-11 | B-210 |
| V-38 | A-12 | B-212 |
| V-39 | A-13 | B-214 |
| V-40 | A-17 | B-217 |
| V-41 | A-19 | B-219 |
| V-42 | A-21 | B-220 |
| V-43 | A-22 | B-221 |

TABLE V-6-continued

| Example | Resin (A) | Resin (B) |
|---|---|---|
| V-44 | A-24 | B-222 |
| V-45 | A-25 | B-223 |
| V-46 | A-26 | B-224 |
| V-47 | A-27 | B-225 |
| V-48 | A-28 | B-226 |
| V-49 | A-29 | B-208 |
| V-50 | A-14 | B-214 |
| V-51 | A-16 | B-215 |
| V-52 | A-23 | B-216 |
| V-53 | A-27 | B-218 |

Each of the light-sensitive materials according to the present invention was excellent in charging properties, dark charge retention rate and photosensitivity, and provided a clear duplicated image free from background fog and scratches of fine lines even under severe conditions of high temperature and high humidity (30° C. and 80% RH) and low temperature and low humidity (15° C. and 30% RH). Further, when these materials were employed as offset master plate precursors, 10,000 prints of a clear image free from background stains were obtained respectively.

EXAMPLE VI-1

A mixture of 6 g (solid basis) of Resin (A-108), 34 g (solid basis) of Resin (B-201), 200 g of photo-conductive zinc oxide, 0.018 g of Methine Dye (VI-1) having the following structure, 0.10 g of phthalic anhydride and 300 g of toluene was dispersed by a homogenizer (manufactured by Nippon Seiki K.K.) at a rotation of $6\times10^3$ r.p.m. for 8 minutes to prepare a coating composition for a light-sensitive layer. The coating composition was coated on paper, which had been subjected to electrically conductive treatment, by a wire bar at a dry coverage of 20 g/m$^2$, followed by drying at 110° C. for 10 seconds. The coated material was then allowed to stand in a dark place at 20° C. and 65% RH for 24 hours to prepare an electrophotographic light-sensitive material.

Methine Dye (VI-1)

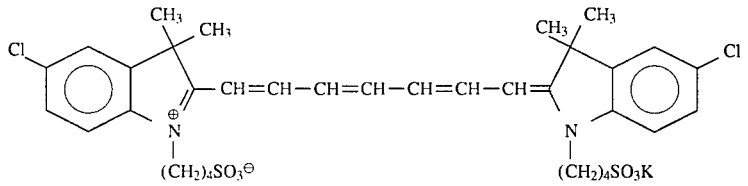

Comparative Example VI-1

An electrophotographic light-sensitive material was prepared in the same manner as in Example VI-1, except for using 34 g of Resin (R-VI-1) shown below in place of 34 g of Resin (B-201) used in Example VI-1.

Comparative Resin (R-VI-1)

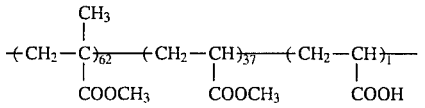

Mw: $7\times10^4$ (random copolymer)

Comparative Example VI-2

An electrophotographic light-sensitive material was prepared in the same manner as in Example VI-1, except for using 34 g of Resin (R-VI-2) shown below in place of 34 g of Resin (B-201) used in Example VI-1.

Comparative Resin (R-VI-2)

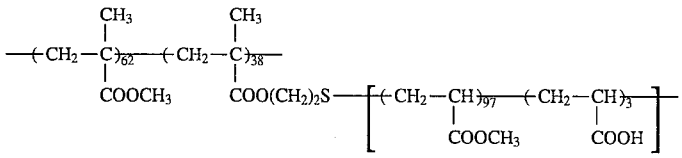

Mw: $7.5 \times 10^4$ (graft copolymer)

With each of the light-sensitive material thus prepared, electrostatic characteristics and image forming performance were evaluated. The results obtained are shown in Table VI-1 below.

TABLE VI-1

| | Example VI-1 | Comparative Example VI-1 | Comparative Example VI-2 |
|---|---|---|---|
| Electrostatic*1) Characteristics $V_{10}$ (−V) | | | |
| I (20° C., 65% RH) | 760 | 730 | 750 |
| II (30° C., 80% RH) | 745 | 700 | 730 |
| III (15° C., 30% RH) | 765 | 740 | 750 |
| D.R.R. (90 sec value) (%) | | | |
| I (20° C., 65% RH) | 88 | 83 | 85 |
| II (30° C., 80% RH) | 83 | 78 | 80 |
| III (15° C., 30% RH) | 88 | 84 | 84 |
| $E_{1/10}$ (erg/cm$^2$) | | | |
| I (20° C., 65% RH) | 20 | 28 | 24 |
| II (30° C., 80% RH) | 23 | 26 | 26 |
| III (15° C., 30% RH) | 25 | 31 | 30 |
| Image Forming*2) Performance | | | |
| I (20° C., 65% RH) | Good | Good | Good |
| II (30° C., 80% RH) | Good | Unevenness in half tone area | Unevenness in half tone area |
| III (15° C., 30% RH) | Good | Unevenness in half tone area, white spots in image portion | Unevenness in half tone area, white spots in image portion |

The evaluation of each item shown in Table VI-1 was conducted in the following manner.

*1) Electrostatic Characteristics

The light-sensitive material was charged with a corona discharge to a voltage of −6 kV for 20 seconds in a dark room using a paper analyzer ("Paper Analyzer SP- 428" manufactured by Kawaguchi Denki K.K.). Ten seconds after the corona discharge, the surface potential $V_{10}$ was measured. The sample was then allowed to stand in the dark for an additional 90 seconds, and the potential $V_{100}$ was measured. The dark charge retention rate (DRR; %), i.e., percent retention of potential after dark decay for 90 seconds, was calculated from the following equation:

$$DRR\ (\%)=(V_{100}/V_{10})\times 100$$

Separately, the surface of photoconductive layer was charged to −400 V with a corona discharge and then exposed to light emitted from a gallium-aluminum-arsenic semiconductor laser (oscillation wavelength: 780 nm), and the time required for decay of the surface potential $V_{10}$ to one-tenth was measured, and the exposure amount $E_{1/10}$ (erg/cm$^2$) was calculated therefrom. The measurements were conducted under ambient condition of 20° C. and 65% RH (I), 30° C. and 80% RH (II) or 15° C. and 30% RH (III).

*2) Image Forming Performance

After the light-sensitive material was allowed to stand for one day under the ambient condition shown below, the light-sensitive material was charged to −6 kV and exposed to light emitted from a gallium-aluminum-arsenic semiconductor laser (oscillation wavelength: 780 nm; output: 2.8 mW) at an exposure amount of 64 erg/cm$^2$ (on the surface of the photoconductive layer) at a pitch of 25 μm and a scanning speed of 300 m/sec. The thus formed electrostatic latent image was developed with a liquid developer ELP-T (produced by Fuji Photo Film Co., Ltd.), washed with a rinse solution of iso-paraffinic solvent Isopar G (manufactured by Esso Chemical K.K.) and fixed. The duplicated image obtained was visually evaluated for fog and image quality. The ambient condition at the time of image formation was 20° C. and 65% RH (I), 30° C. and 80% RH (II) or 15° C. and 30% RH (III).

As shown in Table VI-1, the light-sensitive material according to the present invention exhibited good electrostatic characteristics and provided duplicated image which was clear and free from background fog, even when the ambient condition was fluctuated. On the contrary, while the light-sensitive materials of Comparative Examples VI-1 and VI-2 exhibited good image forming performance under the ambient condition of normal temperature and normal humidity (I), the occurrence of unevenness of density was observed in the highly accurate image portions, in particular, half tone areas of continuous gradation under the ambient condition of high temperature and high humidity (II) regardless of the electrostatic characteristics. Also a slight background fog remained without removing after the rinse treatment. Further, the occurrence of unevenness of small white spots at random in the image portion was observed under the ambient condition of low temperature and low temperature (III).

From all these considerations, it is thus clear that an electrophotographic light-sensitive material satisfying both requirements of electrostatic characteristics and image forming performance (in particular, for highly accurate image) and being advantageously employed particularly in a scanning exposure system using a semi-conductor laser beam can be obtained only using the binder resin according to the present invention.

EXAMPLE VI-2

A mixture of 5 g (solid basis) of Resin (A-111), 35 g (solid basis) of Resin (B-202), 200 g of photo-conductive zinc oxide, 0.020 g of Methine Dye (VI-II) having the following structure, 0.20 g of N-hydroxymalinimide and 300 g of toluene was treated in the same manner as described in Example VI-1 to prepare an electrophotographic light-sensitive material.

Methine Dye (VI-II)

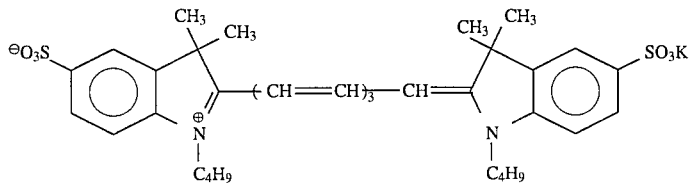

Comparative Example VI-3

An electrophotographic light-sensitive material was prepared in the same manner as in Example VI-2, except for using 35 g of Resin (R-VI-3) having the following structure in place of 35 g of Resin (B-202) used in Example VI-2.

Comparative Resin (R-VI-3)

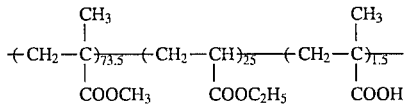

Mw: $6.5 \times 10^4$ (random copolymer)

Comparative Example VI-4

An electrophotographic light-sensitive material was prepared in the same manner as in Example VI-2, except for using 35 g of Resin (R-VI-4) having the following structure in place of 35 g of Resin (B-202) used in Example VI-2.

Comparative Resin (R-VI-4)

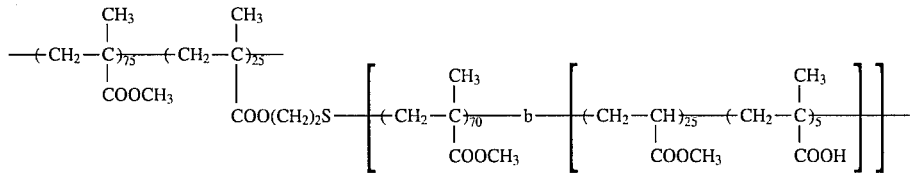

Mw: $5.5 \times 10^4$ (graft copolymer)
—b— represents a bond between blocks.

With each of the light-sensitive materials thus-prepared, a film property in terms of surface smoothness, mechanical strength, electrostatic characteristics and image forming performance were evaluated. Further, printing property was evaluated when it was used as an electrophotographic lithographic printing plate precursor. The results obtained are shown in Table VI-2 below.

TABLE VI-2

| | | Example VI-2 | Comparative Example VI-3 | Comparative Example VI-4 |
|---|---|---|---|---|
| Smoothness of Photoconductive*3) Layer (sec/cc) | | 400 | 410 | 405 |
| Mechanical Strength of*4) Photoconductive Layer (%) | | 92 | 85 | 88 |
| Electrostatic Characteristics | | | | |
| $V_{10}$ (−V) | I (20° C., 65% RH) | 760 | 710 | 725 |
| | II (30° C., 80% RH) | 750 | 680 | 700 |
| | III (15° C., 30% RH) | 770 | 715 | 730 |

TABLE VI-2-continued

| | | Example VI-2 | Comparative Example VI-3 | Comparative Example VI-4 |
|---|---|---|---|---|
| D.R.R. (%) (90 sec value) | I (20° C., 65% RH) | 86 | 81 | 84 |
| | II (30° C., 80% RH) | 82 | 77 | 80 |
| | III (15° C., 30% RH) | 85 | 82 | 83 |
| $E_{1/10}$ (erg/cm$^2$) | I (20° C., 65% RH) | 25 | 31 | 26 |
| | II (30° C., 80% RH) | 27 | 35 | 28 |
| | III (15° C., 30% RH) | 30 | 40 | 30 |
| Image Forming Performance | I (20° C., 65% RH) | Good | Good | Good |
| | II (30° C., 80% RH) | Good | Unevenness in half tone area | Unevenness in half tone area |
| | III (15° C., 30% RH) | Good | Unevenness in half tone area, unevenness of white spots in image portion | Unevenness in half tone area, unevenness of white spots in image portion |
| Water Retentivity of*5) Light-Sensitive Material | | Good | Slight background stain | Slight background stain |
| Printing Durability*6) | | 10,000 Prints | Scratches of image occurred from the start of printing | Scratches of image occurred from the start of printing |

The evaluation of each item shown in Table VI-2 was conducted in the following manner.

*3) Smoothness of Photoconductive Layer

The smoothness (sec/cc) of the light-sensitive material was measured using a Beck's smoothness test machine (manufactured by Kumagaya Riko K.K.) under an air volume condition of 1 cc.

*4) Mechanical Strength of Photoconductive Layer

The surface of the light-sensitive material was repeatedly (1000 times) rubbed with emery paper (#1000) under a load of 75 g/cm$^2$ using a Heidon 14 Model surface testing machine (manufactured by Shinto Kagaku K.K.). After dusting, the abrasion loss of the photoconductive layer was measured to obtain film retention (%).

*5) Water Retentivity of Light-Sensitive Material

A light-sensitive material without subjecting to plate making was passed twice through an etching processor using an aqueous solution obtained by diluting an oil-desensitizing solution ELP-EX (produced by Fuji Photo Film Co., Ltd.) to a seven-fold volume with distilled water to conduct an oil-desensitizing treatment of the surface of the photoconductive layer. The material thus-treated was mounted on an offset printing machine ("611XLA-II Model" manufactured by Hamada Printing Machine Manufacturing Co.) and printing was conducted using distilled water as dampening water. The extent of background stain occurred on the 50th print was visually evaluated. This tesing method corresponds to evaluation of water retentivity after oil-desensitizing treatment of the light-sensitive material under the forced condition.

*6) Printing Durability

The light-sensitive material was subjected to plate making in the same manner as described in *2) above to form toner images, and the surface of the photoconductive layer was subjected to oil-desensitization treatment by passing twice through an etching processor using ELP-EX. The resulting lithographic printing plate was mounted on an offset printing machine ("Oliver Model 52", manufactured by Sakurai Seisakusho K.K.), and printing was carried out on paper. The number of prints obtained until background stains in the non-image areas appeared or the quality of the image areas was deteriorated was taken as the printing durability. The larger the number of the prints, the higher the printing durability.

As shown in Table VI-2, the light-sensitive material according to the present invention had good surface smoothness, film strength and electrostatic characteristics of the photoconductive layer, and the duplicated image obtained was clear and free from background fog in the non-image area. These results appear to be due to sufficient adsorption of the binder resin onto the photoconductive substance and sufficient covering of the surface of the particles with the binder resin. For the same reason, when it was used as an offset master plate precursor, oil-desensitization of the offset master plate precursor with an oil-desensitizing solution was sufficient to render the non-image areas satisfactorily hydrophilic and adhesion of ink was not observed at all as a result of the evaluation of water retentivity under the forced condition. On practical printing using the resulting master plate, 10,000 prints of clear image without background stains were obtained.

On the contrary, with the light-sensitive materials of Comparative Examples VI-3 and VI-4, the occurrence of slight background stain in non-image area, unevenness in highly accurate image of continuous gradation and unevenness of white spots in image portion was observed when the image formation was conducted under severe conditions. Further, as a result of the test on water retentivity of these light-sensitive materials to make offset master plates, the adhesion of ink was observed. On practical printing, scratches of image were observed from the start of printing.

From these results it is believed that the resin (A) and the resin (B) according to the present invention suitably interacts with zinc oxide particles to form the condition under which an oil-desensitizing reaction proceeds easily and sufficiently with an oil-desensitizing solution and that the remarkable improvement in film strength is achieved by the action of the resin (B).

EXAMPLES VI-3 TO VI-18

Each electrophotographic light-sensitive material was prepared in the same manner as described in Example VI-2, except for using each of Resins (A) and Resins (B) shown in Table VI-3 below in place of Resin (A-111) and Resin (B-202) used in Example VI-2, respectively. The electrostatic characteristics of the resulting light-sensitive materials were evaluated in the same manner as described in Example VI-2.

TABLE VI-3

| Example | Resin (A) | Resin (B) |
|---|---|---|
| VI-3 | A-104 | B-201 |
| VI-4 | A-107 | B-202 |
| VI-5 | A-108 | B-203 |
| VI-6 | A-110 | B-204 |
| VI-7 | A-111 | B-205 |
| VI-8 | A-112 | B-206 |
| VI-9 | A-113 | B-207 |
| VI-10 | A-114 | B-208 |
| VI-11 | A-120 | B-209 |
| VI-12 | A-123 | B-211 |
| VI-13 | A-124 | B-212 |
| VI-14 | A-125 | B-213 |
| VI-15 | A-127 | B-215 |
| VI-16 | A-129 | B-218 |
| VI-17 | A-130 | B-222 |
| VI-18 | A-135 | B-224 |

The electrostatic characteristics and image forming performance of each of the light-sensitive materials were determined in the same manner as described in Example VI-1. Each light-sensitive material exhibited good electrostatic characteristics. As a result of the evaluation on image forming performance of each light-sensitive material, it was found that clear duplicated images having good reproducibility of fine lines and letters and no occurrence of unevenness in half tone areas without the formation of background fog were obtained.

Further, when these electrophotographic light-sensitive materials were employed as offset master plate precursors under the same printing condition as described in Example VI-2, more than 10,000 good prints were obtained respectively.

It can be seen from the results described above that each of the light-sensitive materials according to the present invention was satisfactory in all aspects of the surface smoothness and film strength of the photoconductive layer, electrostatic characteristics and printing property.

EXAMPLES VI-19 TO VI-22

Each electrophotographic light-sensitive material was prepared in the same manner as described in Example VI-1, except for using each of the dye shown in Table VI-4 below in place of Methine Dye (VI-1) used in Example VI-1.

TABLE VI-4

| Example | Dye | Chemical Structure of Dye |
|---|---|---|
| VI-19 | (VI-III) | 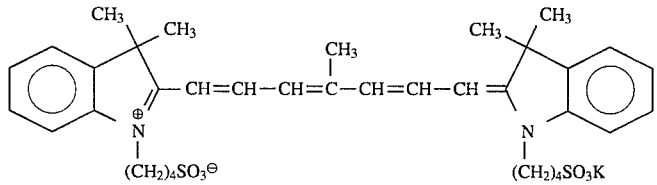 |
| VI-20 | (VI-IV) | 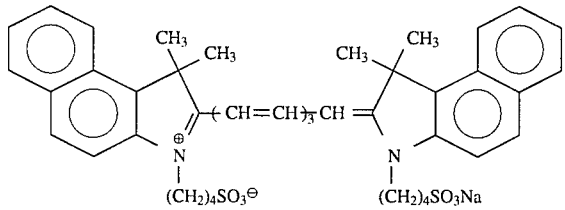 |
| VI-21 | (VI-V) | 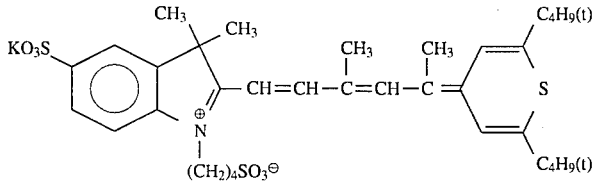 |
| VI-22 | (VI-IV) | 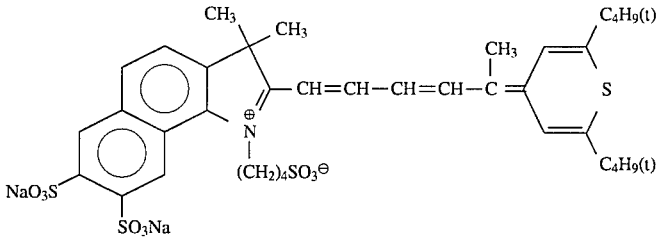 |

Each of the light-sensitive materials according to the present invention was excellent in charging properties, dark charge retention rate and photosensitivity, and provided clear duplicated images free from background fog even when processed under severe conditions of high temperature and high humidity (30° C. and 80% RH) and low temperature and low humidity (15° C. and 30% RH).

EXAMPLES VI-23 AND VI-24

A mixture of 6.5 g of Resin (A-101) (Example VI-23) or Resin (A-118) (Example VI-24), 33.5 g of Resin (B-223), 200 g of photoconductive zinc oxide, 0.02 g of uranine, 0.03 g of Methine Dye (VI-VII) having the following structure, 0.03 g of Methine Dye (VI-VIII) having the following structure, 0.18 g of p-hydroxybenzoic acid and 300 g of toluene was dispersed by a homogenizer at a rotation of $7\times10^3$ r.p.m. for 8 minutes to prepare a coating composition for a light-sensitive layer. The coating composition was coated on paper, which had been subjected to electrically conductive treatment, by a wire bar at a dry coverage of 22 $g/m^2$, and dried for 20 seconds at 110° C. Then, the coated material was allowed to stand in a dark place for 24 hours under the conditions of 20° C. and 65% RH to prepare each electrophotographic light-sensitive material.

Methine Dye (VI-VII)

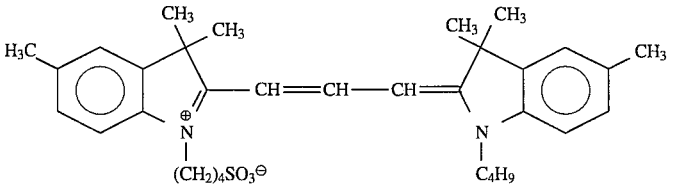

Methine Dye (VI-VIII)

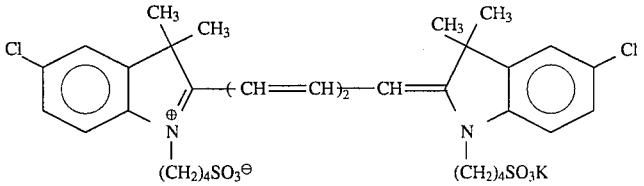

Comparative Example VI-5

An electrophotographic light-sensitive material was prepared in the same manner as in Example VI-23, except for using 33.5 g of Resin (R-VI-5) having the following structure in place of 33.5 g of Resin (B-223) used in Example VI-23.

Comparative Resin (R-VI-5)

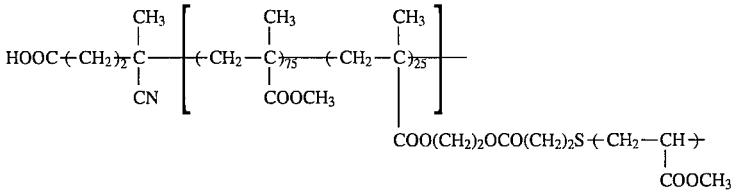

With each of the light-sensitive materials thus prepared, various characteristics were evaluated in the same manner as in Example VI-2. The results obtained are shown in Table VI-5 below.

TABLE VI-5

| | | Example VI-23 | Example VI-24 | Comparative Example VI-5 |
|---|---|---|---|---|
| Binder Resin | | (A-101)/(B-223) | (A-118)/(B-223) | (A-101)/(R-VI-5) |
| Smoothness of Photoconductive Layer (sec/cc) | | 380 | 360 | 350 |
| Mechanical Strength of Photoconductive Layer (%) | | 92 | 91 | 87 |
| Electrostatic Characteristics*7) | | | | |
| $V_{10}$ (−V) | I (20° C., 65% RH) | 690 | 740 | 660 |
| | II (30° C., 80% RH) | 675 | 725 | 645 |
| | III (15° C., 30% RH) | 695 | 750 | 670 |
| D.R.R. (%) | I (20° C., 65% RH) | 90 | 94 | 88 |
| | II (30° C., 80% RH) | 87 | 91 | 83 |
| | III (15° C., 30% RH) | 91 | 94 | 89 |
| $E_{1/10}$ (lux ·]sec) | I (20° C., 65% RH) | 10.5 | 9.3 | 11.4 |
| | II (30° C., 80% RH) | 10.8 | 10.0 | 12.0 |
| | III (15° C., 30% RH) | 11.5 | 10.7 | 13.0 |
| Image Forming*8) Performance | I (20° C., 65% RH) | Good | Very good | Good |
| | II (30° C., 80% RH) | Good | Very good | Slight unevenness in half tone area |
| | III (15° C., 30% RH) | Good | Very good | Slight unevenness in half tone area and image portion |
| Water Retentivity of Light-Sensitive Material | | Good | Good | Slight background stain |
| Printing Durability | | 10,000 Prints | 10,000 Prints | Unevenness in image portion occurred from the start of printing |

The characteristics were evaluated in the same manner as in Example VI-2, except that some electrostatic characteristics and image forming performance were evaluated according to the following test methods.

*7) Electrostatic Characteristics: $E_{1/10}$

The surface of the photoconductive layer was charged to −400 V with corona discharge, and then irradiated by visible light of the illuminance of 2.0 lux. Then, the time required for decay of the surface potential ($V_{10}$) to 1/10 thereof was determined, and the exposure amount $E_{1/10}$ (lux·sec) was calculated therefrom.

*8) Image Forming Performance

The electrophotographic light-sensitive material was allowed to stand for one day under the ambient condition described below, the light-sensitive material was subjected to plate making by a full-automatic plate making machine ELP-404V (manufactured by Fuji Photo Film Co., Ltd.) using ELP-T as a toner. The duplicated image thus obtained was visually evaluated for fog and image quality. The ambient condition at the time of image formation was 20° C. and 65% RH (I), 30° C. and 80% RH (II) or 15° C. and 30% RH (III). The original used for the duplication was composed of cuttings of other originals pasted up thereon.

From the results, it can be seen that each of the light-sensitive materials according to the present invention exhibited good mechanical strength of the photoconductive layer. On the contrary, with the light-sensitive material of Comparative Example VI-5 the value of mechanical strength was lower than them, and the value of $E_{1/10}$ of electrostatic characteristics degraded particularly under the ambient condition of low temperature and low humidity (III), while they were good under the ambient condition of normal temperature and normal humidity (I). On the other hand, the electrostatic characteristics of the light-sensitive materials according to the present invention were good. Particularly, those of Example VI-24 using the resin (A) having the specified substituent were very good.

With respect to image forming performance, the edge mark of cuttings pasted up was observed as background fog in the non-image areas in the light-sensitive material of Comparative Example VI-5. Also the occurrence of unevenness in half tone area of continuous gradation and unevenness of small white spots in image portion were observed on the duplicated image when the ambient conditions at the time of the image formation were high temperature and high humidity (II) and low temperature and low humidity (III).

Further, each of these light-sensitive materials was subjected to the oil-desensitizing treatment to prepare an offset printing plate and using the plate printing was conducted. The plates according to the present invention provided 10,000 prints of clear image without background stains. However, with the plate of Comparative Example VI-5, the above described edge mark of cuttings pasted up was not removed with the oil-desensitizing treatment and the background stains occurred from the start of printing.

It can be seen from the results described above that only the light-sensitive materials according to the present invention can have excellent performance.

EXAMPLE VI-25

A mixture of 5 g of Resin (A-123), 35 g of Resin (B-222), 200 g of photoconductive zinc oxide, 0.02 g of uranine, 0.04 g of Rose Bengal, 0.03 g of bromophenol blue, 0.40 g of phthalic anhydride and 300 g of toluene was treated in the same manner as described in Example VI-24 to prepare an electrophotographic light-sensitive material.

As the result of the evaluation of various characteristics in the same manner as described in Example VI-24, it can be seen that the light-sensitive material according to the present invention is excellent in charging properties, dark charge retention rate and photosensitivity, and provides a clear duplicated image free from background fog under severe conditions of high temperature and high humidity (30° C. and 80% RH) and low temperature and low humidity (15° C. and 30% RH). Further, when the material was employed as an offset master plate precursor, 10,000 prints of clear image were obtained.

EXAMPLES VI-26 TO VI-49

Each electrophotographic light-sensitive material was prepared in the same manner as described in Example VI-25, except for using 5 g of each of Resin (A) and 35 g of each of Resin (B) shown in Table VI-6 below in place of 5 g of Resin (A-123) and 35 g of Resin (B-222) used in Example VI-25, respectively.

TABLE VI-6

| Example | Resin (A) | Resin (B) |
|---|---|---|
| VI-26 | A-102 | B-202 |
| VI-27 | A-103 | B-203 |
| VI-28 | A-104 | B-205 |
| VI-29 | A-106 | B-210 |
| VI-30 | A-107 | B-214 |
| VI-31 | A-108 | B-215 |
| VI-32 | A-110 | B-216 |
| VI-33 | A-112 | B-217 |
| VI-34 | A-113 | B-218 |
| VI-35 | A-115 | B-219 |
| VI-36 | A-116 | B-220 |
| VI-37 | A-117 | B-221 |
| VI-38 | A-121 | B-223 |
| VI-39 | A-125 | B-225 |
| VI-40 | A-126 | B-226 |
| VI-41 | A-126 | B-224 |
| VI-42 | A-128 | B-206 |
| VI-43 | A-129 | B-222 |
| VI-44 | A-131 | B-209 |
| VI-45 | A-132 | B-208 |
| VI-46 | A-133 | B-221 |
| VI-47 | A-134 | B-215 |
| VI-48 | A-135 | B-214 |
| VI-49 | A-120 | B-211 |

Each of the light-sensitive materials according to the present invention was excellent in charging properties, dark charge retention rate and photosensitivity, and provided a clear duplicated image free from background fog and scratches of fine lines even under severe conditions of high temperature and high humidity (30° C. and 80% RH) and low temperature and low humidity (15° C. and 30% RH). Further, when these materials were employed as offset master plate precursors, 10,000 prints of a clear image free from background stains were obtained respectively.

POSSIBILITY OF UTILIZATION IN INDUSTRY

In accordance with the present invention, an electrophotographic light-sensitive material which exhibits excellent electrostatic characteristics (particularly, under severe conditions) and mechanical strength and provides clear images of good quality can be obtained. The electrophotographic light-sensitive material according to the present invention is particularly useful in the scanning exposure system using a semiconductor laser beam. The electrostatic characteristics are further improved by using the resin according to the present invention which contains a reapeating unit having the specific methacrylate component.

What is claimed is:

1. An electrophotographic light-sensitive material comprising a photoconductive layer containing at least an inorganic photoconductive substance, a spectral sensitizing dye and a binder resin, the binder resin comprising at least one resin selected from the group consisting of resin ($A_1$), resin ($A_2$) and resin ($A_3$) shown below and at least one resin (B) shown below:

Resin ($A_1$):

A copolymer having a weight average molecular weight of from $1\times10^3$ to $2\times10^4$ as determined by gel permeation chromatography and being formed from at least a monofunctional macromonomer ($M_1$) described below and a monomer corresponding to a repeating unit represented by the general formula (I) described below, wherein the copolymer has a polymer component containing at least one polar group selected from the group consisting of $—PO_3H_2$, $—SO_3H$, —COOH,

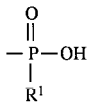

(wherein $R^1$ represents a hydrocarbon group or $—OR^2$ (wherein $R^2$ represents a hydrocarbon group)) and a cyclic acid anhydride group bonded at one terminal of the main chain thereof;

Monofunctional macromonomer ($M_1$):

A monofunctional macromonomer having a weight average molecular weight of not more than $2\times10^4$ as determined by gel permeation chromatography and having a polymerizable double bond group bonded at only one terminal of the main chain of a polymer containing not less than 30% by weight of a polymer component corresponding to a repeating unit represented by the general formula (I) described below:

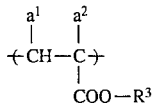

(I)

(wherein $a^1$ and $a^2$ each represents a hydrogen atom, a halogen atom, a cyano group, a hydrocarbon group, $—COOR^4$ or $—COOR^4$ bonded via a hydrocarbon group (wherein $R^4$ represents a hydrocarbon group); and $R^3$ represents a hydrocarbon group);

Resin ($A_2$):

A copolymer having a weight average molecular weight of from $1\times10^3$ to $2\times10^4$ as determined by gel permeation chromatography and being formed from at least a monofunctional macromonomer ($M_2$) described below and a monomer corresponding to a repeating unit represented by the general formula (I) described above;

Monofunctional macromonomer ($M_2$):

A monofunctional macromonomer having a weight average molecular weight of not more than $2\times10^4$ as determined by gel permeation chromatography and having a polymerizable double bond group at only one terminal of the main chain of a polymer containing at random not less than 30% by weight of a polymer component corresponding to a repeating unit represented by the general formula (I) described above and from 1 to 50% by weight of a polymer component containing at least one polar group selected from the specified polar groups as described in the resin ($A_1$) above;

Resin ($A_3$):

A copolymer having a weight average molecular weight of from $1\times10^3$ to $2\times10^4$ as determined by gel permeation chromatography and being formed from at least a monofunctional macromonomer ($M_3$) described below and a monomer corresponding to a repeating unit represented by the general formula (I) described above;

Monofunctional macromonomer ($M_3$):

A monofunctional macromonomer having a weight average molecular weight of not more than $2\times10^4$ as determined by gel permeation chromatography, comprising an AB block copolymer being composed of an A block containing a polymer component containing at least one polar group selected from the specified polar groups as described in the resin ($A_1$) above and a B block containing a polymer component corresponding to a repeating unit represented by the general formula (II) described below and having a polymerizable double bond group bonded at the terminal of the main chain of the B block polymer:

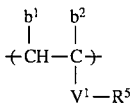

(II)

wherein $b^1$ and $b^2$ each represents a hydrogen atom, a halogen atom, a cyano group, a hydrocarbon group, —$COOR^4$ or —$COOR^4$ bonded via a hydrocarbon group (wherein $R^4$ represents a hydrocarbon group); $V^1$ represents —COO—, —OCO—, $$\text{-}(CH_2)_a\text{-}OCO\text{-},\quad \text{-}(CH_2)_a\text{-}COO\text{-}$$

(wherein a represents an integer of from 1 to 3), —O—, —$SO_2$—, —CO—, $$\text{-}\overset{Z^1}{\overset{|}{C}}ON\text{-},\quad \text{-}SO_2\overset{Z^1}{\overset{|}{N}}\text{-}$$

(wherein $Z^1$ represents a hydrogen atom or a hydrocarbon group), —CONHCOO—, —CONHCONH— or

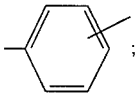

;

and $R^5$ represents a hydrocarbon group, provided that when $V^1$ represents

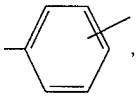

, $R^5$ represents a hydrogen atom or a hydrocarbon group;

Resin (B):

An AB block copolymer having a weight average molecular weight of from $3\times10^4$ to $1\times10^6$ as determined by gel permeation chromatography and comprising an A block comprising a polymer component containing at least one polar group selected from the specific polar groups as described in the resin ($A_1$) above and a B block containing a polymer component corresponding to a repeating unit represented by the general formula (I) as described in the resin ($A_1$) above, wherein the A block contains the polymer component containing the polar group in an amount of from 0.05 to 10% by weight based on the AB block copolymer and the B block contains the polymer component represented by the general formula (I) in an amount not less than 30% by weight based on the AB block copolymer.

2. An electrophotographic light-sensitive material as claimed in claim 1, wherein the resin ($A_1$), ($A_2$) or ($A_3$) contains, as the polymer component represented by the general formula (I), at least one methacrylate component having an aryl group represented by the following general formulae (Ia) or (Ib):

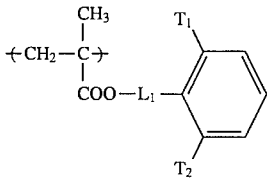

(Ia)

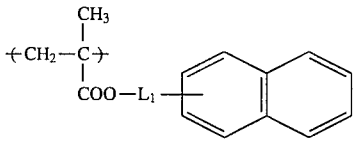

(Ib)

wherein $T_1$ and $T_2$ each represents a hydrogen atom, a halogen atom, a hydrocarbon group having from 1 to 10 carbon atoms, a cyano group, —$COR_a$ or —$COOR_a$ wherein $R_a$ represents a hydrocarbon group having from 1 to 10 carbon atoms; and $L_1$ and $L_2$ each represents a mere bond or a linking group containing from 1 to 4 linking atoms, which connects —COO— and the benzene ring.

3. An electrophotographic light-sensitive material as claimed in claim 1, wherein the total amount of the specific polar group-containing polymer component contained in the copolymer of the resin (B) is from 10 to 50% by weight based on the total amount of the specific polar group-containing polymer component present in the resin ($A_1$), ($A_2$) or ($A_3$).

4. An electrophotographic light-sensitive material as claimed in claim 1, wherein the resin ($A_2$) is a copolymer further having a polymer component containing at least one polar group selected from the specified polar groups described in the resin ($A_1$) above bonded at one terminal of the main chain thereof.

5. An electrophotographic light-sensitive material as claimed in claim 1, wherein the resin (B) is an AB block copolymer wherein the A block polymer chain and the B block polymer chain are bonded to each other as follows:

(A block)-b-(B block) wherein b represents a bond connecting two blocks present on both sides.

6. An electrophotographic light-sensitive material as claimed in claim 1, wherein the resin (B) is an AB block copolymer wherein the polar group-containing polymer component is bonded at one terminal of the A block polymer chain and the B block polymer chain is bonded at the other terminal of the A block polymer chain.

7. An electrophotographic light-sensitive material as claimed in claim 1, wherein the resin (B) is an AB block copolymer wherein the B block polymer chains are bonded at both terminals of the A block polymer chain.

* * * * *